US010781656B2

(12) United States Patent
Yuasa et al.

(10) Patent No.: US 10,781,656 B2
(45) Date of Patent: Sep. 22, 2020

(54) UNDERSEA MINING BASE, MINING BASE MONITORING DEVICE, AND CHIMNEY AVOIDANCE METHOD FOR SEABED DEPOSIT

(71) Applicant: Furukawa Co., Ltd., Chiyoda-ku, Tokyo (JP)

(72) Inventors: Fumio Yuasa, Tsukuba (JP); Yoshiyasu Watanabe, Shizuoka (JP)

(73) Assignee: Furukawa Co., Ltd., Tokyo (JP)

( * ) Notice: Subject to any disclaimer, the term of this patent is extended or adjusted under 35 U.S.C. 154(b) by 0 days.

(21) Appl. No.: 16/327,627

(22) PCT Filed: Aug. 22, 2017

(86) PCT No.: PCT/JP2017/029984
§ 371 (c)(1),
(2) Date: Feb. 22, 2019

(87) PCT Pub. No.: WO2018/038119
PCT Pub. Date: Mar. 1, 2018

(65) Prior Publication Data

US 2019/0186225 A1 Jun. 20, 2019

(30) Foreign Application Priority Data

Aug. 24, 2016 (JP) ..... 2016-163682

(51) Int. Cl.
*E21B 7/124* (2006.01)
*E21B 15/02* (2006.01)
(Continued)

(52) U.S. Cl.
CPC ..... *E21B 33/035* (2013.01); *E21B 15/02* (2013.01); *E21B 43/01* (2013.01); *E21C 50/00* (2013.01);
(Continued)

(58) Field of Classification Search
CPC ..... E21B 15/003; E21B 15/02; E21B 33/035; E21B 43/01; E21C 50/00
See application file for complete search history.

(56) References Cited

U.S. PATENT DOCUMENTS

2009/0218136 A1* 9/2009 Asakawa ..... E21B 7/124 175/6
2013/0241263 A1 9/2013 Jones et al.
(Continued)

FOREIGN PATENT DOCUMENTS

JP H04-169694 A 6/1992
JP H05-256082 A 10/1993
(Continued)

OTHER PUBLICATIONS

English translation of the International Preliminary Report on Patentability in corresponding Japanese Patent Application No. PCT/JP2017/029984, dated Mar. 7, 2019, 11 pgs.

*Primary Examiner* — Matthew R Buck
(74) *Attorney, Agent, or Firm* — Young Basile Hanlon & MacFarlane, P.C.

(57) ABSTRACT

Provided is an undersea mining base capable of corresponding with slopes and undulations of seabed ore deposits. The undersea mining base includes a seabed mineral mining device configured to form a pit in a seabed ore deposit and a platform equipped with the seabed mineral mining device and capable of self-traveling in at least one of an X direction and a Y direction.

21 Claims, 36 Drawing Sheets

(51) Int. Cl.

| | |
|---|---|
| ***E21B 33/035*** | (2006.01) |
| ***E21B 43/01*** | (2006.01) |
| ***E21C 50/00*** | (2006.01) |
| *E21B 7/12* | (2006.01) |
| *E21B 33/076* | (2006.01) |
| *E21B 43/36* | (2006.01) |

(52) U.S. Cl.
CPC ..... *E21B 7/12* (2013.01); *E21B 33/076* (2013.01); *E21B 43/36* (2013.01)

(56) References Cited

U.S. PATENT DOCUMENTS

| | | | | |
|---|---|---|---|---|
| 2015/0361768 | A1* | 12/2015 | Takai | E21B 43/36<br>166/351 |
| 2018/0355674 | A1* | 12/2018 | Cooper | E21B 15/02 |

FOREIGN PATENT DOCUMENTS

| | | | | |
|---|---|---|---|---|
| JP | 07248817 | A | * | 9/1995 |
| JP | 2004-204440 | A | | 7/2004 |
| JP | 2004204440 | A | * | 7/2004 |
| JP | 2005-030138 | A | | 2/2005 |
| JP | 2005030138 | A | * | 2/2005 |
| JP | 2013-528726 | A | | 7/2013 |
| JP | 2013-163902 | A | | 8/2013 |
| JP | 2016-000930 | A | | 1/2016 |
| WO | 2013/118876 | A1 | | 8/2013 |

* cited by examiner

UNDERSEA MINING BASE, MINING BASE MONITORING DEVICE, AND CHIMNEY AVOIDANCE METHOD FOR SEABED DEPOSIT

CROSS REFERENCE TO RELATED APPLICATION

This application claims priority to Japanese Patent Application No. 2016-163682, filed Aug. 24, 2016, which is herein incorporated by reference in its entirety.

TECHNICAL FIELD

The present invention relates to a technology for mining seabed minerals.

BACKGROUND

Recent years have seen rising prices of useful metals, which are those essential to manufacture various kinds of industrial equipment but abundance thereof is lacking. Useful metals are essential in industry, but there are small amounts of them that can be mined, as well as the number of producing countries is limited, so that geopolitical risks are present. Then, among seabed minerals, useful metal-containing minerals present under the seabed are drawing attention.

Various investigations have shown that seabed minerals contain useful metals at higher concentrations, as compared with minerals currently mined on ground. Accordingly, in the recent years, various institutions have conducted trial mining and investigations, and also, various methods and systems for mining seabed minerals have been proposed (e.g., see JP 2013-528726 A).

JP 2013-528726 A discloses a seabed mineral mining system. The mining system disclosed in the literature includes a seabed locomotion device having a cutting tool capable of cutting a surface of a seabed ore deposit. While receiving power and control signals from a supply source on a sea level side and traversing the seabed, the seabed locomotion device cuts the surface of a seabed ore deposit by an open-type cutting tool. Cuttings produced by the cutting are sized by sizing means to ensure that such cuttings are no greater than a predetermined size, and the sized cuttings are transported up to the sea level.

BRIEF SUMMARY

However, in the technology disclosed in JP 2013-528726 A, a crawler-type cutting machine has a problem where operation corresponding with seabed unevenness is complicated, which makes automation difficult. In addition, on seabed ore deposits, there are seamounts with large slope angles, which are obstacles to a crawler traveling on soft ground accumulated on the surfaces thereof.

Accordingly, the present invention has been accomplished focusing on such problems. It is an object of the present invention to provide an undersea mining base capable of corresponding with slopes and undulations of seabed ore deposits, a mining base monitoring device, and a method for avoiding chimneys of seabed ore deposits.

In order to achieve the object mentioned above, according to an aspect of the present invention, there is provided an undersea mining base arranged undersea and erected on a seabed, the undersea mining base mining seabed minerals while forming a bottomed hole in a seabed ore deposit, and collecting the mined seabed minerals from an inside of the bottomed hole, the undersea mining base including: a seabed mineral mining device configured to form the bottomed hole in the seabed ore deposit and a platform equipped with the seabed mineral mining device; wherein the platform includes a plurality of support legs, each of the support legs being configured to be individually relatively slidable in a Z direction via a vertical movement mechanism.

In the undersea mining base according to the one aspect of the present invention, the platform erected on the seabed is equipped with the seabed mineral mining device, and includes the plurality of support legs. Each support leg is configured to be individually relatively slidable in the Z direction via the vertical movement mechanism, thus enabling the undersea mining base to correspond with slopes and undulations of seabed ore deposits.

In addition, in order to achieve the object mentioned above, according to another aspect of the present invention, there is provided an undersea mining base arranged undersea and erected on a seabed, the undersea mining base mining seabed minerals while forming a bottomed hole in a seabed ore deposit, and collecting the mined seabed minerals from an inside of the bottomed hole, the undersea mining base including: a seabed mineral mining device configured to form the bottomed hole in the seabed ore deposit and a platform equipped with the seabed mineral mining device and self-movable in at least one of an X direction and a Y direction orthogonal to each other in a horizontal plane.

In the undersea mining base according to the other aspect of the present invention, the platform erected on the seabed is equipped with the seabed mineral mining device, and is movable by itself in at least one of the X and Y directions, thus enabling the undersea mining base to correspond with the slopes and undulations of seabed ore deposits.

Herein, in the undersea mining base according to the other aspect of the present invention, preferably, the platform includes an upper platform, a lower platform, and a middle frame arranged between the upper and lower platforms, in which the middle frame and the upper platform are configured to be relatively slidable in one direction via a horizontal movement mechanism, the middle frame and the lower platform are configured to be relatively slidable in an other direction orthogonal to the one direction via a horizontal movement mechanism, and each of the upper and lower platforms includes a plurality of support legs, each of the support legs being configured to be individually relatively slidable in a Z direction via a vertical movement mechanism. The structure thus formed is suitable to correspond with the slopes and undulations of seabed ore deposits.

Additionally, preferably, the undersea mining base according to any one of the aspects of the present invention further includes chimney detection means configured to detect at least one chimney on the seabed ore deposit. The structure thus formed enables chimney detection on seabed ore deposits, and therefore is more suitable to correspond with the slopes and undulations of the seabed ore deposits.

Furthermore, to solve the above problems, a mining base monitoring device according to one aspect of the present invention is a mining base monitoring device equipped in an offshore base or a land base to monitor the undersea mining base according to any one of the aspects of the present invention, and is characterized by including chimney monitoring means configured to monitor the chimney of the seabed ore deposit.

In the mining base monitoring device according to the one aspect of the present invention, when an operator monitors an undersea mining base in the offshore base or the land base, he or she can monitor chimneys on a seabed ore deposit in the offshore base or the land base, so that it is possible to correspond with the slopes and undulations of the seabed ore deposit.

In addition, in order to achieve the object mentioned above, according to still another aspect of the present invention, there is provided a method for avoiding a chimney on a seabed ore deposit, which is a method for avoiding interference between a work device used on a seabed ore deposit and configured to perform work necessary to mine while self-travelling on a seabed and a chimney on the seabed ore deposit, the method including: detecting the chimney on the seabed ore deposit on a basis of an echo obtained by underwater detection through transmission and reception of an ultrasonic wave; and avoiding the interference between the work device and the chimney on a basis of position information of the chimney obtained at the detecting.

In the method for avoiding a chimney on a seabed ore deposit according to the one aspect of the present invention, the chimney on the seabed ore deposit is detected on the basis of the echo obtained by underwater detection through transmission and reception of an ultrasonic wave, and interference between a work device and the chimney is avoided on the basis of the position information of the chimney obtained at the chimney detection step, so that it is possible to correspond with the slopes and undulations of the seabed ore deposit.

As mentioned above, according to the present invention, it is possible to correspond with the slopes and undulations of the seabed ore deposit.

BRIEF DESCRIPTION OF THE DRAWINGS

FIGS. 2A and 2B are schematic illustrative diagrams of an undersea mining base of the mining system of FIG. 1, in which FIG. 2A is a plan view, and FIG. 2B is a front view of an undersea mining base (in which the part of a seabed ore deposit depicts a cross-sectional image (hereinafter the same in front view)), which are each schematically represented.

FIGS. 7A and 7B are illustrative diagrams of a seabed mineral mining method by the mining system of FIG. 1, in which FIG. 7A is a front view of an undersea mining base, and FIG. 7B is a plan view of one section of a seabed ore deposit, which are each schematically represented.

FIGS. 8A and 8B are illustrative diagrams of a seabed mineral mining method by the mining system of FIG. 1, in which FIG. 8A is a front view of an undersea mining base, and FIG. 8B is a plan view of one section of a seabed ore deposit, which are each schematically represented.

FIGS. 34A to 34C are diagrams illustrating one embodiment of an erection and installation mother ship for use in the mining system of the present invention, in which FIG. 34A is a plan view, FIG. 34B is a front view, and FIG. 34C is a right side view.

DETAILED DESCRIPTION

Hereinafter, an embodiment of the present invention will be described with reference to the drawings as appropriate. However, the drawings are schematic. Therefore, it should be noted that a relation and ratio between thickness and planar dimensions, and the like are different from actual ones, and portions where dimensional relations and ratios are different from one another among the drawings are also included. In addition, the embodiment, which will be described below, exemplify a device and method to embody a technical idea of the present invention, and the technical idea of the present invention does not limit materials, shapes, structures, arrangements, and the like of the constituent components to those described in the embodiments below.

First, a description will be given of the entire structure of a mining system of the present embodiment.

Figure 1:
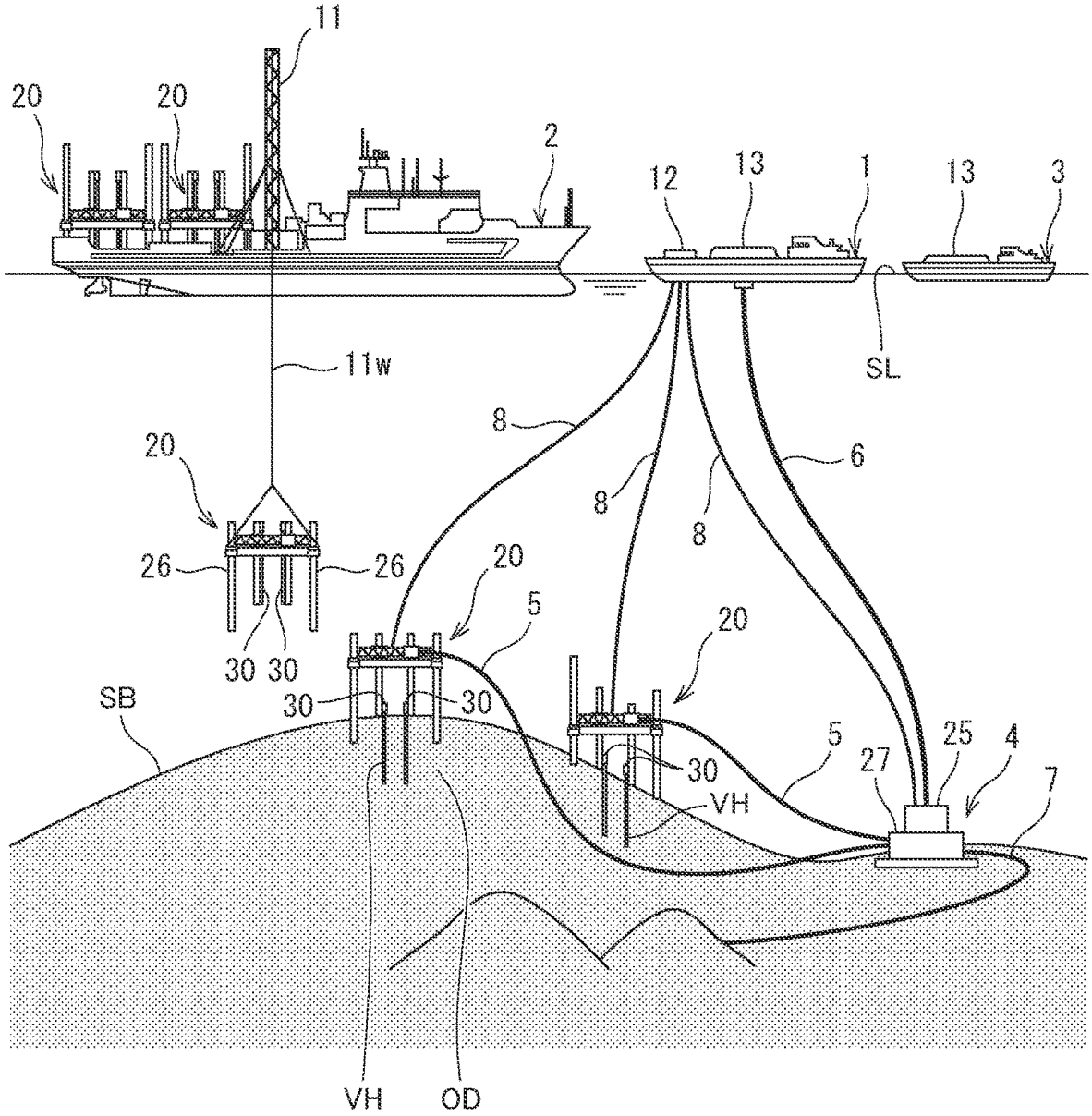
FIG. 1 is a schematic diagram illustrating one embodiment of the entire structure of a seabed mineral mining system according to one aspect of the present invention.

As illustrated in FIG. 1, the mining system includes a mining mother ship 1 that is placed as an offshore mining base on a sea level SL, a mining station 20, and a mineral lifting unit 4 that are placed on a seabed SB. In the mining system, a plurality of mining stations 20 are used as undersea mining bases. Each mining station 20 is equipped with a plurality of seabed mineral mining devices 30 (hereinafter also referred to as "mining devices 30").

Each mining device 30 is configured to be capable of forming a pit that is a bottomed hole in a seabed ore deposit OD by drilling. Additionally, each mining device 30 is configured to be capable of mining by forming seabed minerals into a slurry in the pit. Then, the mining system transfers the slurry of the seabed minerals mined by each mining device 30 to the undersea mineral lifting unit 4 via a suction pipe 5. The mineral lifting unit 4 is configured to lift the minerals up to the mining mother ship 1 via a mineral lifting pipe 6.

Specifically, in an example of the present embodiment, the mining mother ship 1, an erection and installation mother ship 2, and a carrier ship 3 are anchored at the sea level SL in a target sea region. The erection and installation mother ship 2 is a mother ship for erection and installation configured to carry the mineral lifting unit 4 and the plurality of mining stations 20 and erect and install them on the seabed SB. The erection and installation mother ship 2 is equipped with a work machine 11 such as a crane or the like for erecting and installing the mineral lifting unit 4 and the mining stations 20 on the seabed SB. The erection and installation mother ship 2 carries the mining stations 20 to a predetermined position on the seabed ore deposit OD, and hangs down the mining stations 20 with a winch 11*w* of the work machine 11 to erect them on the seabed SB. Additionally, similarly, the erection and installation mother ship 2 installs the mineral lifting unit 4 at an appropriate position on the seabed SB.

The mining mother ship 1 is mounted with a power generator 12 and a reservoir 13, as well as an unillustrated management computer. The reservoir 13 is replaceably mounted on the ship. The management computer and the power generator 12 are connected to the mining stations 20 and the mineral lifting unit 4 installed on the seabed SB via an umbilical cable 8 to enable supply of electrical power and control signals necessary to operate the mining stations 20 and the mining devices 30, as well as the mineral lifting unit 4.

The mineral lifting unit 4 includes a mineral lifting pump 25 and a sizer 27 with a cyclone device. A discharge side of the sizer 27 is connected to a suction side of the mineral lifting pump 25 in the mineral lifting unit 4. A suction side of the sizer 27 is connected to each mining station 20 via the suction pipe 5. Sea water is filled in the suction pipe 5. One end of a discharge pipe 7 is connected to the sizer 27, and the other end of the discharge pipe 7 is piped to a place for returning and leaving minerals determined to be unnecessary by sizing. Note that flexible pipes are used for the suction pipe 5, the mineral lifting pipe 6, and the discharge pipe 7.

The mineral lifting pump 25 is connected to the mining mother ship 1 via the mineral lifting pipe 6. The mineral lifting pipe 6 is a cylindrical pipeline having flexible properties for lifting the slurry of the seabed minerals mined by each mining station 20 up to the mining mother ship 1. Sea water is filled in the mineral lifting pipe 6. An upper portion of the mineral lifting pipe 6 reaches the mining mother ship 1 on the sea level SL, and is connected to the reservoir 13 via a ship bottom of the mining mother ship 1. The reservoir 13 stores the mineral slurry lifted up from the mineral lifting pipe 6 by the mineral lifting pump 25. The carrier ship 3 replaces the reservoir 13 with that of the mining mother ship 1, and transfers the seabed mineral lifted to the mining mother ship 1 to a necessary place.

Figure 2A:
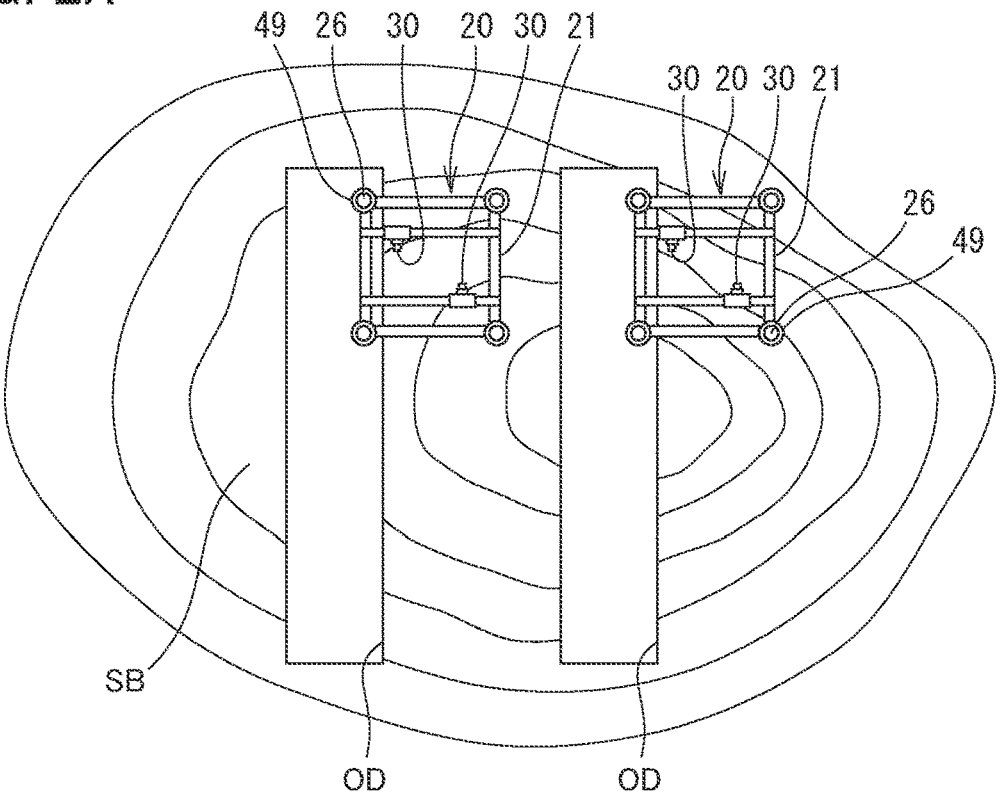
Figure 2B:
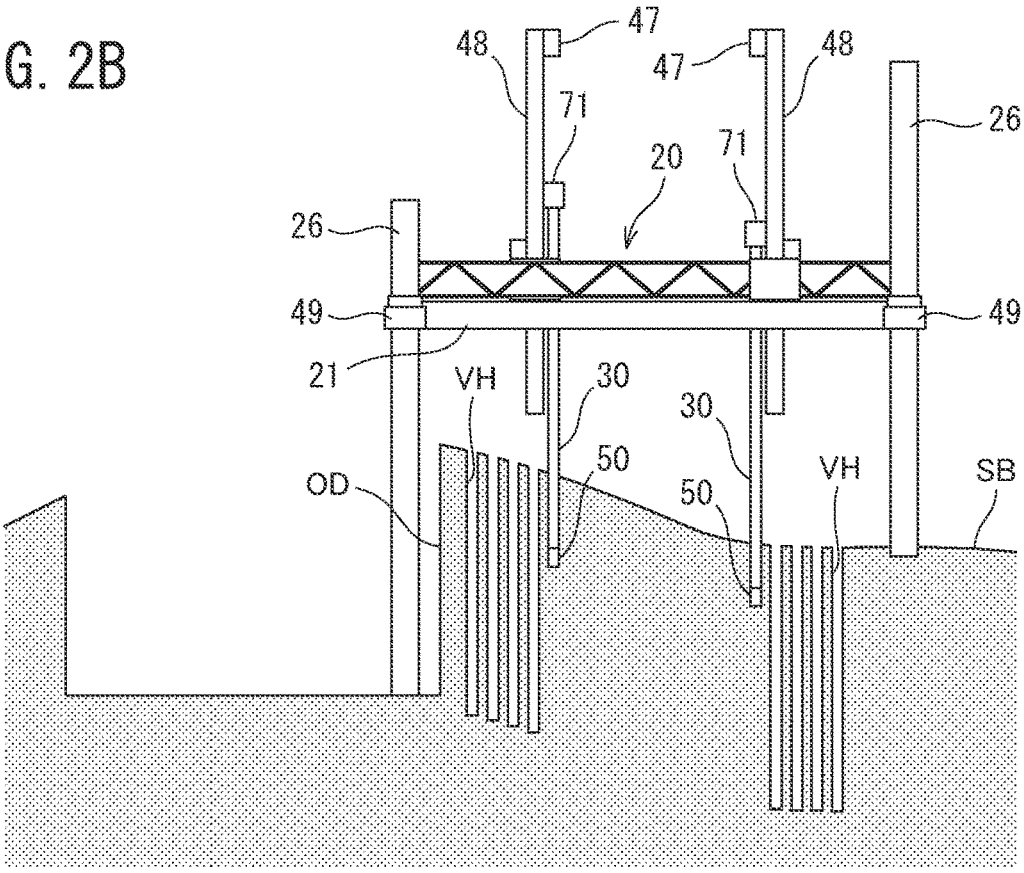

Next, the mining stations 20 will be described in detail. As illustrated in FIGS. 2A and 2B, each mining station 20 includes a rectangular frame-shaped base frame 21 configured to serve as a platform. The base frame 21 is supported by a plurality of (four in this example) support legs 26 at four corners of the frame. Each support leg 26 is fixed to the base frame 21 via a jack mechanism 49.

The jack mechanism 49 includes a motor, a deceleration mechanism, and a rack and pinion mechanism, which are unillustrated. The rack is formed along an axial direction of each support leg 26. The jack mechanism 49 drives the rack and pinion mechanism by the motor via the deceleration mechanism to be able to slide the support leg 26 in a vertical direction (a Z direction) and maintain a position to which the support leg 26 has been moved. Note that the motor for driving the jack mechanism 49 may be driven by fluid pressure (e.g., hydraulically driven) or driven by electrical power (e.g., an electromagnetic motor) (hereinafter the same in other driving motors).

Figure 3:
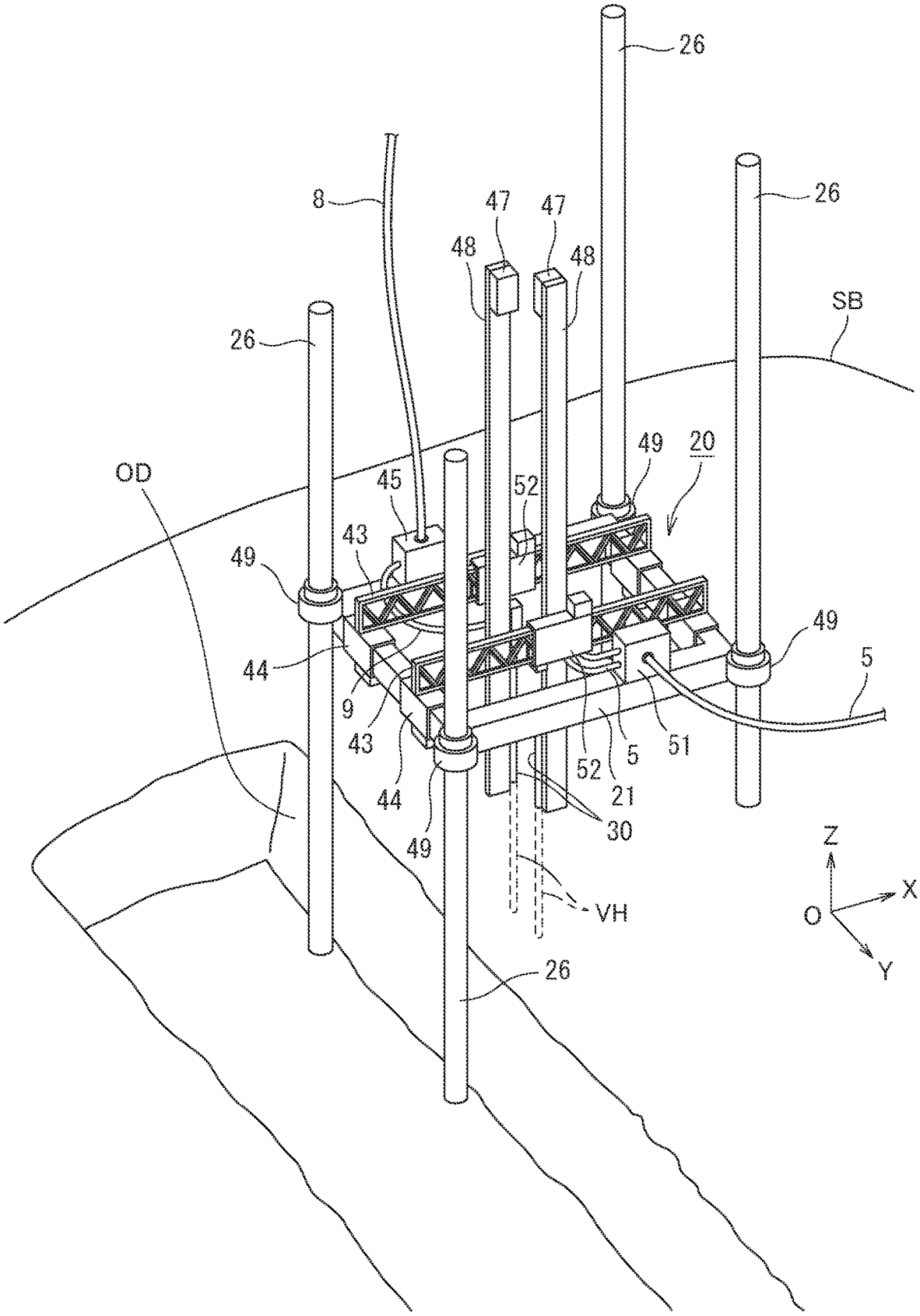
FIG. 3 is a schematic perspective diagram illustrating a first embodiment of the undersea mining base of FIGS. 2A and 2B.

In this example, as illustrated in FIG. 3, two movement frames 43 are stretched across the base frame 21 along an X direction. The movement frames 43 have, for example, a truss structure. Both ends of each movement frame 43 are supported on the base frame 21 via a Y-direction movement mechanism 44. The Y-direction movement mechanism 44 includes a motor, a deceleration mechanism, and a rack and pinion mechanism, which are unillustrated, and drives the rack and pinion mechanism by the motor via the deceleration mechanism to be able to slide the movement frame 43 in the Y direction along the base frame 21.

In each movement frame 43, a guide shell 48 is longitudinally arranged. Each guide shell 48 forms a feeding mechanism for each mining device 30 in the Z direction. The guide shell 48 is supported on the movement frame 43 via an X-direction movement mechanism 52. The X-direction movement mechanism 52 includes a motor, a deceleration mechanism, and a rack and pinion mechanism, which are unillustrated, and drives the rack and pinion mechanism by the motor via the deceleration mechanism to be able to slide the guide shell 48 in the X direction along the movement frame 43.

Furthermore, the base frame 21 includes a base control unit 45 and a suction chamber 51. The umbilical cable 8 is connected to the base control unit 45. To drive the mining station 20 and the mining device 30, the base control unit 45 incorporates a high pressure water supply pump, a motor for driving the high pressure water supply pump, and a control unit configured to control operation of the entire mining station 20, which are unillustrated.

This allows each mining station 20 to receive, in the base control unit 45, necessary electrical power and control signals supplied from the mining mother ship 1 via the umbilical cable 8. The base control unit 45 serves as a controller configured to control the posture of each mining station 20 by driving of each jack mechanism 49 on the basis of a command of the management computer on the mining mother ship 1 side.

Furthermore, each mining station 20 can move the guide shell 48 in the X direction and the Y direction by driving of the X-direction movement mechanism 52 and the Y-direction movement mechanism 44 by the base control unit 45, and can supply sea water taken in, as high pressure water, to each mining device 30 by driving of the high pressure water supply pump to drive each mining device 30 provided on the guide shell 48, under management of the management computer.

Next, the mining devices 30 equipped in each mining station 20 will be described in detail.

Figure 4:
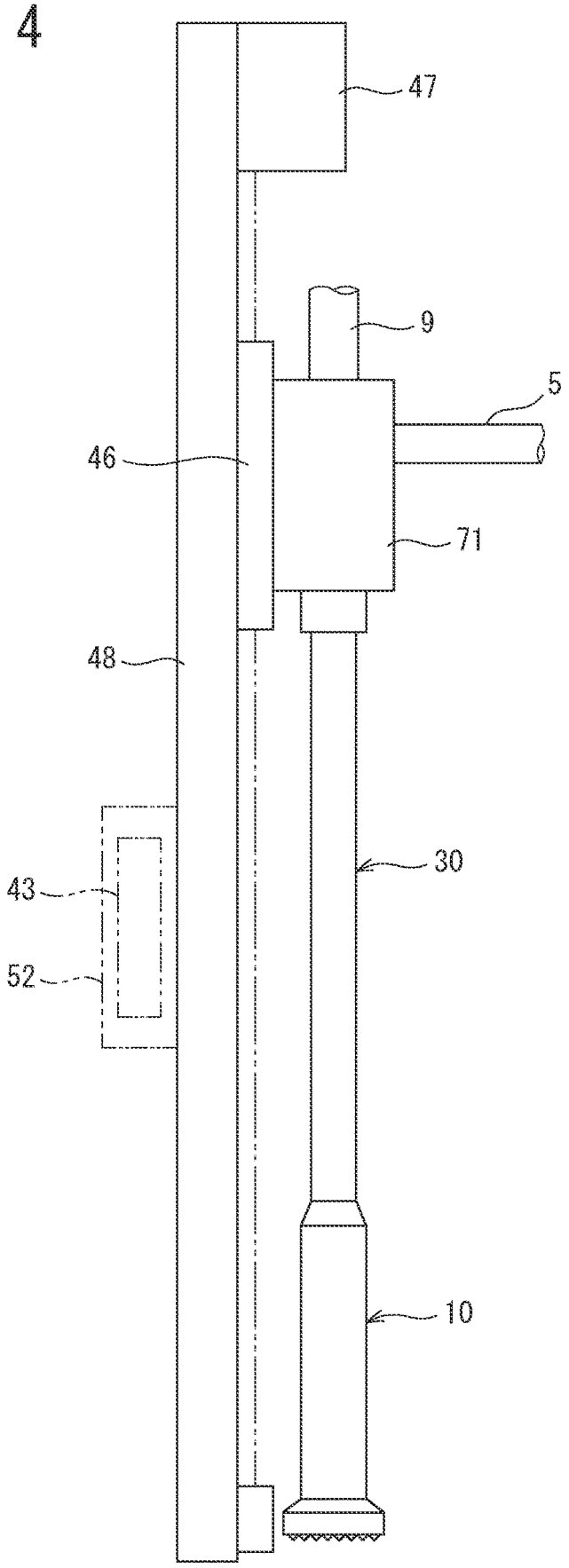
FIG. 4 is a schematic front view illustrating a seabed mineral mining device equipped in the undersea mining base.

As illustrated in FIG. 4, each guide shell 48 is equipped with the mining device 30 via a slider 46. At an upper portion of the guide shell 48 is provided a slide movement mechanism 47 configured to slide the slider 46 in the Z direction along the guide shell 48. The slide movement mechanism 47 includes a motor, a deceleration mechanism, and a rack and pinion mechanism, which are not unillustrated, and drives the rack and pinion mechanism by the motor via the deceleration mechanism to be able to slide the slider 46 in the Z direction along the guide shell 48.

Each mining device 30 includes a housing unit 71 attached to the slider 46. The housing unit 71 incorporates a rotating drive mechanism and a swivel, which are unillustrated. In the housing unit 71, an upper portion of the housing unit 71 is connected to the high pressure water supply pump of the base control unit 45 via a high pressure water supply pipe 9. Additionally, to a side face of the housing unit 71 is connected one end of the suction pipe 5 for suctioning the slurry of minerals mined by driving of the mining device 30. The other end of the suction pipe 5 is connected to the sizer 27 via the suction chamber 51.

Next, the structure of a mining device main body of the mining device 30 will be described in more detail.

Figure 5:
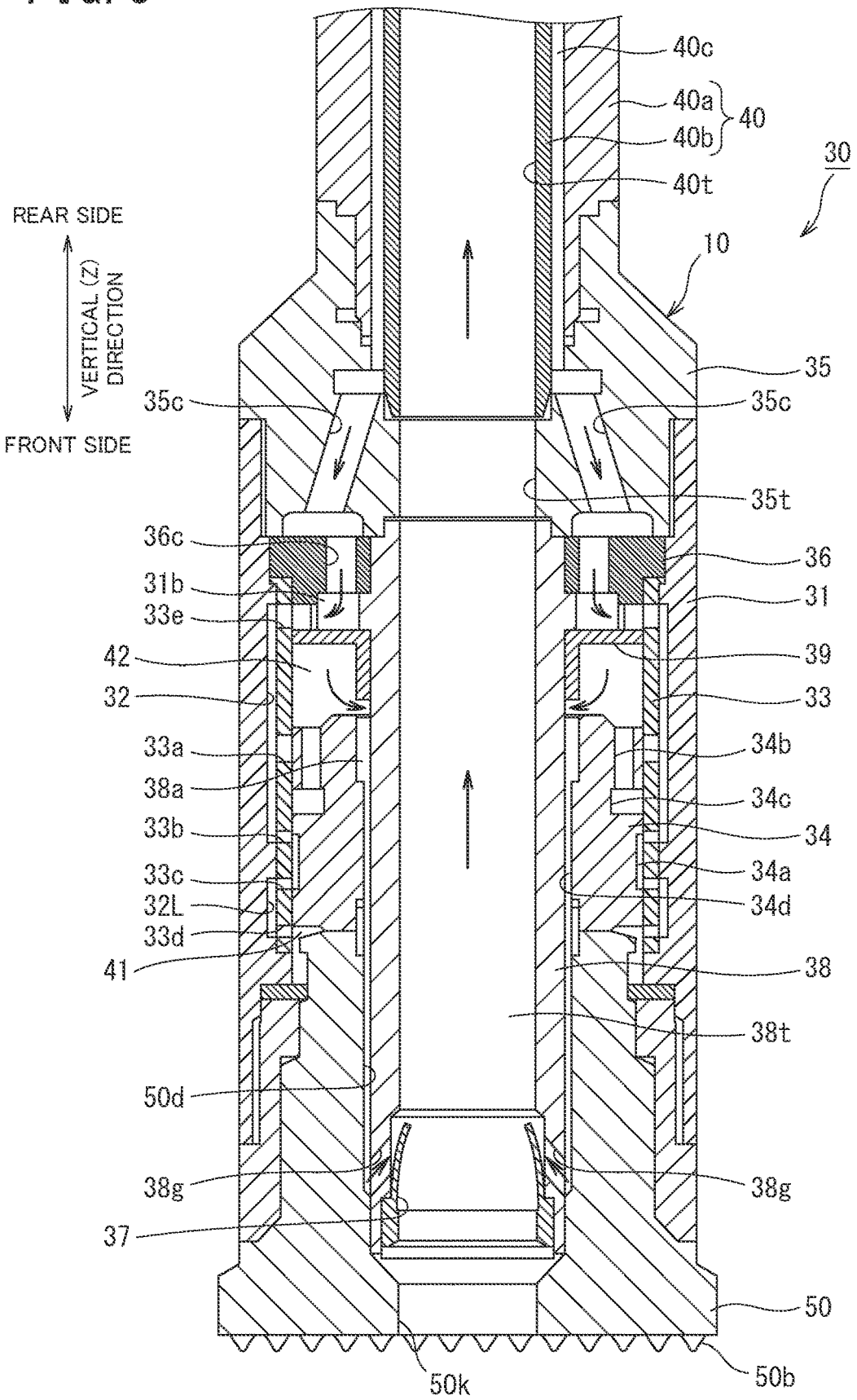
FIG. 5 is an illustrative diagram (a hammer advanced state) of a mining device main body of the seabed mineral mining device of FIG. 4, the diagram illustrating a longitudinal cross-section including an axis line.

As illustrated in FIG. 5 by enlarging the mining device main body, the mining device 30 is equipped with a mining device main body 10 at a portion ahead of a double pipe rod 40. The mining device main body 10 includes a cylindrical cylinder 31. A substantially cylindrical cylinder liner 33 is fitted into an inner peripheral surface of the cylinder 31. Between the cylinder 31 and the cylinder liner 33 is formed a water passage hole 32 along an axial direction of the cylinder 31.

A substantially cylindrical hammer 34 is held in the cylinder liner 33 in such a manner as to be reciprocally slidable. A rear end of the cylinder 31 is connected to the double pipe rod 40 of the mining device 30 via a connection member 35. The double pipe rod 40 is formed by a double pipe including an outer cylinder 40*a* and an inner cylinder 40*b* coaxially. A water supply passage 40*c* is formed in a gap between the outer cylinder 40*a* and the inner cylinder 40*b*. An upstream side of the water supply passage 40*c* is connected to the high pressure water supply pipe 9 via the swivel of the housing unit 71. The high pressure water supply pipe 9 is connected to a discharge side of the high pressure water supply pump provided in the base control unit 45 of the mining station 20. A downstream side of the water supply passage 40*c* is communicating with a water supply passage 35*c* in the connection member 35.

A cylinder bush 36 is inserted between the rear end of the cylinder 31 and a front end face of the connection member 35. In a front side of the cylinder bush 36 is inserted a ring 39 for forming a cylinder rear chamber 42. By doing this, the cylinder rear chamber 42 is defined between the ring 39 and a rear portion of the hammer 34. In the cylinder bush 36 is provided a communication hole 36*c* communicating with the water supply passage 35*c* along the axial direction.

A bit 50, which is a crushing tool for striking, is attached to a front end of the cylinder 31. A cylinder front chamber 41 is defined between a rear end of the bit 50 and a front part of the hammer 34. The bit 50 covers a front side face of the cylinder front chamber 41, and is attached such that a rear end of its own receives a striking force from the hammer 34 so as to be reciprocally slidable at a predetermined stroke in the axial direction. On an outer peripheral surface of the hammer 34 are formed a plurality of control grooves 34*a* and 34*c* and a communication flow passage 34*b*.

In the cylinder 31, a first water inlet hole 31*b* is formed between the front side of the cylinder bush 36 and the ring 39. The first water inlet hole 31*b* allows the communication hole 36*c* of the cylinder bush 36 and a communication hole 33*e* of a rear end of the cylinder liner 33 to communicate with each other. The communication hole 33*e* of the cylinder liner 33 is communicating with the water passage hole 32. The water passage hole 32 allows the control grooves 34*a* and 34*c* of the hammer 34 to communicate with a plurality of communication holes 33*a* to 33*d* of the cylinder liner 33 at predetermined positions in accordance with a position of the hammer 34 in the axial direction to form a hammer reciprocation switch mechanism for supplying and discharging high pressure water to and from the cylinder front chamber 41 or the cylinder rear chamber 42 so as to move the hammer 34 forward and backward in the cylinder 31.

Furthermore, in the cylinder 31, a cylindrical sleeve 38 is provided coaxially with the cylinder 31. Inside the sleeve 38, a suction hole 38*t* is penetratingly formed along the axial direction. The sleeve 38 holds a position in the axial direction by a stepped portion formed at a rear portion thereof and inserted into the cylinder bush 36 and the ring 39. A rear end of the suction hole 38*t* of the sleeve 38 communicates with a front end of the suction hole 40*t* of the inner cylinder 40*b* of the double pipe rod 40 via the suction hole 35*t* of the connection member 35.

An intermediate portion of the sleeve 38 is inserted through a communication hole 34*d* penetratingly formed in the hammer 34 via a gap, and a front end of the sleeve 38 is inserted in a communication hole 50*d* penetratingly formed in the bit 50, via a gap. In the sleeve 38, gap portions in a radial direction inserted in the hammer 34 and the bit 50 form a drainage passage 38*a* from the cylinder front chamber 41 and the cylinder rear chamber 42.

In the sleeve 38, a discharge hole 38*g* is formed at a position on a leading end side of the drainage passage 38*a*. The discharge hole 38*g* is inclined toward the suction hole 38*t* at the center of the sleeve 38 from an outer periphery thereof, and also rearwardly toward the direction of the double pipe rod 40. In the suction hole 38*t* of the sleeve 38, a flexible check valve 37 is installed at an outlet of the discharge hole 38*g* to prevent earth and sand, or the like from entering the cylinder front chamber 41.

At a front end of the bit 50, a water suction hole 50*k* is opened that communicates with the suction hole 38*t* at the center of the sleeve 38. In this manner, in the mining device 30, flow velocity of high pressure water discharged rearwardly from the discharge hole 38*g* toward the suction hole 38*t* produces negative pressure in the water suction hole 50*k*, whereby the seabed mineral suctioned from the water suction hole 50*k* is mixed with sea water in the suction hole 38*t*.

Accordingly, in the mining device 30, seabed minerals crushed by drilling are suctioned into the mining device 30 by a drainage flow and mixed with the sea water in the suction hole 38*t* to be able to produce a slurry. Additionally, in the mining device 30, the produced slurry can be collected from the suction hole 40*t* of the inner cylinder 40*b* of the double pipe rod 40. Furthermore, since the mineral lifting pump 25 is connected to an upper end of the inner cylinder 40*b* of the double pipe rod 40 via the suction pipe 5, the seabed minerals crushed by drilling can be suctioned through the water suction hole 50*k* of the bit 50 and lifted up to the mining mother ship 1 on the sea level.

Next, a description will be given of steps of lifting minerals from a seabed ore deposit OD by the above-described mining system, and operations and effects of the seabed mineral mining system and a seabed mineral mining method by the mining device 30.

First, as illustrated in FIG. 1, the mining mother ship 1 and the erection and installation mother ship 2 are anchored on the sea level SL in a target sea region. Next, the mining stations 20 and the mineral lifting unit 4 are lifted down into the sea by using the work machine 11 such as a crane installed on the erection and installation mother ship 2, and installed at appropriate positions on the seabed SB such that these pieces of equipment are arranged as illustrated in FIG. 1. Before or after installation of these pieces of equipment, necessary piping and wiring for the suction pipe 5, the mineral lifting pipe 6, the discharge pipe 7, the umbilical cable 8, and the like are performed, and the respective pipes are filled with sea water.

After the installation of the equipment, necessary electric power and control signals are supplied to the base control unit 45 and the mineral lifting unit 4 from the mining mother ship 1 via the umbilical cable 8, whereby the mining stations 20, the mining devices 30, and the mineral lifting unit 4 are driven to crush seabed minerals while drilling a pit VH that is a bottomed hole in the seabed ore deposit OD. Note that, in the present embodiment, when arranging each of the mining stations 20 on the seabed ore deposit OD, the support legs 26 at the four corners of the base frame 21 are slid vertically in advance by the jack mechanism 49 in accordance with an uneven shape of the seabed SB so that the base frame 21 is in horizontal posture.

Herein, the high pressure water supplied from the high pressure water supply pump provided in the base frame 21 of each mining station 20 passes through the water supply passage 40*c* between the inner cylinder 40*b* and the outer cylinder 40*a* of the double pipe rod 40 of the mining device 30, and enters the water passage hole 32 through the communication hole 33*e* from the first water inlet hole 31*b*, from the water supply passage 35*c* of the connection member 35, in FIG. 5.

The high pressure water, having entered the water passage hole 32, is introduced to the hammer reciprocation switch mechanism. In the hammer reciprocation mechanism, the high pressure water in a hammer advanced state passes through in the order of the communication hole 33*b* of the cylinder liner 33, the control grooves 34*a*, and the communication holes 33*c*, 32L, and 33*d*, and enters the cylinder front chamber 41 at a front end of the hammer 34. In this case, the control groove 34*c* is disconnected from the communication hole 33*a* by the outer peripheral surface of the hammer 34. As a result, the hammer 34 retracts (moves upward in FIG. 5).

Due to the retraction of the hammer 34, the sea water in the cylinder rear chamber 42 on a rear side of the hammer 34 passes through the drainage passage 38*a*, and is discharged toward the suction hole 38*t* from the discharge hole 38*g* through the check valve 37.

Figure 6:
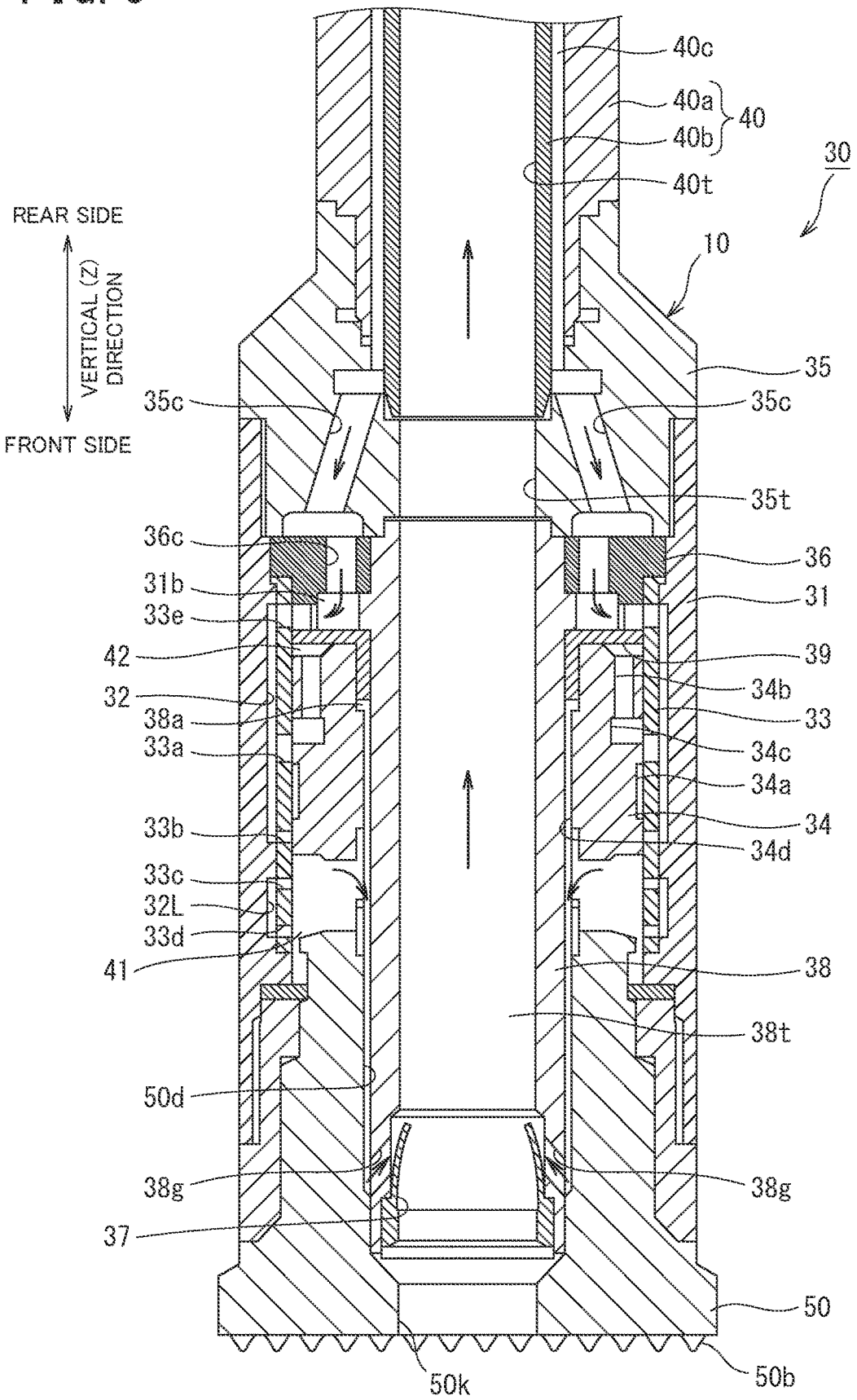
FIG. 6 is an illustrative diagram (a hammer retracted state) of the mining device main body of the seabed mineral mining device of FIG. 4, the diagram illustrating a longitudinal cross-section including an axis line.

Next, as illustrated in FIG. 6, when the hammer 34 reaches a retraction limit, the communication hole 33*b* formed in the cylinder liner 33 is disconnected by the outer peripheral surface of the hammer 34. On the other hand, the communication hole 33*a* communicates with the control groove 34*c* formed on the outer peripheral surface of the hammer 34. Thus, the high pressure water from the water passage hole 32 of the cylinder 31 flows into the cylinder rear chamber 42 on the rear side of the hammer 34.

Due to the inflow of the high pressure water into the cylinder rear chamber 42, the hammer 34 shifts from retraction to advancement, and strikes a rear end face of the bit 50 at a predetermined striking position. In the struck bit 50, chips 50*b* at a leading end thereof apply a striking force to a drilling surface to crush the seabed minerals.

The high pressure water continues to be supplied to the mining device 30 from the high pressure water supply pump, whereby the hammer 34 repeatedly strikes the read end face of the bit 50 by the above-described reciprocating movement. Then, in addition to the striking to the drilling surface at the bit 50, feed-driving of the mining device 30 is performed by the slide movement mechanism 47 provided on the guide shell 48, and also rotary drive of the mining device 30 is performed by a rotation mechanism of the housing unit 71.

Thus, the mining device 30 can continue mining of seabed minerals while forming the pit VH by drilling on the seabed ore deposit OD. Additionally, in the mining device 30, the mining device main body 10 of its own lies inside the pit VH, so that drilling can be continued, with an opening side of the pit VH closed. Accordingly, crushed powder of the seabed minerals are prevented or suppressed from being flown out into the sea. This prevents or suppresses sea water suspension (mining unit; mining step).

Then, according to the mining device 30, at the front end of the bit 50, the water suction hole 50*k* is open that communicates with the suction hole 38*t* of the sleeve 38. Since the suction hole 38*t* is open along the discharge hole 38*g* inclined toward the direction of the double pipe rod 40, flow velocity of the high pressure water passing through the suction hole 38*t* produces negative pressure in the water suction hole 50*k*. As a result, the seabed minerals crushed by drilling are suctioned through the water suction hole 50*k* of the bit 50, and the suctioned seabed minerals can be mixed with the sea water in the suction hole 38*t*.

Herein, in the case of drilling by striking force, the crushed seabed minerals produced by the drilling are extremely small in particulate diameter and uniform in particle size. Thus, according to the mining device 30, the crushed seabed minerals produced by drilling can be suctioned by action of the drainage flow and mixed with the sea water in the suction hole 38*t* of the mining device 30 to be able to form a slurry (slurry production unit; slurry production step).

Furthermore, according to the mining device 30, the suction hole 38*t* of the sleeve 38 is directly introduced to the suction pipe 5 through the suction hole 40*t* of the inner cylinder 40*b* of the double pipe rod 40, so that the mineral lifting unit 4 can suction the slurry of minerals mined by the mining device 30, together with the sea water, from the suction pipe 5. By doing this, it is possible to prevent or suppress the slurry of the seabed minerals from flying up and scattering in the sea water (collection unit; collection step).

Next, the mineral slurry suctioned into the suction pipe 5 is transferred to the sizer 27. The sizer 27 separates desired one or more minerals from undesired, unnecessary minerals by centrifugal force due to specific gravity difference between mineral particles. The minerals determined not to be necessary by sizing are guided to the place for returning and leaving those unnecessary on the seabed via the discharge pipe 7 connected to the sizer 27, as illustrated in FIG. 1.

On the other hand, among the separated minerals in the slurry, the one or more minerals having a desired specific gravity are sent to the mineral lifting pump 25, and lifted up to the reservoir 13 of the mining mother ship 1 via the mineral lifting pipe 6. In the mining mother ship 1, when storing in the reservoir 13, the one or more minerals in the slurry are separated from the sea water, as a result of which the seabed minerals are stored in the reservoir 13, and the separated sea water is discharged in the sea.

Figure 7A:
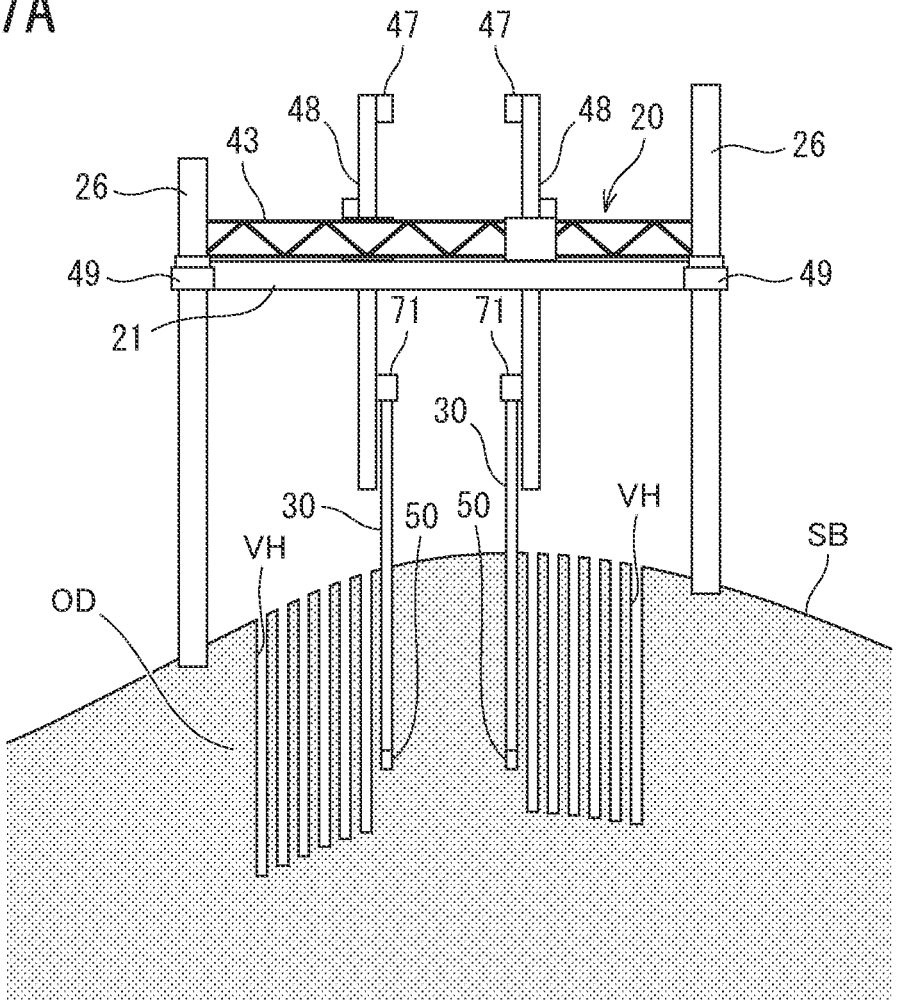
Figure 7B:
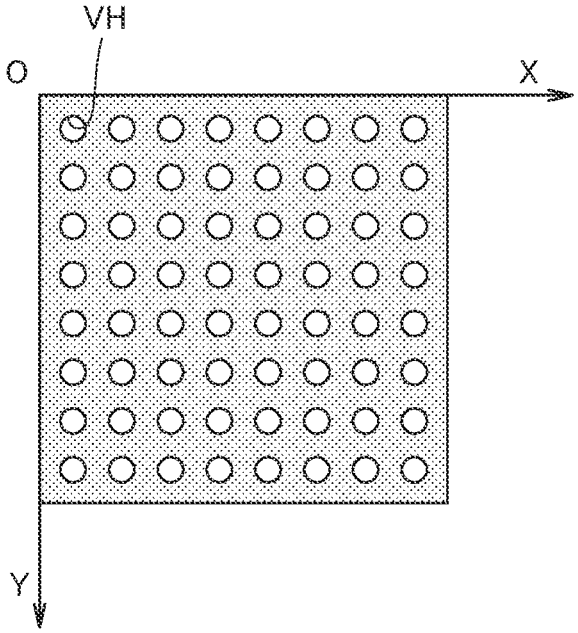

When mining is done to a maximum drilling depth of each mining device 30, each mining station 20 retracts the mining device 30, and then moves the mining device 30 in an X-Y plane to drill holes in order in such a manner as to scan the entire X-Y plane, as illustrated in FIG. 7B. The movement in the X-Y plane and the drilling after the movement may be automatically performed by computer (such as the above-mentioned management computer and the base control unit 45), as in the present embodiment, or may be performed through manual operation by an operator concurrently monitoring the state of each mining station 20 from the mining mother ship 1 on the sea level.

Particularly, according to the mining stations 20 each including the mining devices 30, the seabed mineral mining system, and the mineral lifting method using these pieces of equipment, each mining station 20 includes the plurality of support legs 26, each of which is individually relatively slidable in the Z direction via the jack mechanism 49, which is the vertical movement mechanism, so that each mining station 20 can correspond with the slopes and undulations of seabed ore deposits. In addition, when an operator performs manual operation while monitoring through a camera or the like, scattering of seabed minerals into sea water is prevented or suppressed, which is thus suitable to improve the efficiency of mining work.

Herein, while a plurality of mining stations 20 can be used to simultaneously mine a wide range, as in the above embodiment, various types of mining devices 30, from those for small diameter to those for large diameter, can also be used as the mining devices 30 equipped in each mining station 20.

Figure 8A:
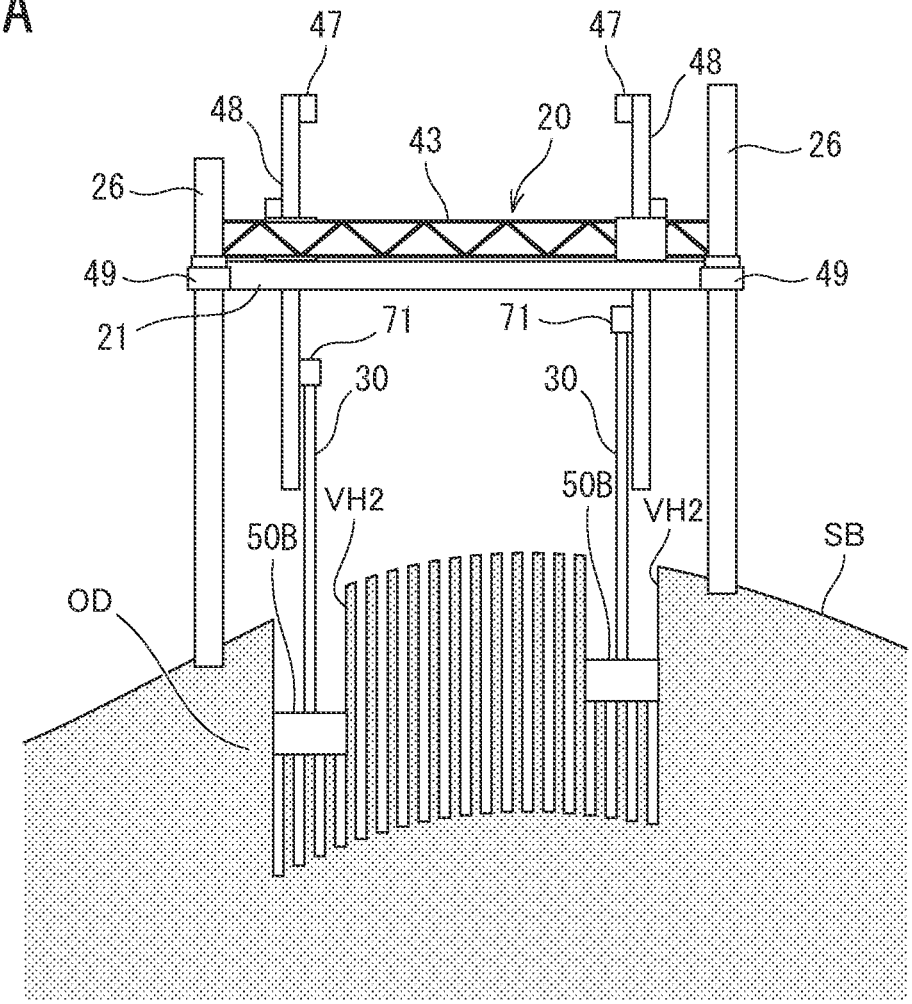
Figure 8B:
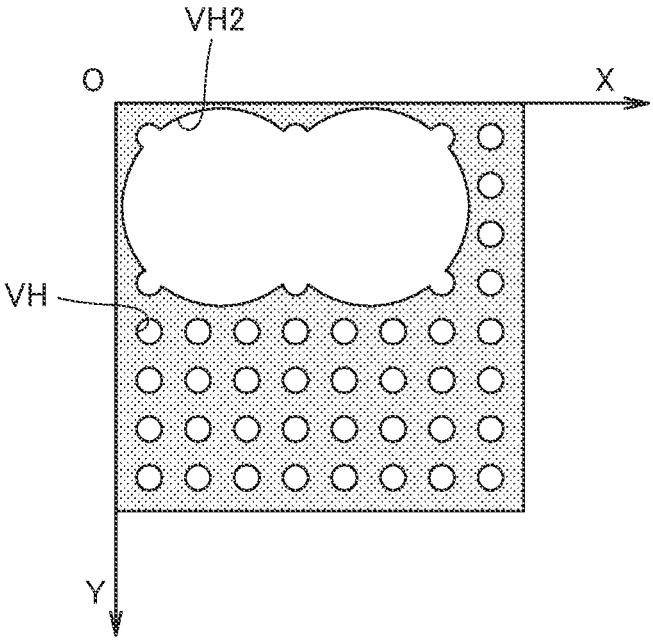

For example, as illustrated in FIG. 7A, after mining using the mining station 20 equipped with mining devices 30 for small diameter, the same region can be further mined using an other mining station 20 equipped with mining devices 30 for large diameter or using the same mining station 20 equipped with replaced mining devices 30 for large diameter, as illustrated in FIGS. 8A and 8B. Note that reference signs 50 and 50B in FIGS. 7A, 8A and 8B do not mean replacement by bits only but overall replacement by mining devices 30 corresponding to a small-diameter bit 50 or a large-diameter bit 50B.

Thus, according to the mining stations 20 each including the mining devices 30, the seabed mineral mining system, and the mineral lifting method using these pieces of equipment, it is possible to correspond with the slopes and undulations of seabed ore deposits, and furthermore, the slurry of seabed minerals is in the pits VH, which prevents or suppresses flying up and scattering of the seabed minerals in the sea water. Additionally, the mining system of the present embodiment directly introduces the slurry of seabed minerals mined by the mining devices 30 to the suction pipe 5 from insides of the pits VH, which thus can also prevent or suppress scattering in the sea water at the time of mineral lifting.

It should be noted that the present invention is not limited to the above embodiment, and it is obvious that various modifications can be made without departing from the spirit of the present invention.

For example, while the above embodiment has described the example of the mining mother ship 1 as the offshore mining base, the present invention is not limited thereto. The offshore mining base may be, for example, a platform erected on the sea, or the like, as long as it serves as an offshore mineral lifting base.

Additionally, for example, while the above embodiment has described the example where the mineral slurry is transported to the reservoir 13 provided in the mining mother ship 1, the present invention is not limited thereto. Minerals mined in the seabed and directly transported from the inside of the pit VH that is a bottomed hole may be lifted, stored, or sized in the vicinity of the mining mother ship 1 on the sea level or under the sea level (e.g. there is provided a reservoir near the ship bottom thereof).

In addition, for example, while the above embodiment has described the example where the pit VH is drilled as one example of a bottomed hole, the bottomed hole according to the present invention is not limited to a hole having a vertical axial line. In other words, in the present invention, it is sufficient that a bottomed hole can be formed by drilling, then seabed minerals can be formed into a slurry in the bottomed hole, and the slurry can be collected from the inside of the bottomed hole. Therefore, the bottomed hole according the present invention may be a lateral hole having a horizontal axis line or may be a hole having an oblique axis line.

In addition, the method and device for forming the pit VH are not limited to drilling with a striking mechanism, and may be drill boring with a rotation mechanism. However, to form mined minerals into a slurry and make particle diameters very small to uniformize particle sizes, drilling with a striking mechanism is preferable to drill boring.

Additionally, for example, while the above embodiment has described the example where the mineral lifting unit 4 includes the sizer 27, and the slurry of minerals are sized by the sizer 27 in the sea, the present invention is not limited thereto. With the mining device according to the present invention, mined minerals are in the form of slurry, whose particle diameter is extremely small, and whose particle size is uniform, so that the seabed minerals in the form of slurry may be lifted up without sizing.

Figure 9:
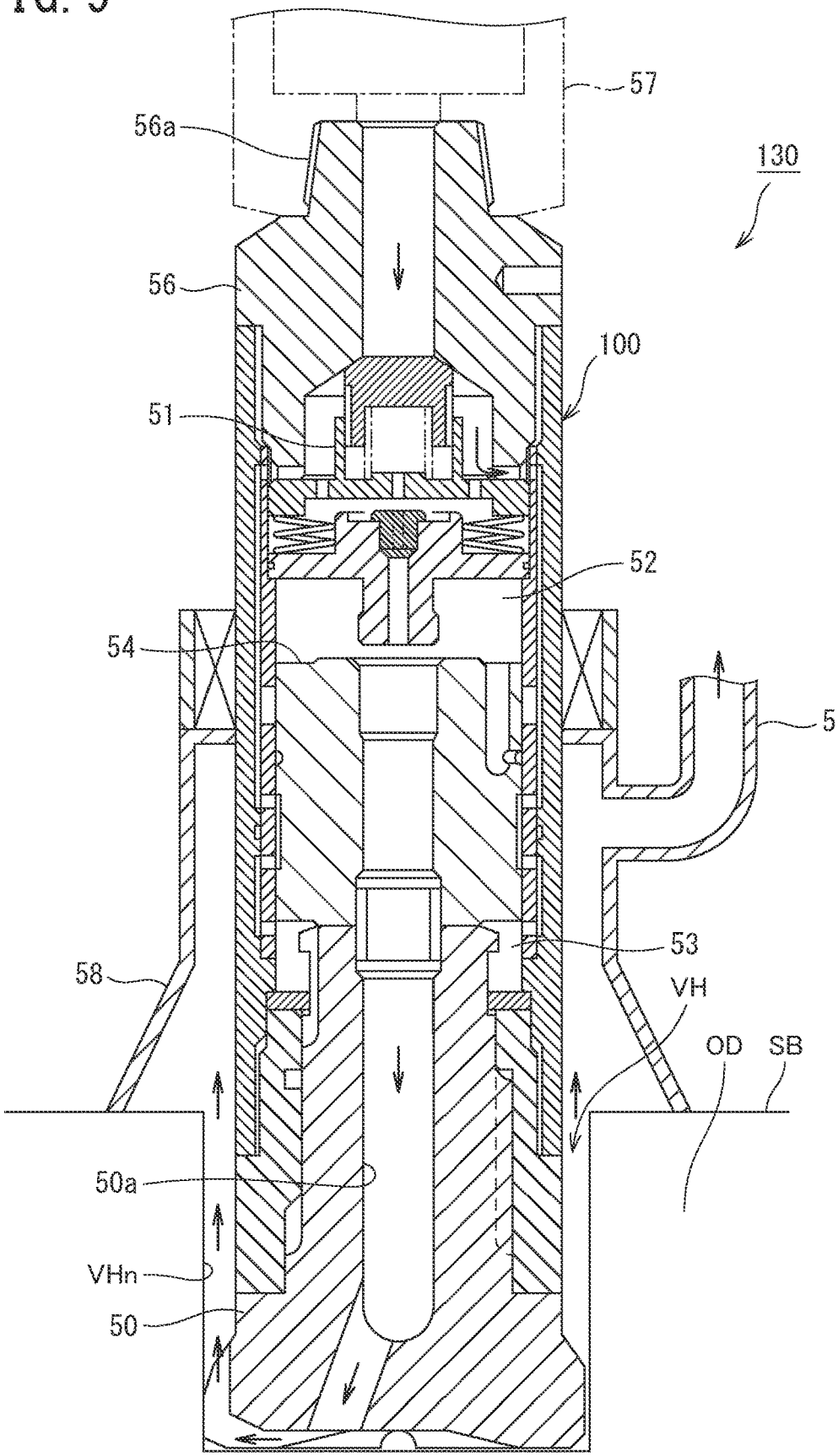
FIG. 9 is a longitudinal cross-sectional diagram of a modification of a seabed mineral mining device according to one aspect of the present invention.

Furthermore, for example, while the above embodiment has described the example where the mining device 30 includes the double pipe rod 40 including the outer cylinder 40*a* and the inner cylinder 40*b*, the present invention is not limited thereto. For example, as illustrated in FIG. 9, a mining device may be formed using a single pipe rod.

In other words, as illustrated in the drawing, a mining device 130 includes a single pipe rod 57, and a mining device main body 100 is installed ahead of the rod 57. The mining device main body 100 includes a cylinder 56 connected to a leading end of the rod 57 by a tapered screw portion 56*a*. In the cylinder 56, a check valve 51, a hammer 54, and a bit 50 are provided in order from the top, and a cylinder front chamber 52 and a cylinder rear chamber 53 are defined in front of and behind the hammer 54.

High pressure water for driving the mining device 130 is supplied to the housing unit 71 at an upper end of the rod 57 via the high pressure water supply pipe 9 from the high pressure water supply pump, as in the above embodiment. The supplied high pressure water is supplied to and discharged from the cylinder front chamber 52 or the cylinder rear chamber 53 so as to move the hammer 54 forward and backward in the cylinder 56 by the hammer reciprocation switch mechanism formed on inner and outer peripheral surfaces of the cylinder 56 and the hammer 54, as in the above embodiment. In addition, the rod 57 is rotated and fed by the slide movement mechanism 47 provided on the guide shell 48 and the rotation mechanism of the housing unit 71.

Herein, in the mining device 130, the cylinder 56 is provided with a foot pad 58 capable of being pressed toward a drilled hole opening side and being slidable along the axial direction so as to surround a periphery of the drilled hole. To an upper side face of the foot pad 58 is connected to the suction pipe 5 to mine the slurry as a seabed mineral resource.

In the mining device 130 thus formed, the high pressure water passes through the check valve 51 at an upper part, and is supplied to or discharged from the cylinder front chamber 52 and the cylinder rear chamber 53 by the hammer reciprocation switch mechanism to drive the hammer 54 forward and backward, whereby an impact due to striking of the hammer 54 against the bit 50 drills the pit VH that is a bottomed hole in the seabed ore deposit OD (mining unit; mining step).

While the high pressure water after the striking flows out to a leading end of the bit through the suction hole 50*a* provided at an axial center of the bit 50, seabed minerals mined by the drilling is mixed with sea water in the pit VH to be formed into a slurry (slurry production unit; slurry production step).

Then, the slurry produced in the pit VH passes through a gap between an outside of the cylinder 56 and a drilled hole inner wall VHn or a gap between an outside of the rod 57 contacted with the drilled hole inner wall VHn and extending into the sea water and the drilled hole inner wall VHn, and is directly collected from the inside of the pit VH via the suction pipe 5 from an inside of the foot pad 58 (collection unit; collection step). Thus, even with the structure as in the mining device 130, scattering of the mined minerals in the sea can be prevented or suppressed.

Figure 10A:
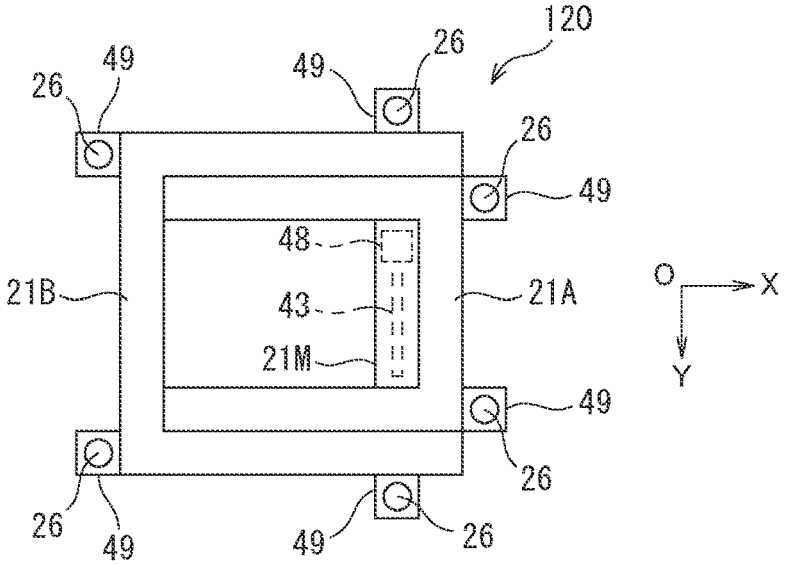
FIGS. 10A to 10C are schematic plan views of a second embodiment of an undersea mining base according to one aspect of the present invention.
Figure 10B:
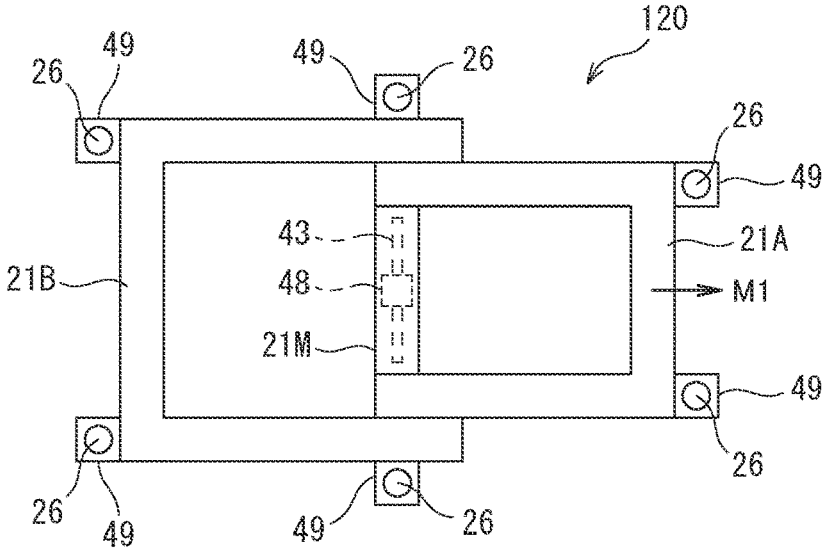
Figure 10C:
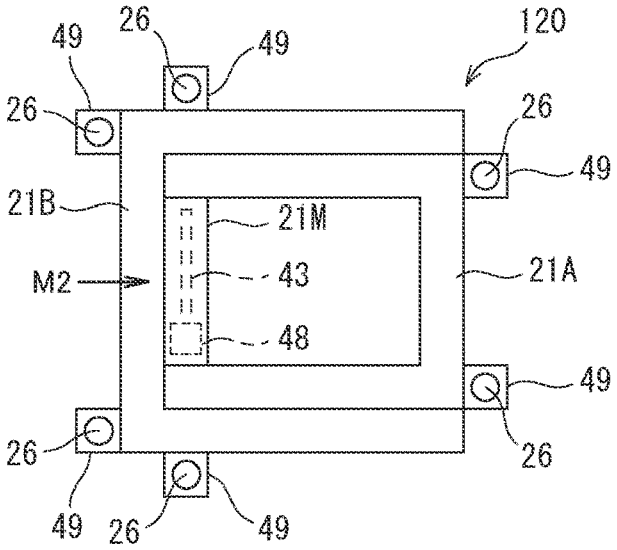

Additionally, for example, while the above embodiment has described the example whereas the undersea mining base, each mining station 20 itself does not move horizontally, the present invention is not limited thereto. For example, as illustrated in FIGS. 10A to 10C, each mining station can be configured to include a mechanism allowing itself to move horizontally.

Herein, regarding an excavator for mining mineral resources in seabed ore deposits, a main concept that has been proposed so far is a method in which, using a crawler-type remote controlled excavator, a seabed ore deposit is mined horizontally by a drum cutter mounted in the excavator while travelling by crawler. This will be hereinafter referred to as horizontal mining system (HMS). The HMS is excellent in mobility and portability, and can mine while traveling freely on a seabed. On the other hand, the HMS has problems to be solved in terms of the following points (Problem 1) to (Problem 5):

(Problem 1): Large friction force is required to ensure mining reaction force of the drum cutter within a mining plane. Due to that, it is necessary to increase the weight of an excavator main body.

(Problem 2): Minerals crushed at drilling fly up in the water, and lower visibility. In operation of the HMS, an operator on the sea needs to visually operate through a camera, which thus may affect operation rate. Additionally, load on environment may also be significant.

(Problem 3): Operation corresponding with the undulations of the seabed is necessary, and excavation is performed while visually observing through a camera, thus making full automation difficult.

(Problem 4): Climbing ability corresponding with the inclined angle of a mine is necessary. In addition, even if not on an inclined land, when the ground of the seabed is soft, it may be difficult to travel by crawler.

(Problem 5): Depending on a contrivance of the shape of the drum cutter, a subsea crushing unit (SCU) is said to be necessary due to non-uniform sizes of mined ores.

Thus, in the HMS, which is a crawler-type excavator, operation corresponding with the undulations of the seabed is complicated, and automation is difficult. Additionally, seabed ore deposits have large inclined angles, thus making it difficult to travel by crawler on soft ground accumulated on the surface thereof. Particularly, on seabed hydrothermal deposits, there are many chimneys spouting hot water (chimney-like hot water spouting protrusions) on seamounts, and it is difficult to avoid such chimneys. Thus, to solve such problems of the HMS, the present inventors have invented the above first embodiment, which is a vertical mining system (VMS), as a method different from the HMS.

Merits of the VMS are summarized at least as in the following (Effect 1) to (Effect 4):

(Effect 1): Ores are crushed into an extremely fine powder, so that the subsea crushing unit (SCU) can be omitted.

(Effect 2): Since a seabed ore deposit is longitudinally mined, ores crushed by mining are sucked out using a flow line, similarly to riser excavation, so that scattering to environment is small. Thus, the load on the environment is also small, and low visibility can be prevented when an operator monitors through a camera from above the sea.

(Effect 3): It is possible to mine a section at a bottom-landing position (a predetermined range), so that according to a predetermined program, mining can be automatically performed without any problem of visibility.

(Effect 4): Each mining station is erected on the seabed, and each support leg thereof is individually relatively slidable in the Z direction via the vertically movement mechanism. Thus, the system is applicable to complicated seabed shapes and soft ground to which it will be difficult to apply the HMS.

However, as for the mining station 20 of the first embodiment, after completing the mining of a first section, it is necessary to install the mining station 20 again in a next adjacent section. In other words, the mining station 20 of the first embodiment requires an installation and relocation vessel (IRV) every time a jack-up type platform is installed and relocated.

Due to that, much time and cost are needed for work for lifting, relocation, and bottom landing of the VMS by the IRV. In addition, since the IRV is always used during the mining period, cost for use is large. By contrast, second and third embodiments, which will be described below, solve the problems, and are each a VMS movable by itself in at least one direction of the X and Y directions, e.g., a self-traveling vertical mining system for developing seabed mineral resources.

Specifically, a mining station 120 of the second embodiment is formed using three base frames including a first base frame 21A, a second base frame 21B, and a third base frame 21M, as illustrated in FIG. 10A.

The first base frame 21A and the second base frame 21B are each formed of a U-shaped frame body. The first and second frames 21A and 21B are each provided with the support legs 26 each provided at two corner portions forming a U-shape via the jack mechanism 49, as in the above embodiment. The U-shape of the first base frame 21A has a width narrower than the width of the U-shape of the second base frame 21B.

The first base frame 21A and the second base frame 21B are arranged to face each other such that opening portions of the U-shapes of the mutual frames 21A and 21B can be combined together. Horizontal frames of the mutual frames 21A and 21B are engaged with each other on facing surfaces thereof via an unillustrated first rack and pinion mechanism and a first sliding guide device such as a linear guide, and are relatively slidable in the X direction by driving the first rack and pinion mechanism by an unillustrated first motor.

The third base frame 21M is formed into an I-shape from a vertical frame extending in the Y direction. In the third base frame 21M, the support legs 26 are each provided at both ends of the I-shape via the jack mechanism 49, as in the above embodiment. Additionally, the third base frame 21M includes a Y-direction movement mechanism and the guide shell 48, and can slide the guide shell 48 in the Y direction along the movement frame 43. Note that the guide shell 48 is equipped with a mining device similar to that of the above embodiment.

The third base frame 21M is arranged in a direction orthogonal to the horizontal frames with respect to the first base frame 21A and the second base frame 21B. The third base frame 21M is engaged with respect to the horizontal frames of the first and second frames 21A and 21B on facing surfaces thereof via an unillustrated second rack and pinion mechanism and a second sliding guide device such as a linear guide, and is relatively slidable in the X direction by driving the second rack and pinion mechanism by an unillustrated second motor.

When the mining station 120 moves, as illustrated in FIG. 10B, first, the jack mechanism 49 of the first base frame 21A is driven to move the two support legs 26 of the first base frame 21A upward so as to be in a non-supporting state. Next, the first rack and pinion mechanism is driven by the first motor to relatively slide the first base frame 21A in a positive direction of the X direction with respect to the second base frame 21B. After the sliding, the first motor is stopped, and the jack mechanism 49 is driven to move the two support legs 26 of the first base frame 21A downward so as to be in a supporting state.

Next, as illustrated in FIG. 10C, first, the jack mechanism 49 of the second base frame 21B is driven to move the two support legs 26 of the second base frame 21B upward so as to be in the non-supporting state. Then, the first rack and pinion mechanism is driven by the first motor to relatively slide the second base frame 21B in the positive direction of the X direction with respect to the first base frame 21A. After the sliding, the first motor is stopped, and the jack mechanism 49 is driven to move the two support legs 26 of the second base frame 21B downward so as to be in the supporting state.

Next, the jack mechanism 49 of the third base frame 21M is driven to move the two support legs 26 of the third base frame 21M upward so as to be in the non-supporting state. Then, the second rack and pinion mechanism is driven by the second motor to relatively slide the third base frame 21M in the positive direction of the X direction with respect to the first and second base frames 21A and 21B. After the sliding, the second motor is stopped, and the jack mechanism 49 is driven to move the two support legs 26 of the third base frame 21M downward so as to be in the supporting state. As a result, the entire three base frames 21A, 21B, and 21M are brought into a state illustrated in FIG. 10A while moving in the positive direction of the X direction by an amount corresponding to an amount of the sliding.

Thus, according to the mining station 120, sequentially moving the three base frames 21A, 21B, and 21M in the manner described above allows the entire mining station 120 to move by itself in the X direction. Note that when sliding, the base frames 21A and 21B overhang in a cantilevered state, but are mutually engaged on the facing surfaces via the sliding guide device, so that horizontal posture is maintained.

In addition, the third base frame 21M includes the Y-direction movement mechanism, as in the above first embodiment, whereby the guide shell 48 can be slid in the Y direction along the movement frame 43. The guide shell 48 is equipped with the mining device 30 similar to the above embodiment. Thus, the mining device 30 can be driven while moving the guide shell 48 in the Y direction, as appropriate, at a time when the third base frame 21M is not moved.

Accordingly, even with such a structure, each mining device 30 is movable in the X direction and the Y direction, whereby seabed minerals can be mined while forming a pit that is a bottomed hole by drilling while corresponding with the slopes and undulations of a seabed ore deposit, and formed into a slurry in the pits, and then the slurry can be directly collected from the insides of the pits.

Next, the third embodiment of the present invention will be described with reference to FIGS. 11 to 30, as appropriate. The third embodiment is a self-traveling vertical mining system for developing seabed mineral resources, capable of moving a mining station in the X direction and the Y direction, and, particularly, is an example of an undersea mining base that is a self-traveling seabed excavation machine including a vertical hole excavation drill.

Figure 11:
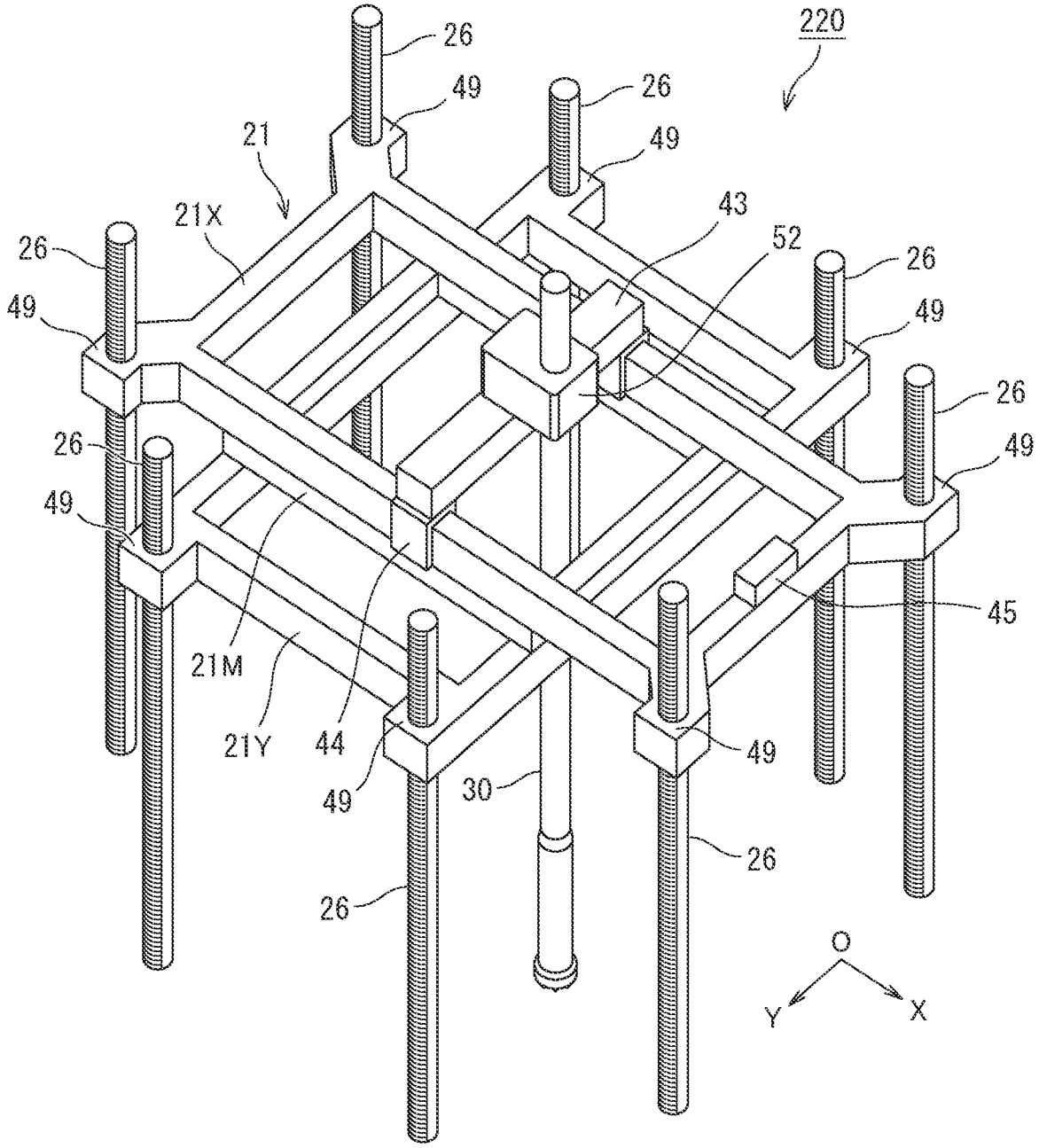
FIG. 11 is a schematic perspective diagram illustrating a third embodiment of the undersea mining base according to the one aspect of the present invention.

FIG. 11 illustrates a schematic perspective diagram of an entire mining station of the third embodiment. As illustrated in the drawing, a mining station 220 includes the mining device 30 and a platform 21 capable of self-traveling in the X direction and the Y direction. The platform 21 includes an upper platform 21X having a rectangular frame shape in a plan view, a lower platform 21Y having a rectangular frame shape in a plan view, and a middle frame 21M provided between both platforms 21X and 21Y and having a rectangular frame shape in a plan view.

Note that the mining station 220 of the third embodiment has the same structure as that of the above first embodiment, except for the platform 21 and a movement mechanism for moving in the X direction and the Y direction included in the platform 21. Thus, the third embodiment will describe the platform 21 and the movement mechanism for moving in the X direction and the Y direction, and descriptions of other mechanisms will be omitted as appropriate.

Figure 12:
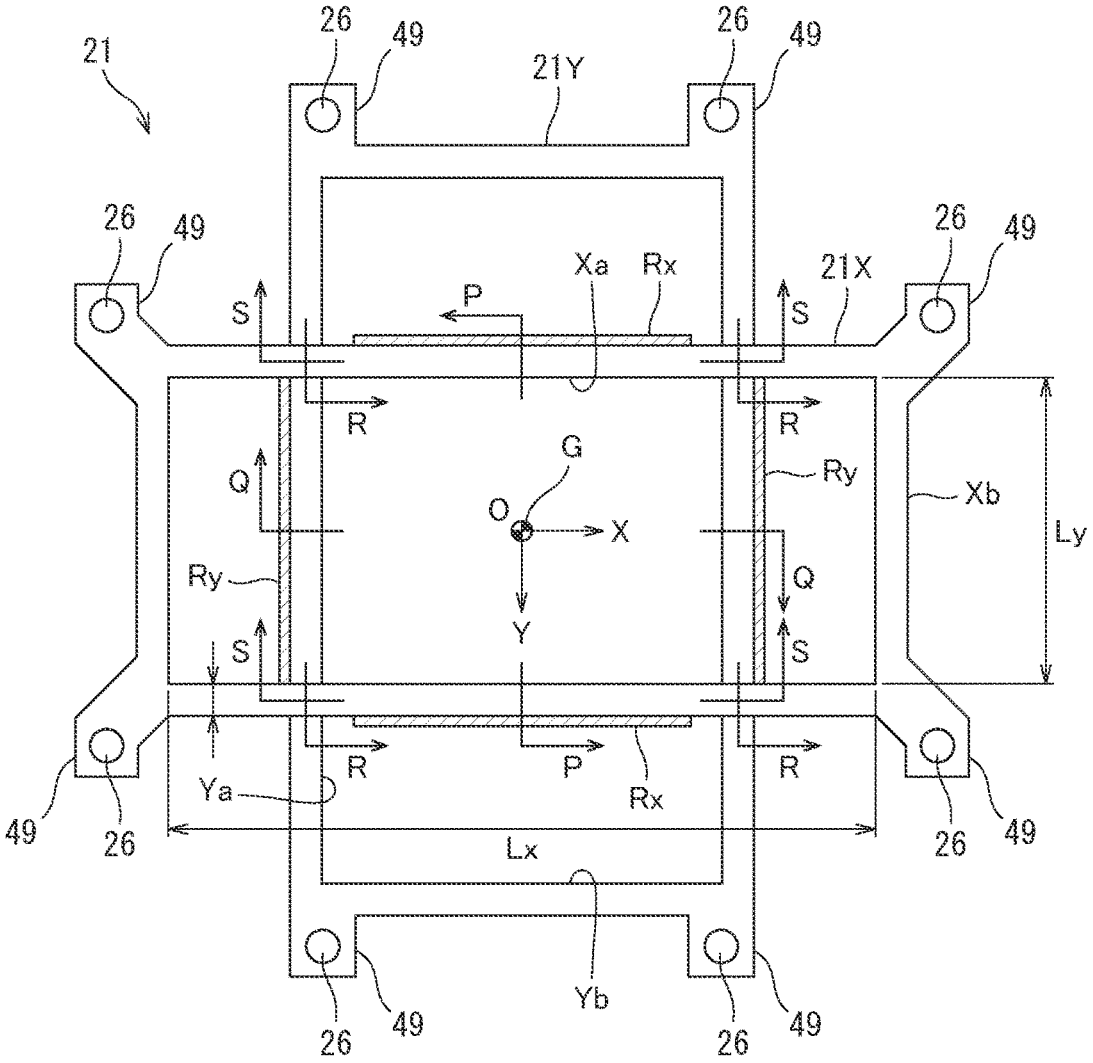
FIG. 12 is a schematic plan view of a platform of the undersea mining base of the third embodiment.
Figure 13:
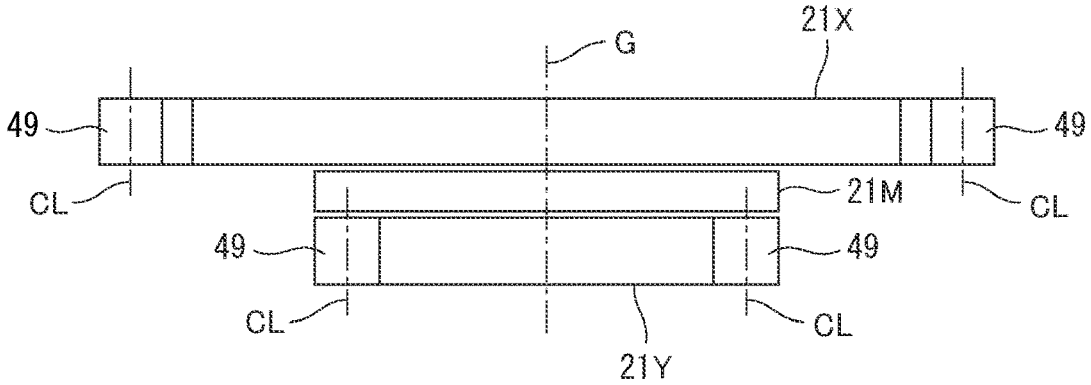
FIG. 13 is a schematic front view of the platform of the undersea mining base of the third embodiment.

Hereinafter, a detailed description of the movement mechanism of the mining station 220 of the third embodiment will be given with reference to FIGS. 12 to 19. Note that FIGS. 12 and 13 illustrate a bottom-landing posture of the platform 21 when the mining station 220 is landed on the seabed ore deposit OD from the erection and installation mother ship 2. When the platform 21 is in the bottom-landing posture, centers (the centers of gravity) G in a horizontal plane of the upper platform 21X, the middle frame 21M, and the lower platform 21Y are coincident. Note that, in FIG. 13, reference sign CL denotes a center axis line of each support leg 26.

As illustrated in FIG. 12, the upper platform 21X has a rectangular frame shape in a plan view, and includes a pair of rectangular cylindrical longitudinal girders Xb spaced apart from each other in the X direction and arranged parallel to each other and a pair of rectangular cylindrical lateral girders Xa spaced apart from each other in the Y direction and arranged parallel to each other. On each outer side face of the two lateral girders Xa, an X moving rack Rx is each attached symmetrically from a center in an extending direction of each lateral girder Xa.

Additionally, as illustrated in the drawing, the lower platform 21Y has a rectangular frame shape in a plan view, and includes a pair of rectangular cylindrical lateral girders Yb spaced apart from each other in the X direction and arranged parallel to each other and a pair of rectangular cylindrical longitudinal girders Ya spaced apart from each other in the Y direction and arranged parallel to each other. On each outer side face of the two longitudinal girders Ya, a Y moving rack Ry is each attached symmetrically from a center in an extending direction of each longitudinal girder Ya.

Figure 14:
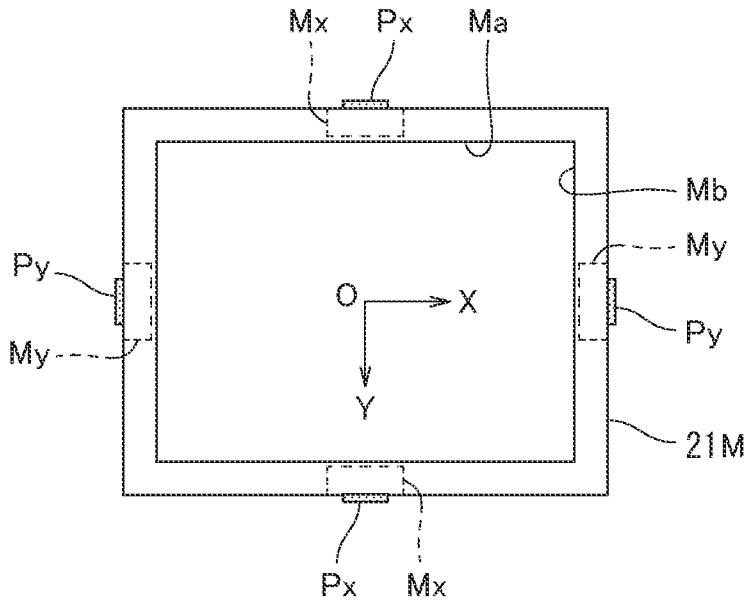
FIG. 14 is a schematic plan view of a middle frame of the undersea mining base of the third embodiment.

As illustrated in FIG. 14, the middle frame 21M has a rectangular shape in a plan view, and includes a pair of rectangular cylindrical longitudinal girders Mb spaced apart from each other in the X direction and arranged parallel to each other and a pair of rectangular cylindrical lateral girders Ma spaced apart from each other in the Y direction and arranged parallel to each other. At a center position in an extending direction of each lateral girder Ma of the middle frame 21M, an X drive motor Mx is each arranged in the rectangular cylinder of the lateral girder Ma. Additionally, at a center position in an extending direction of each longitudinal girder Mb of the middle frame 21M, a Y drive motor My is each arranged in the rectangular cylinder of the longitudinal girder Mb.

As illustrated in FIGS. 11 and 12, the respective upper and lower platforms 21X and 21Y are jack-up platforms each including the four support legs 26 and the jack mechanisms 49 capable of ascending and descending each support leg 26, similarly to the platform of the above first embodiment. Then, the middle frame 21M and the upper and lower platforms 21X and 21Y are supported so as to be slidable via a linear motion guide mechanism illustrated in FIGS. 16 and 17, and also are engaged via a rack and pinion mechanism illustrated in FIGS. 17 and 18, thereby being configured so as to be relatively slidable in the X direction and the Y direction orthogonal to each other on the horizontal plane.

Specifically, as illustrated in FIG. 12, the platform 21 of the third embodiment includes the support leg 26 at each of four corners of a rectangular frame body of the upper platform 21X and at each of four corners of a rectangular frame body of the lower platform 21Y. Each support leg 26 includes the jack mechanism 49 that is a slide movement mechanism in the Z direction, as a jacking unit for ascending and descending.

Figure 15:
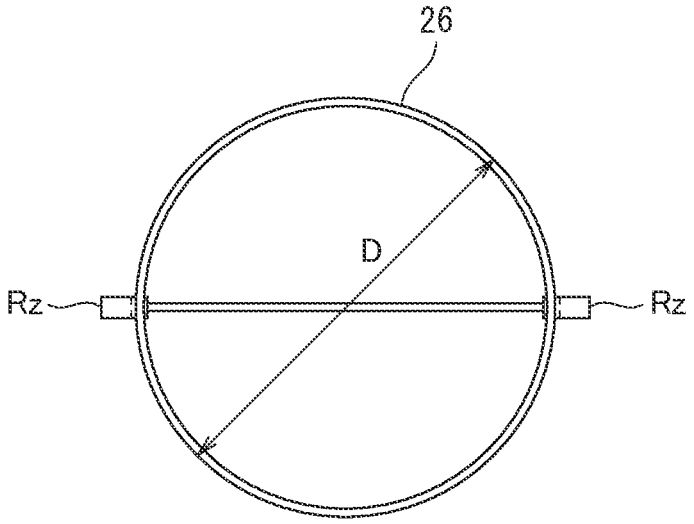
FIG. 15 is a transverse cross-sectional diagram of a support leg of the undersea mining base of the third embodiment.

Each support leg 26 is equipped with a total of two jack mechanisms 49 of the third embodiment, each one at both sides thereof. In each support leg 26, two Z movement racks Rz are arranged at positions facing each other in a circumferential direction along the axial direction of each support leg 26, as illustrated in FIG. 15.

The jack mechanism 49 corresponding to each Z movement rack Rz includes an unillustrated Z drive motor, a pinion attached to an output shaft of the Z drive motor, and the above Z movement rack Rz meshed with the pinion to form the rack and pinion mechanism. As a result, each support leg 26 can relatively slide in the Z direction with respect to the respective platforms 21X and 21Y equipped with itself, thereby enabling ascending and descending of the upper and lower platforms 21X and 21Y by cooperation of the plurality of support legs 26.

Figure 16:
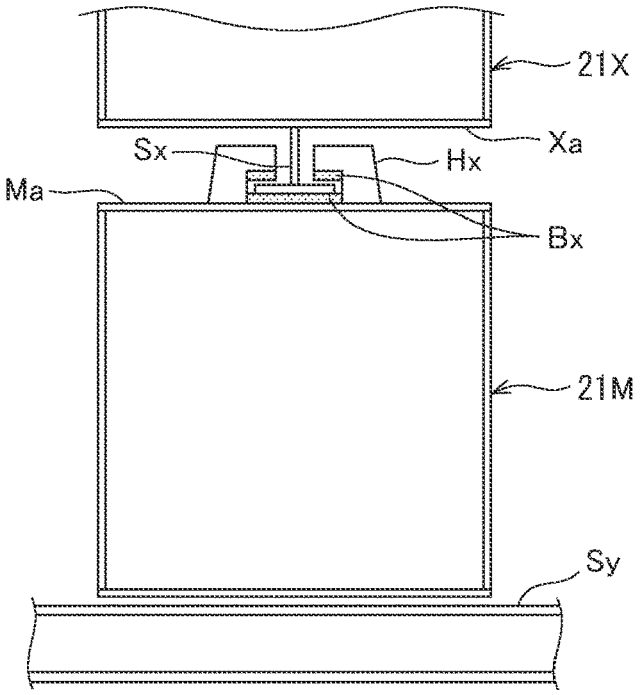
FIG. 16 is a cross-sectional diagram taken along line R-R of FIG. 12.

The linear motion guide mechanism of the upper platform 21X includes a skidding rail Sx attached onto lower surfaces of the lateral girders Xa of the upper platform 21X along the extending directions of the lateral girders Xa, as illustrated in FIG. 16. The skidding rail Sx is attached from one end to the other end of the lateral girder Xa of the upper platform 21X along the lateral girder Xa of the upper platform 21X.

Upper and lower portions of the skidding rail Sx are guided by a bearing plate Bx measuring, for example, about 200 mm×200 mm. The bearing plate Bx is attached onto a corner upper surface of the lateral girder Ma of the middle frame 21M. Additionally, a holding claw Hx is attached at the same position as the arrangement position of the bearing plate Bx in such a manner as to cover the skidding rail Sx from right and left sides thereof. The holding claw Hx supports the skidding rail Sx from both sides thereof so as to prevent the upper platform 21X from falling when moving in the X direction.

Figure 18:
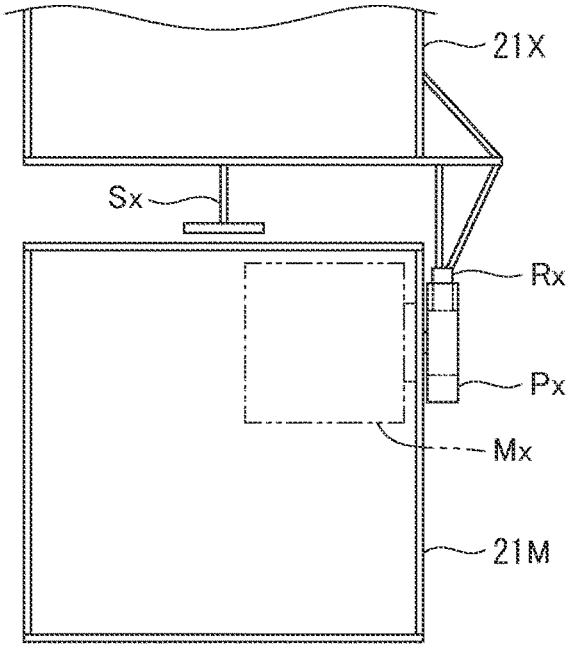
FIG. 18 is a cross-sectional diagram taken along line P-P of FIG. 12.

As illustrated in FIG. 18, each X movement pinion Px is attached to a drive shaft of each X drive motor Mx, and protrudes at a position facing a rack surface of each X movement rack Rx. The two X movement pinions Px are configured to be respectively meshed with the X movement racks Rx and synchronously driven by the X drive motors Mx so that the upper platform 21X are slidable in the X direction.

Figure 17:
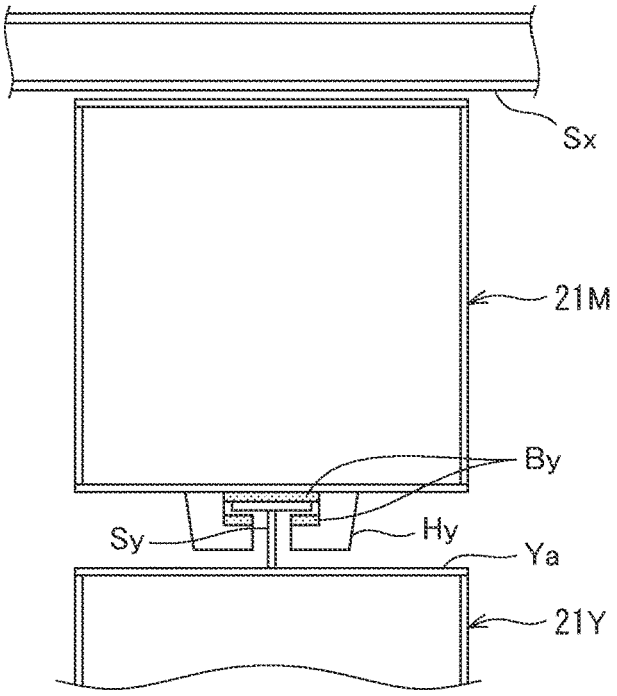
FIG. 17 is a cross-sectional diagram taken along line S-S of FIG. 12.

On the other hand, the linear motion guide mechanism of the lower platform 21Y includes a skidding rail Sy attached onto upper surfaces of the longitudinal girders Ya of the lower platform 21Y along the extending directions of the longitudinal girders Ya, as illustrated in FIG. 17. The skidding rail Sy is attached from one end to the other end of the longitudinal girders Ya of the lower platform 21Y.

Similarly to the upper platform 21X, in the lower platform 21Y a bearing plate By is attached onto a corner lower surface of the longitudinal girder Mb of the middle frame 21M, and the bearing plate By guides upper and lower portions of the skidding rail Sy. Additionally, a holding claw Hy is attached at the same position as the arrangement position of the bearing plate By in such a manner as to cover the skidding rail Sy from right and left sides thereof, and supports the skidding rail Sy from both sides thereof so as to prevent the lower platform 21Y from falling when moving in the Y direction.

Figure 19:
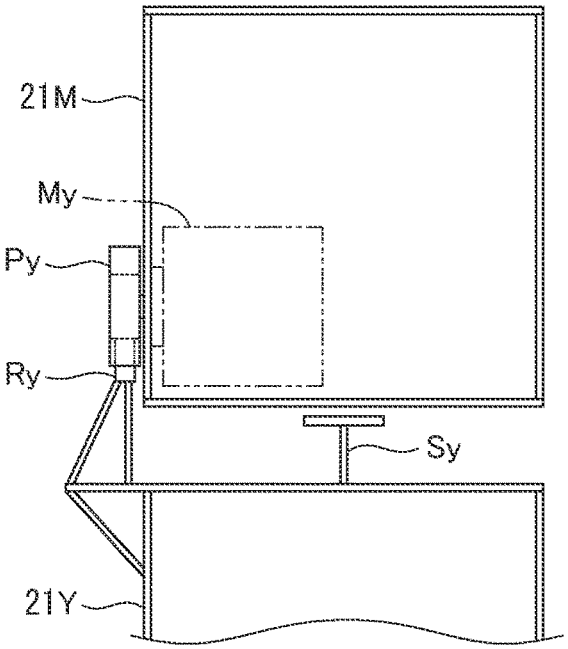
FIG. 19 is a cross-sectional diagram taken along line Q-Q of FIG. 12.

As illustrated in FIG. 19, Y movement pinions Py are attached to a drive shaft of the Y drive motor My, and protrude at a position facing a rack surface of each Y movement rack Ry. The two Y movement pinions Py are configured to be respectively meshed with the Y movement racks Ry, and synchronously driven by the Y drive motors My so that the lower platform 21Y are slidable in the Y direction.

Thus, the mining station 220 of the third embodiment is configured to be capable of walking in each of the X direction and the Y direction in a predetermined mining region, and moving the mining devices 30 in the X direction and the Y direction to sequentially drill predetermined sections according to steps for walking control processing, which will be described later, by the slide movement mechanism configured to slide the upper and lower platforms 21X and 21Y in the X direction and the Y direction and the slide movement mechanism configured to slide each support leg 26 in the Z direction.

Note that, in the third embodiment, the middle frame 21M and the upper and lower platforms 21X and 21Y represent examples in which horizontal movement can be performed via the rack and pinion mechanism, but the movement mechanism is not limited thereto. Any of various movement mechanisms can be employed as long as it is a movement mechanism enabling horizontal movement.

For example, a movement mechanism configured to slide by a hydraulic cylinder method can be used. Similarly, each support leg 26 represents an example in which relative sliding in the Z direction can be performed via the rack and pinion mechanism, but a movement mechanism is not limited thereto. For example, it is possible to use a movement mechanism configured to slide by a hydraulic cylinder method. Additionally, the movement mechanism is not limited to a hydraulically driven type, and may be an electrically driven type.

Herein, the third embodiment assumed, as the specifications of the mining station 220, a total production capacity (Dry SMS) of 2,000,000 t/year (6,600 t/day), a density of from 3 to 5 (t/$m^3$), and a volume of 6600/5 to 6600/3=1320 to 2200 $m^3$, and determined the size of a predetermined region (section) to be drilled by one mining station 220 to be about 10 m×10 m. Additionally, the mining device 30 is assumed to have a structure capable of drilling to a depth of about 20 m.

Then, given the above production capacity, the third embodiment assumes that one mining station 220 drills one section, which is a predetermined region having a depth of 20 m, per day. Additionally, in the third embodiment, when the mining station 220 is a self-traveling type, the platform 21 can move to an adjacent section in a short time. Thus, it is also considered to drill two sections, which are two predetermined regions each 10 m in depth, per day.

Specifically, when the width occupied by the movement mechanism 52 and the mining device 30 illustrated in the above first embodiment is assumed to be 3 m, setting the size of a drilling section as a predetermined region to 10 m×10 m requires setting the size of an inner drilling region in the platform 21 to 13 m×10 m. Furthermore, dimensions of the shapes of the upper platform 21X, the lower platform 21Y, and the middle frame 21M were set in consideration of loading conditions in towing, hanging, and working.

As for the shape and dimensions of each support leg 26 described above, when a total axial length of the support leg 26 was 30 m, an outer diameter D thereof was set to 1000 mm from loading conditions in rolling, mainly in consideration of towing conditions, as illustrated in the cross-section of the support leg 26 of FIG. 15.

In addition, in FIG. 12, from the loading conditions in towing, hanging, and working, a length Lx in the X direction and a width Ly in the Y direction inside the girders of the upper platform 21X were set to 23 m and 10 m, respectively. Additionally, a width Wg and a thickness Dg of the girders themselves of the upper platform 21X were set to 1 m and 2 m, respectively.

In addition, in the drawing, the length Lx in the X direction and the width Ly in the Y direction inside the girders of the lower platform 21Y were set to 13 m and 20 m, respectively. Additionally, the width Wg and the thickness Dg of the girders themselves of the lower platform 21Y were set to 1 m and 2 m, respectively. Furthermore, as for the middle frame 21M, the length Lx in the X direction and the width Ly in the Y direction inside the girders of the middle frame 21M were set to 13 m and 10 m, respectively, as illustrated in FIG. 14.

In addition, the width Wg and the thickness Dg of the girders themselves of the middle frame 21M were both set to 1 m. Additionally, in the rack and pinion mechanism portion illustrated in FIG. 16, the rack had a length of about 10 m. Furthermore, in the rack and pinion mechanism portion illustrated in FIG. 17, the rack had a length of about 10 m.

Figure 20:
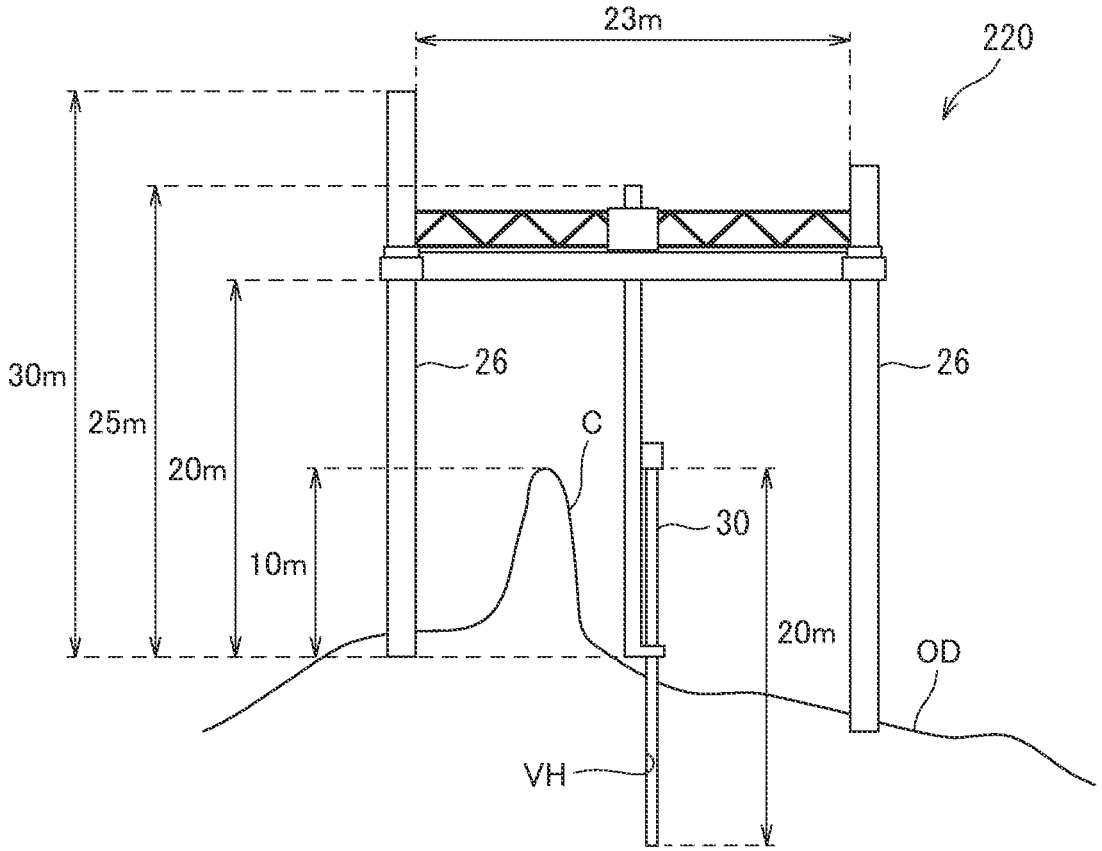
FIG. 20 is a diagram illustrating an image of one example of relative dimensions of the undersea mining base of the third embodiment and a seabed ore deposit (including a chimney).

In the plan view illustrated in FIG. 12, a rectangular portion inside the frame body at a center in a state where the upper platform 21X, the lower platform 21Y, and the middle frame 21M overlap has dimensions of 13 m×10 m. Since the width of the movement mechanism 52 and the mining device 30 is 3 m, the size of a predetermined section that can be excavated is 10 m×10 m. FIG. 20 illustrates an image of a relative size of the mining station 220 on the seabed ore deposit OD in the case of the dimensions set as above, in which the mining station 220 arranged undersea and erected on a seabed is forming the pit VH. Note that reference sign C in the drawing denotes an image of a chimney present on the seabed ore deposit OD.

Furthermore, as illustrated in FIG. 11, the mining station 220 of the third embodiment includes a base control unit 45 for controlling the mining station 220 itself on the upper platform 21X. The base control unit 45 of the third embodiment includes a tilt sensor configured to detect posture of the platform 21.

Still furthermore, in the third embodiment, each jack mechanism 49 driving each support leg 26 is equipped with an unillustrated torque detector. Each torque detector is a torque meter capable of detecting torque of each drive motor configured to drive the pinion of the rack and pinion mechanism of each corresponding jack mechanism 49. Each torque detector can detect motor torque of each drive motor as needed, and can output detected torque information to the base control unit 45.

The base control unit 45 is a controller (a control unit) of the mining station itself including a computer and a program for executing posture stabilization control processing. The base control unit 45 executes walking control processing for the mining station 220, mining control processing for the mining station 220, posture control for the mining station 220, and other necessary processing.

When the posture control processing for the mining station 220 is executed, the base control unit 45 determines the degree of imbalance in the posture of the mining station 220 itself on the basis of output of the tilt sensor, and performs posture stabilization control for maintaining posture stability by adjustment of each drive motor configured to drive the pinion of the rack and pinion mechanism.

Additionally, the base control unit 45 outputs inclination information detected by the tilt sensor and motor torque information regarding detected motor torques of the plurality of support legs 26 to the management computer equipped in the erection and installation mother ship 2, which is a towing vessel on the sea. The management computer is configured to be capable of displaying the inclination information and the motor torque information on a display, for the operator, as needed.

Next, a description will be given of a stabilized sitting method for the mining station 220 of the third embodiment, with reference to FIGS. 21A, 21B and 22A to 22D as appropriate.

Figure 21A:
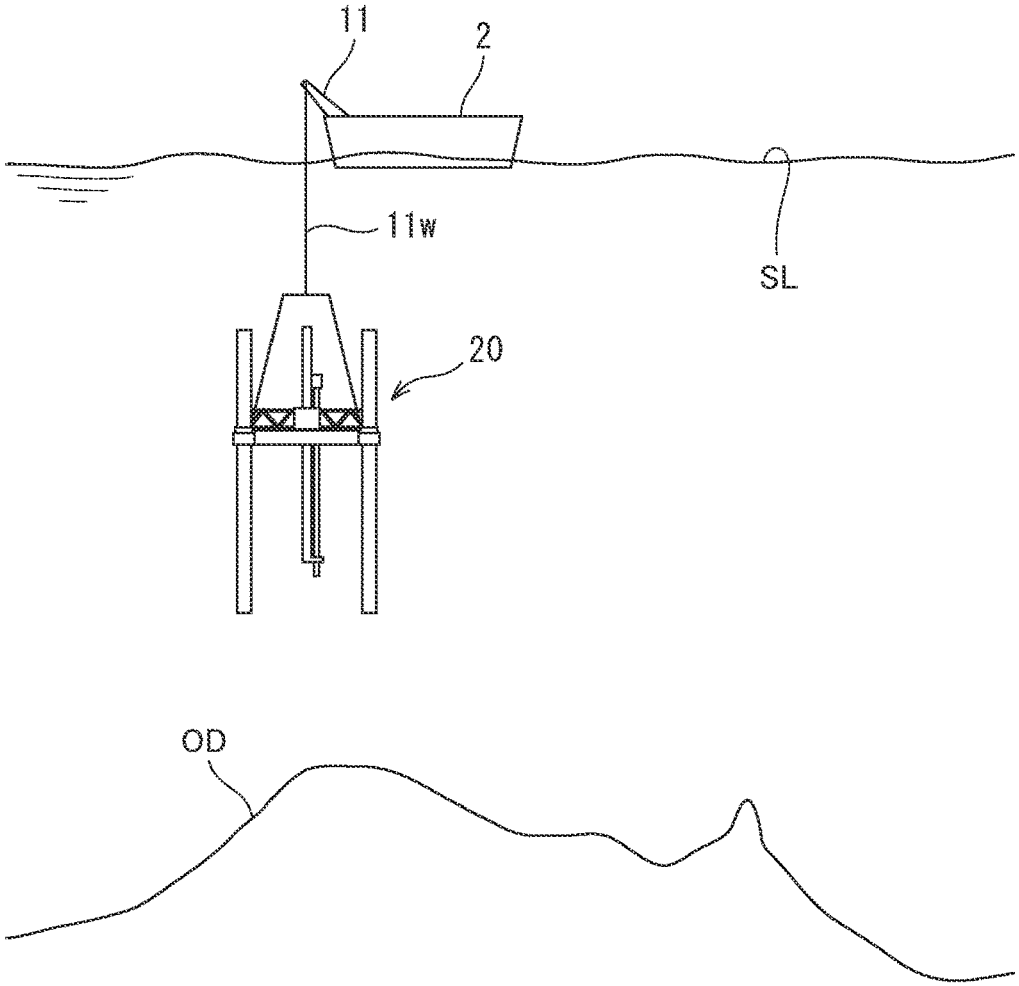
FIGS. 21A and 21B are diagrams illustrating one embodiment of a bottom landing method for the undersea mining base in the mining system of the present invention.

When landing the mining station 220 on the seabed by hanging with hanging rope from the erection and installation mother ship 2, which is the towing vessel on the sea, the mining station 220 is first placed in a state of bottom-landing preparation posture illustrated in FIG. 12 in a plan view. As illustrated in FIG. 21A, the operator hangs down the mining station 220 with rope from the erection and installation mother ship 2.

Figure 22A:
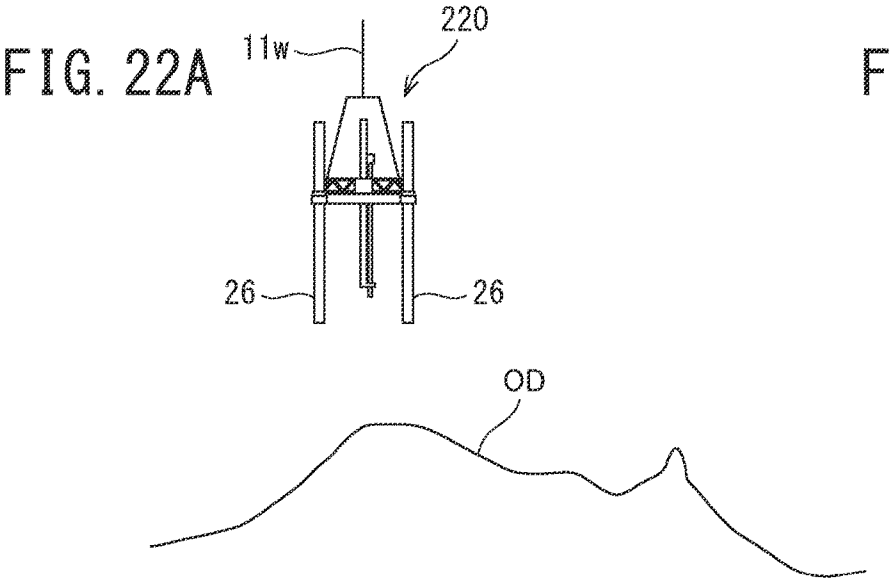
FIGS. 22A to 22D are diagrams illustrating one embodiment of the bottom landing method for the undersea mining base in the mining system of the present invention.
Figure 22B:
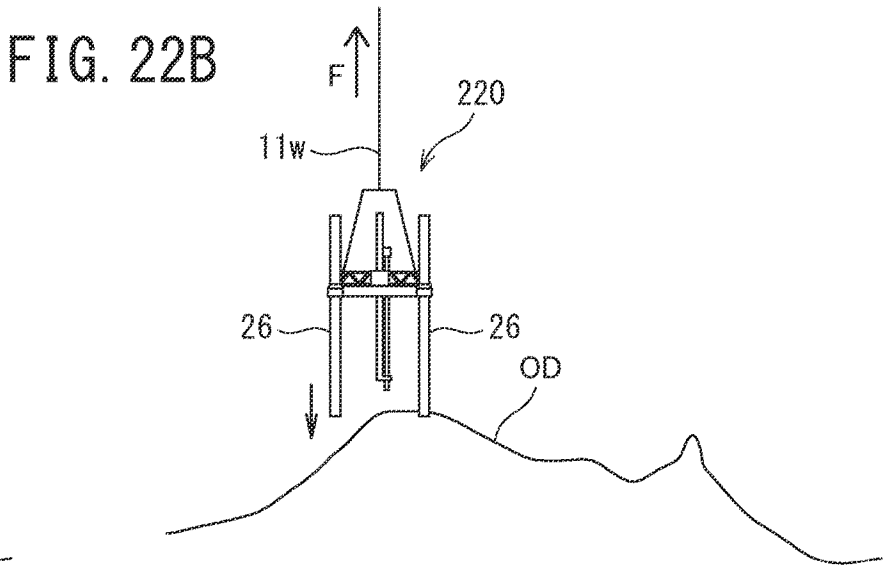

As illustrated in FIG. 22A, while paying attention to a dropped depth, the operator lowers the mining station 220 to an intended position on the seabed ore deposit OD. Then, the operator stops the hanging upon detection of responses of motor torques of at least three legs among the plurality of support legs 26, as illustrated in FIG. 22B. However, if after sitting of one leg of the support legs 26, the inclination angle exceeds a predetermined one before sitting of the other three legs, the sitting position is changed. Note that the hanging operation may be performed by manual operation of the base control unit 45 by the operator via the management computer or may be automatically controlled by the management computer and the base control unit 45. For example, the base control unit 45 of the mining station 220 executes the posture stabilization control upon acquisition of hanging operation termination information (sitting information).

Figure 22C:
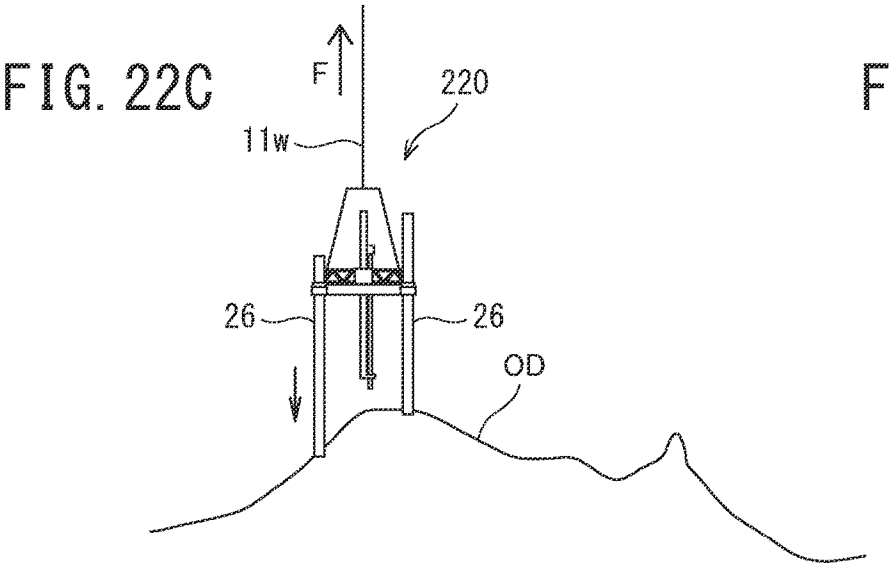

In other words, on the basis of the posture detection information of the tilt sensor, the base control unit 45 extends or retracts the landed support legs 26 so that the posture of the mining station 220 becomes horizontal, as illustrated in FIG. 22C. Based on the motor torque information, the base control unit 45 extends the support leg(s) 26 not landed, and controls so that the motor toques of the respective support legs 26 are substantially balanced, whereby the support leg(s) 26 is/are landed. The base control unit 45 transmits termination information on the posture stabilization control to the management computer of the erection and installation mother ship 2 when it determines the posture of the mining station 220 is horizontal.

Figure 22D:
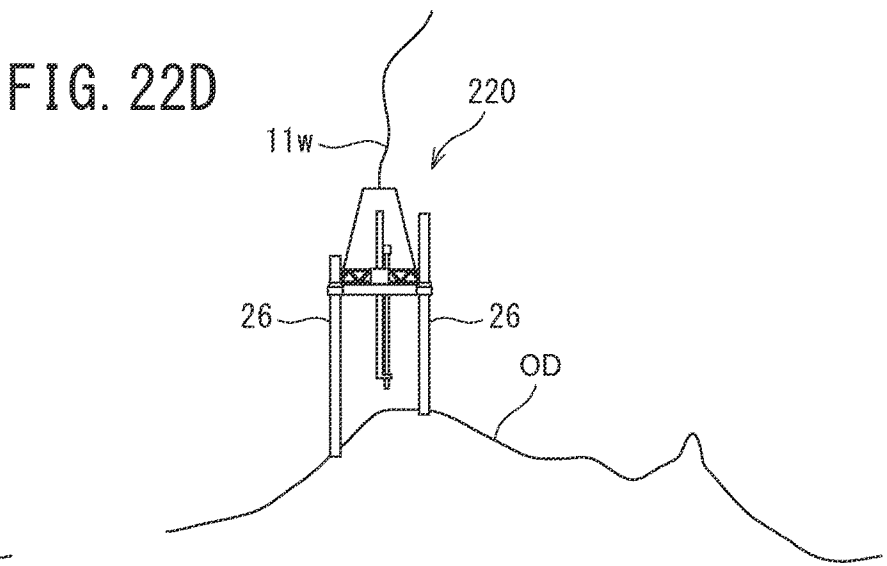

The operator in the erection and installation mother ship 2 monitors the state of the mining station 220 through the display of the management computer, and, upon confirmation of the termination information on the posture stabilization control, inputs a command for loosening tension of the hanging rope through the management computer, as illustrated in FIG. 22D. In this case, due to tension fluctuation of the hanging rope, the posture of the mining station 220 may be unstabilized. Thus, the base control unit 45 continuously executes the posture stabilization control.

Figure 21B:
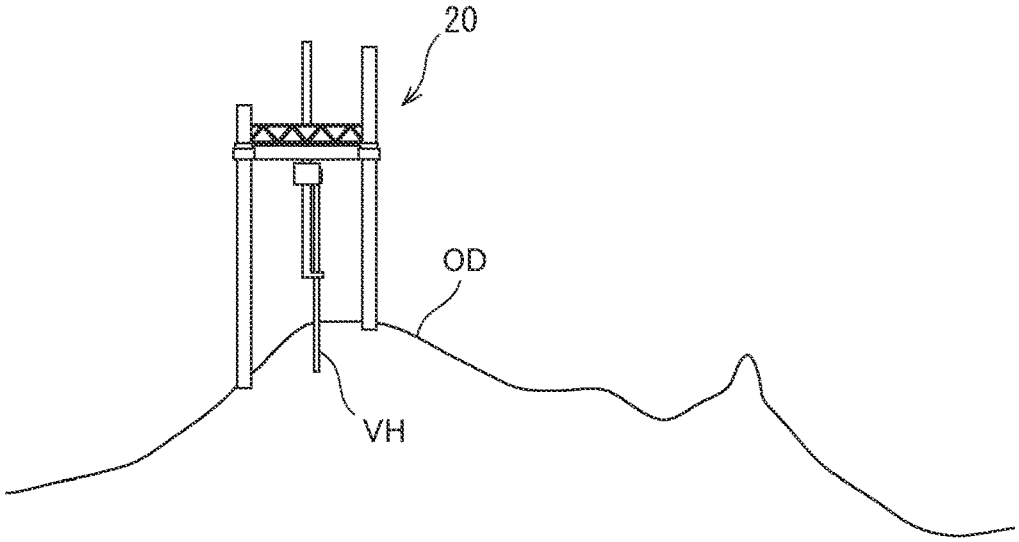

Specifically, on the basis of the posture detection information of the tilt sensor, the base control unit 45 adjusts a leg length of each support leg 26 so that the posture of the mining station 220 becomes horizontal. By doing this, the mining station 220 can be landed in a stabilized posture in an initial landed state illustrated in FIG. 22D on the seabed. After this, the operator cancels engagement of the hanging rope by an engagement cancellation device (unillustrated) for the hanging rope, and allows the self-standing mining station 220 to form the pit VH on the seabed ore deposit OD to start mining, as illustrated in FIG. 21B. Note that the structures and stabilized sitting method of the management computer and the base control unit 45 including the stabilized sitting control can also be applied to the first and second embodiments described above.

Figure 23:
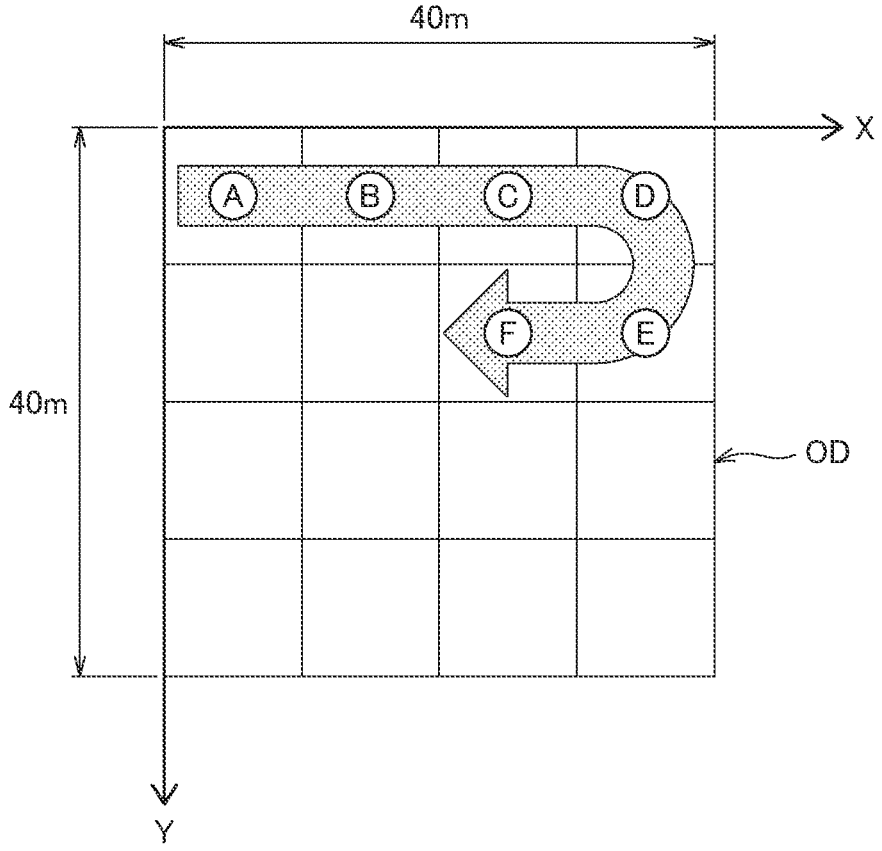
FIG. 23 is a diagram illustrating steps of mining a seabed ore deposit by the undersea mining base of the third embodiment.

Next, a self-travelling method for the mining station 220 of the third embodiment will be described with reference to FIGS. 23 to 33 as appropriate. Herein, as one example, a description will be given of steps for mining a seabed ore deposit OD measuring 40×40 m by self-travelling and excavation of the mining station 220, as illustrated in FIG. 23. Note that self-traveling operation of the mining station 220, which will be described below, is performed on the basis of a predetermined program executed by the base control unit 45 under monitoring of the management computer, but not limited thereto, and may be performed by manual operation by the operator.

(Step 1) Preparation Step

When the mining station 220 is in the initial landed state illustrated in FIG. 22D, relative positions of the upper and lower platforms 21X and 21Y are those in the bottom-landing preparation posture illustrated in FIGS. 11 and 12, in which all the support legs 26 of the upper and lower platforms 21X and 21Y are landed.

Figure 24:
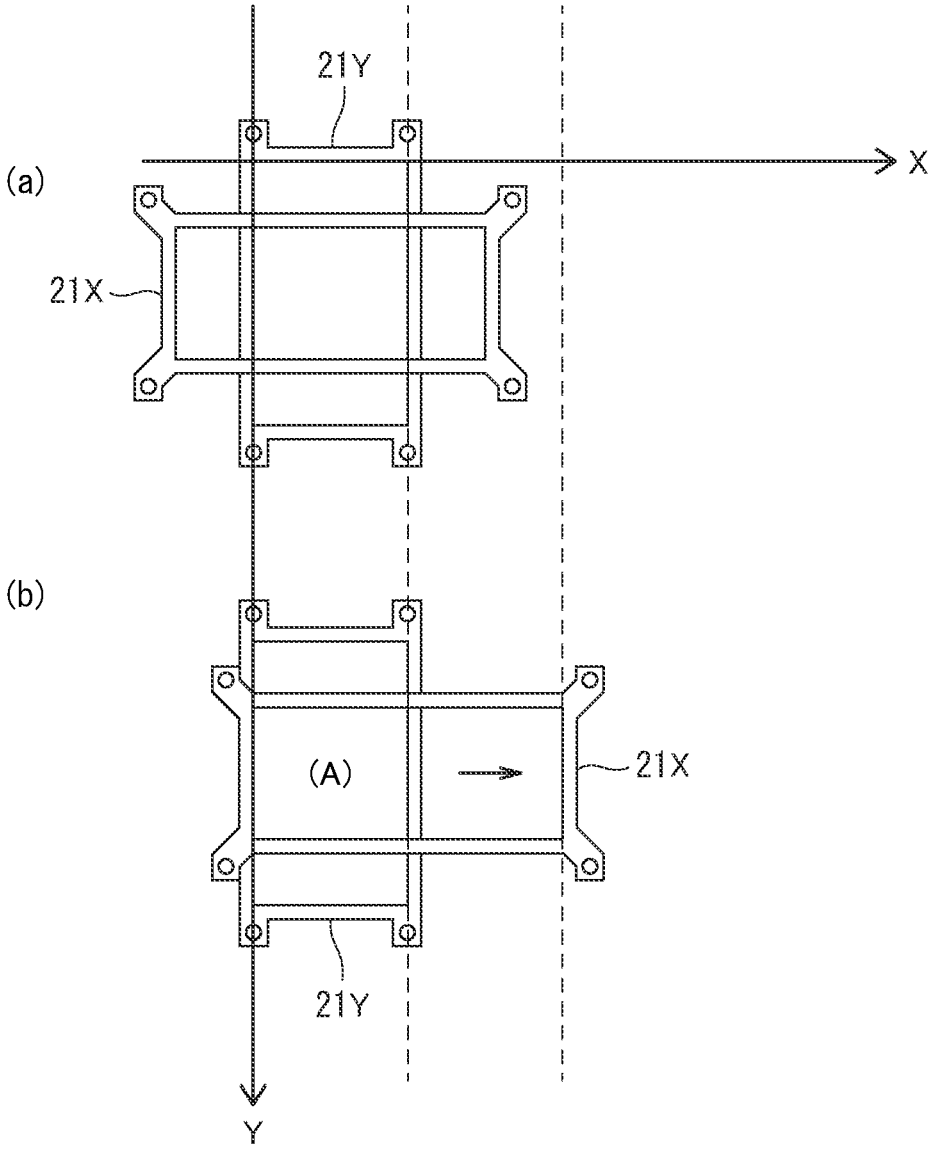
FIG. 24 is a diagram illustrating a walking motion (a transitional motion from a bottom landing preparation posture to a mining start posture) of the platform of the undersea mining base in the mining steps of FIG. 23.
Figure 25A:
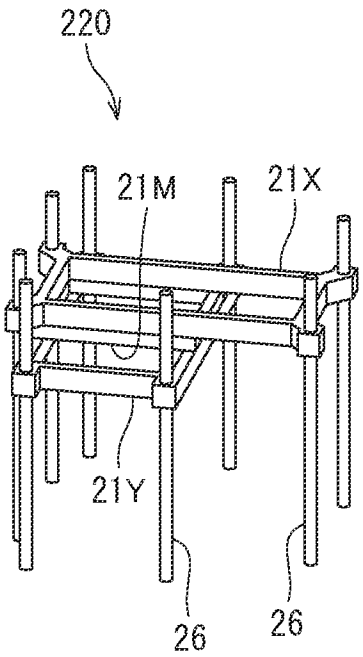
FIGS. 25A to 25D are perspective diagrams illustrating a walking motion of the undersea mining base of the third embodiment.
Figure 25B:
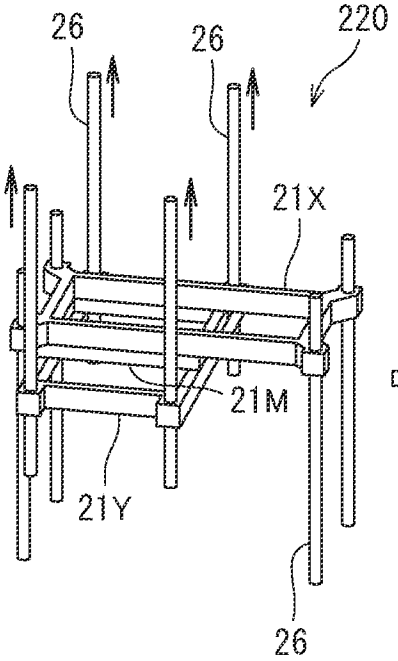
Figure 25C:
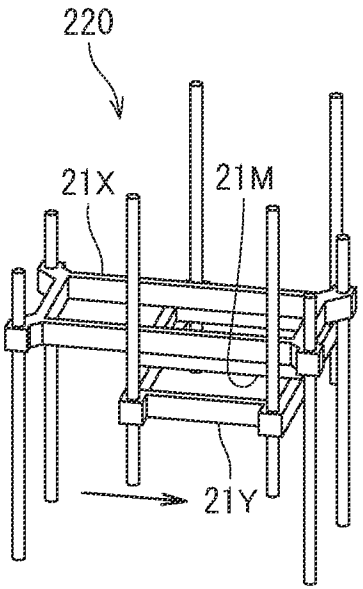
Figure 25D:
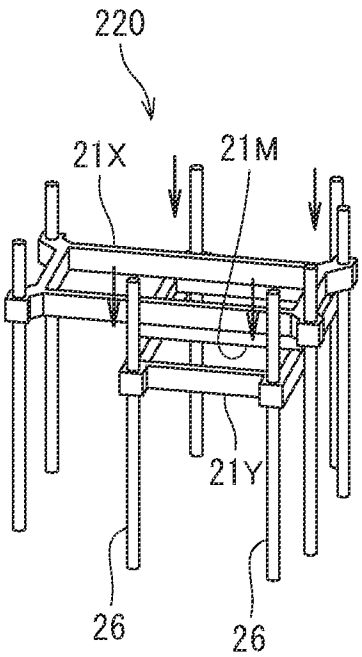

Thus, upon receipt of a mining preparation command from the management computer, the base control unit 45, first, once releases all the support legs 26 of the upper platform 21X from the seabed, from the bottom-landing preparation posture of (a) of FIG. 24, and moves the upper platform 21X fully in the positive direction of X in a state where the middle frame 21M and the lower platform 21Y are joined together, as illustrated in a plan view of FIG. 24. After that, the base control unit 45 allows all the support legs 26 of the upper platform 21X to be landed to start mining, as illustrated in (b) of FIG. 24. As a result, the predetermined region inside the upper and lower platforms 21X and 21Y becomes a first section A illustrated in FIG. 23.

(Step 2) Walking and Excavation in Positive Direction of X (Step 2-1) In the first section A, the base control unit 45 of the mining station 220 receives a mining start command from the management computer, and then mines a predetermined region (10 m×10 m) inside the middle frame 21M. When mining one section, the base control unit 45 stops walking of the mining station 220, and, in this state, performs mining while excavating the 10×10 m predetermined region inside the middle frame 21M sequentially by movement of the mining device 30 in the X direction and the Y direction in the method illustrated in FIGS. 7A and 7B (hereinafter the same).

Figure 30:
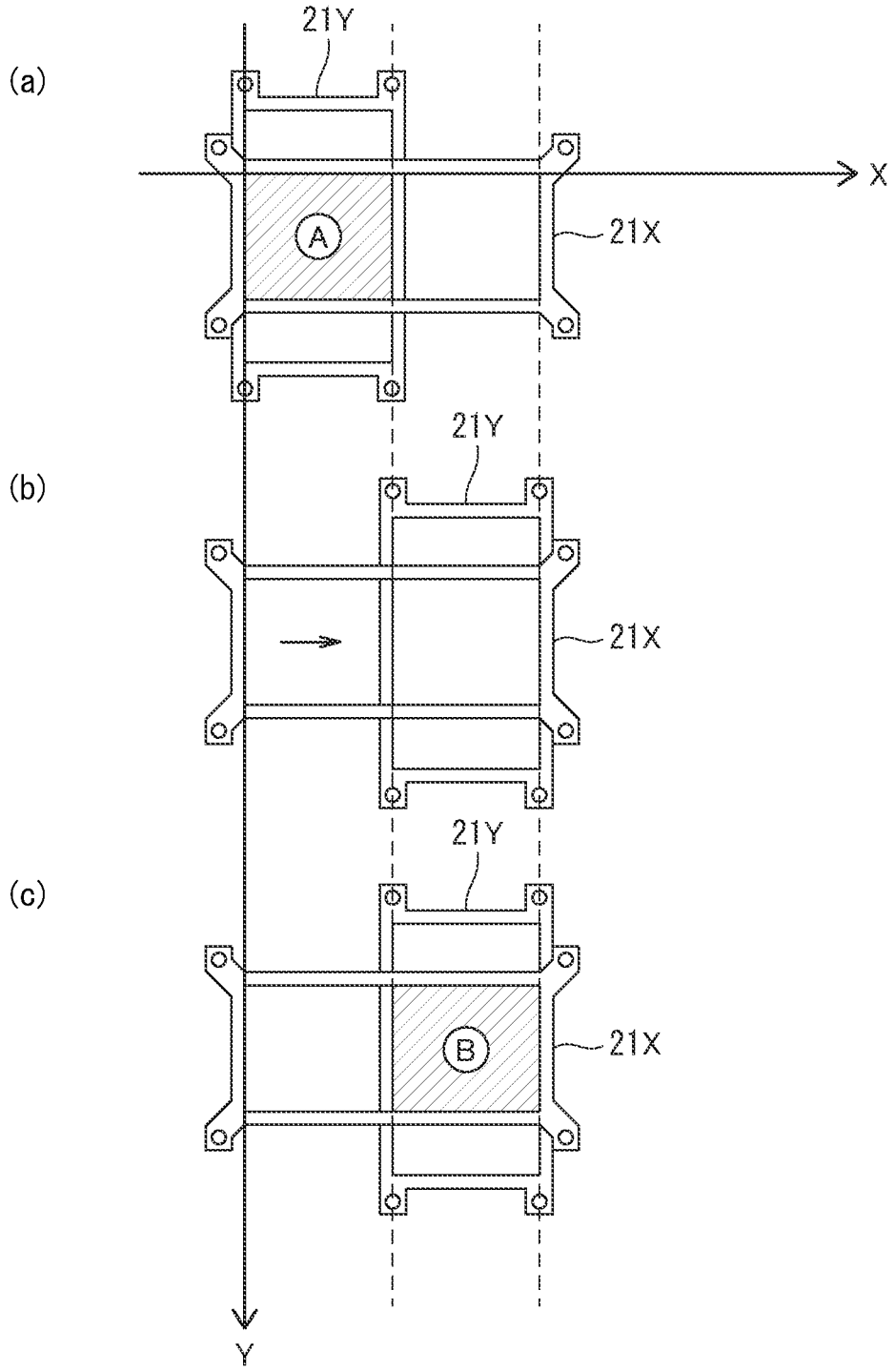
FIG. 30 is a diagram ((a) to (c)) illustrating a walking motion of the platform of the undersea mining base in the mining steps of FIG. 23.

(Step 2-2) After completion of the intended mining in the first section A, the base control unit 45 moves the platform 21, as illustrated in FIG. 30, by driving and controlling respective portions, as illustrated in FIGS. 25A to 25D, so that the predetermined region inside the middle frame 21M comes to a position corresponding to a second section B illustrated in FIG. 23.

Figure 26:
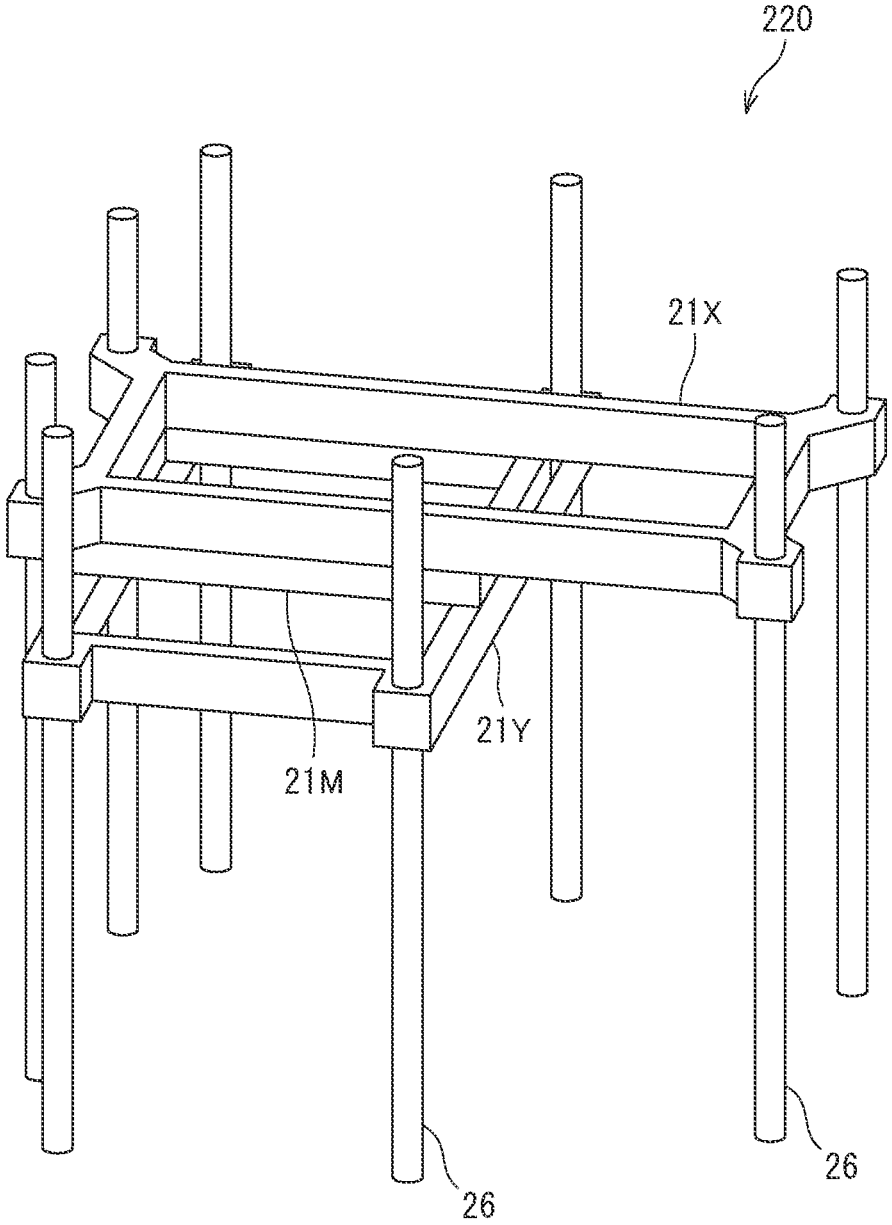
FIG. 26 is an enlarged view of FIG. 25A.

In other words, in the state where the mining of the first section A is completed, all the support legs 26 of the upper and lower platforms 21X and 21Y are landed, as illustrated in FIG. 26.

Figure 27:
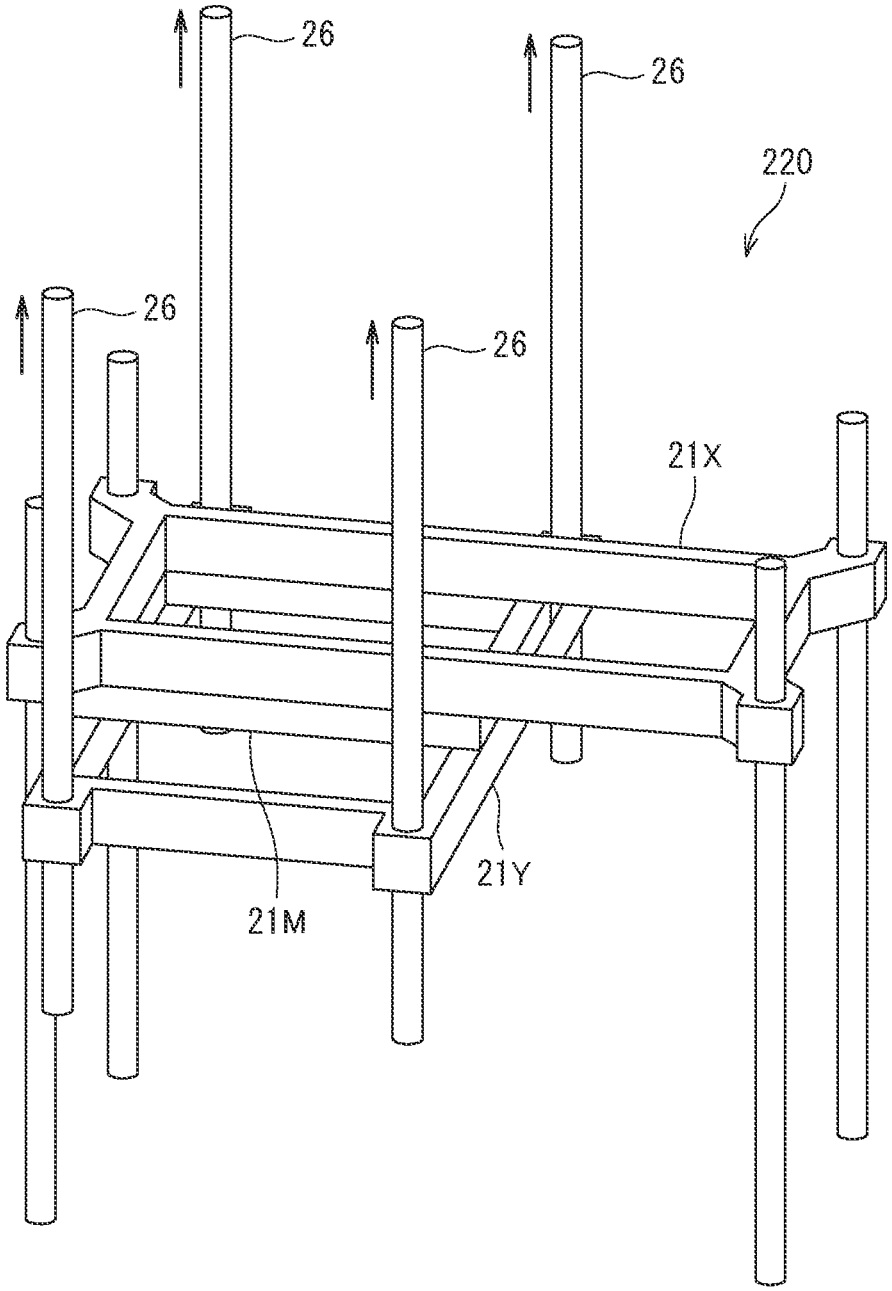
FIG. 27 is an enlarged view of FIG. 25B.

Thus, the base control unit 45 first releases the four support legs 26 of the lower platform 21Y from the seabed, while keeping the support legs 26 of the upper platform 21X landed, as illustrated in FIG. 27.

Figure 28:
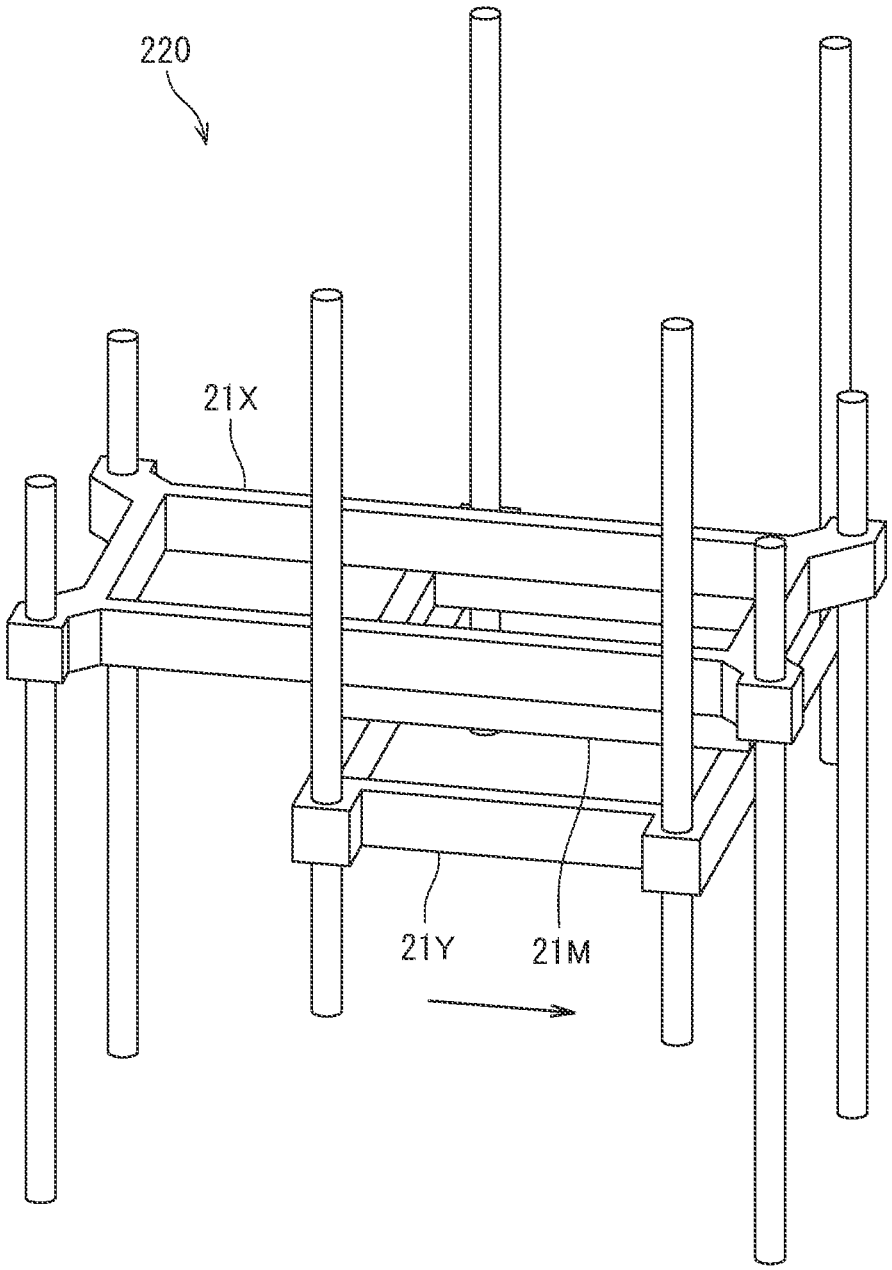
FIG. 28 is an enlarged view of FIG. 25C.
Figure 29:
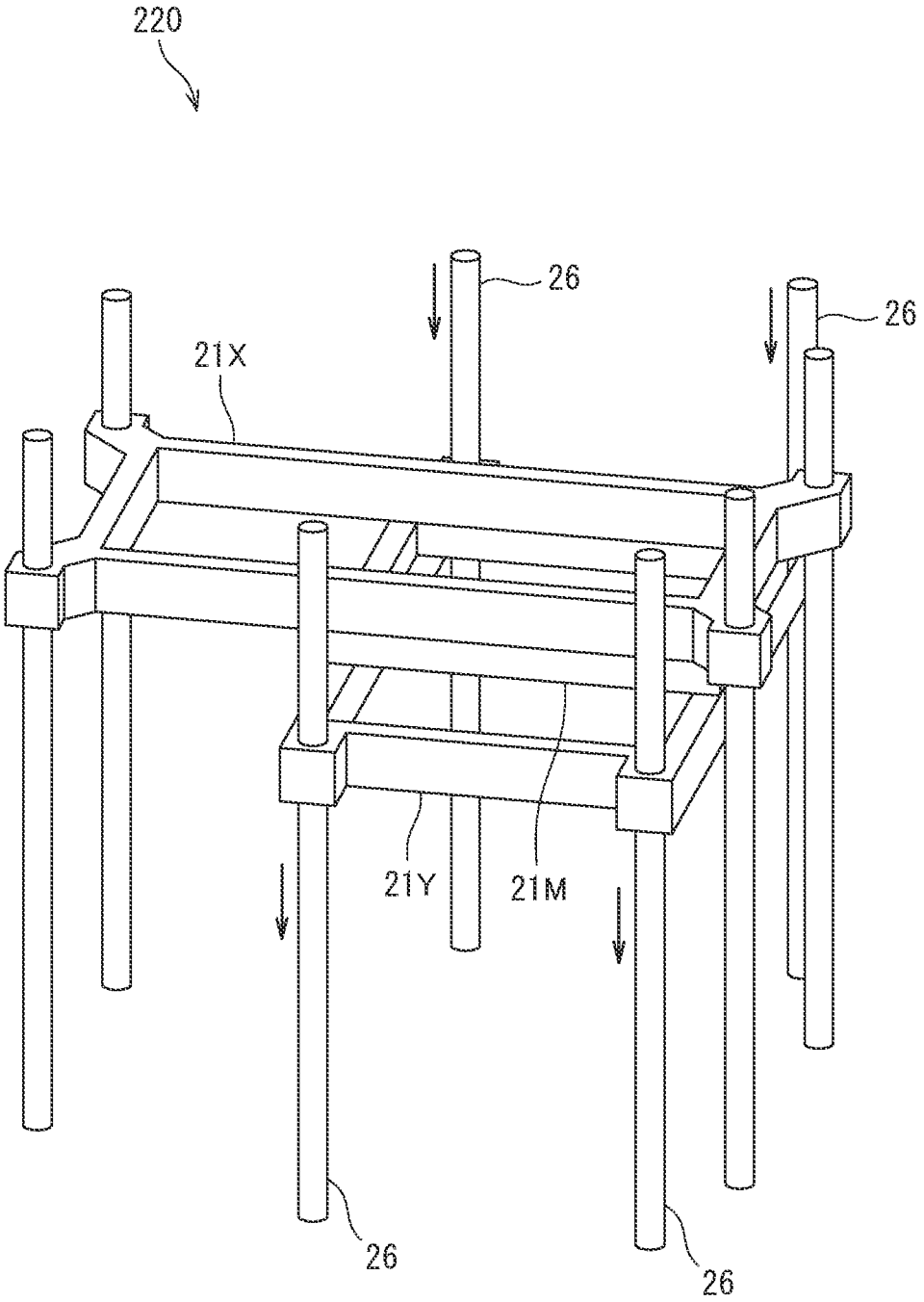
FIG. 29 is an enlarged view of FIG. 25D.

Next, as illustrated in FIG. 28 and (b) of FIG. 30, the base control unit 45 moves the lower platform 21Y and the middle frame 21M fully in the positive direction of X in a state where the lower platform 21Y and the middle frame 21M are joined together. After that, as illustrated in FIG. 29, the base control unit 45 extends the four support legs 26 of the lower platform 21Y downward to allow each to land. As a result, as illustrated in (c) of FIG. 30, the predetermined region inside the upper and lower platforms 21X and 21Y becomes the second section B illustrated in FIG. 23.

(Step 2-3) In the second section B, the base control unit 45 of the mining station 220 receives a mining start command from the management computer, and then mines the predetermined region inside the middle frame 21M.

(Step 2-4) After completion of the intended mining in the second section B ((c) of FIG. 30), the base control unit 45 releases the four support legs 26 of the upper platform 21X from the seabed while keeping the support legs 26 of the lower platform 21Y landed. Then, the base control unit 45 moves the upper platform 21X fully in the positive direction of X, as illustrated in (a) of FIG. 31, in the state where the lower platform 21Y and the middle frame 21M are joined together. After that, the four support legs 26 of the upper platform 21X are landed.

Figure 31:
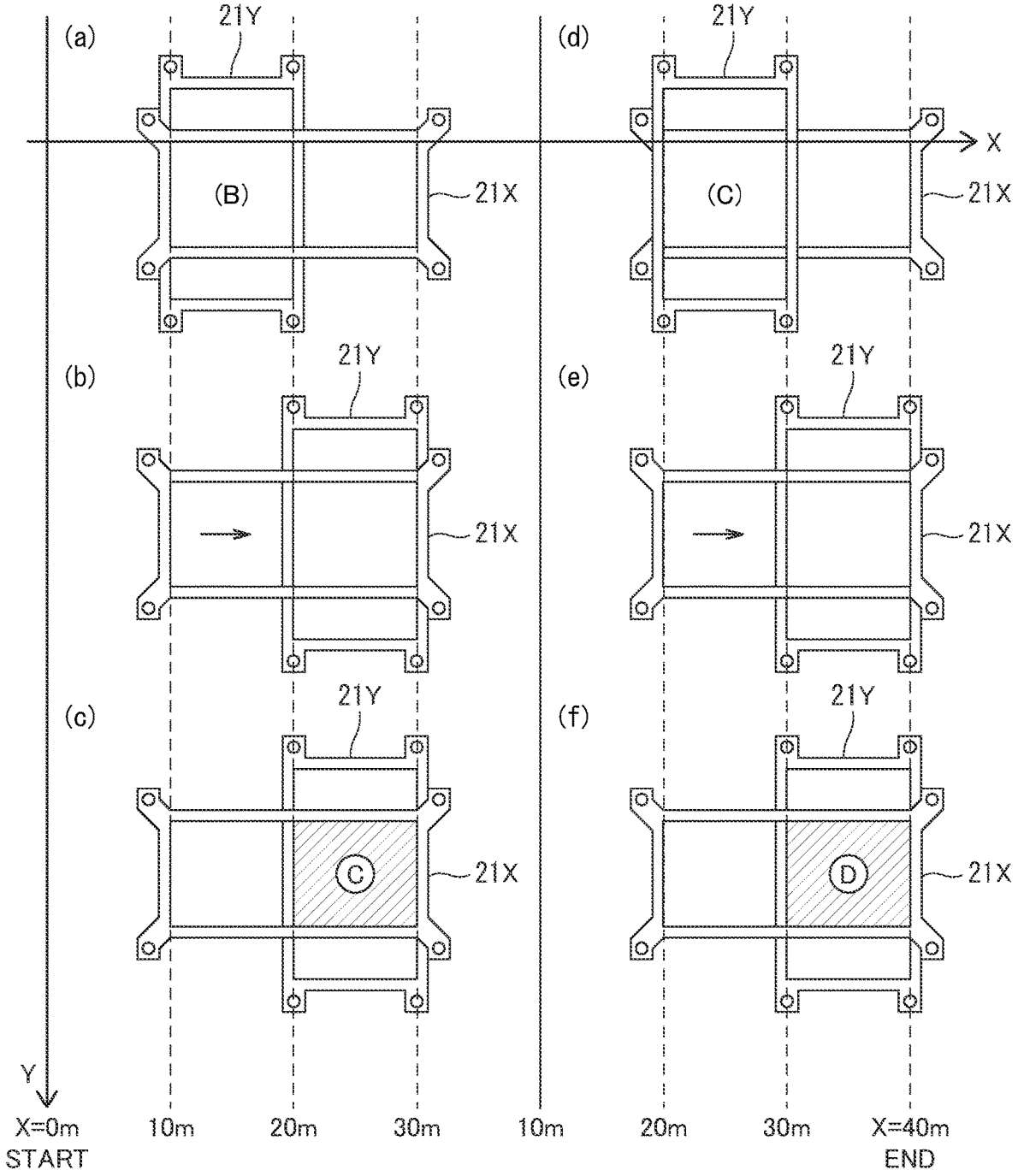
FIG. 31 is a diagram ((a) to (f)) illustrating a walking motion of the platform of the undersea mining base in the mining steps of FIG. 23.

Next, while keeping the support legs 26 of the upper platform 21X landed, the base control unit 45 releases the four support legs 26 of the lower platform 21Y from the seabed, and moves the lower platform 21Y and the middle frame 21M fully in the positive direction of X, as illustrated in (b) of FIG. 31, in the state where the lower platform 21Y and the middle frame 21M are joined together. After that, the four support legs 26 of the lower platform 21Y are extended downward to be each landed. As a result, as illustrated in (c) of FIG. 31, the predetermined region inside the upper and lower platforms 21X and 21Y becomes a third section C illustrated in FIG. 23.

(Step 2-5) Hereinbelow, similarly, after completion of the predetermined mining in the third section C, the base control unit 45 releases the support legs 26 of the upper platform 21X from the seabed while keeping the support legs 26 of the lower platform 21Y landed. Then, the base control unit 45 moves the upper platform 21X and the middle frame 21M fully in the position direction of X, as illustrated in (d) of FIG. 31, in the state where the upper platform 21X and the middle frame 21M are joined together.

Next, while keeping the support legs 26 of the upper platform 21X landed, the base control unit 45 releases the support legs 26 of the lower platform 21Y from the seabed. Then, the base control unit 45 moves the lower platform 21Y and the middle frame 21M fully in the positive direction of X, as illustrated in (e) of FIG. 31, in the state where the lower platform 21Y and the middle frame 21M are joined together. After that, the support legs 26 of the lower platform 21Y are landed. As a result, as illustrated in (f) of FIG. 31, the predetermined region inside the upper and lower platforms 21X and 21Y becomes a fourth section D illustrated in FIG. 23.

(Step 2-6) In the fourth section D, the base control unit 45 receives a mining start command from the management computer, and then mines the predetermined region inside the middle frame 21M.

(Step 2-7) Hereinbelow, similarly, the steps (2-4) to (2-6) are repeated for the walking and excavation in the positive direction of X.

(Step 3) Travelling and Excavation in Positive Direction of Y

Next, a description will be given of steps of moving in the Y direction from the state of the (Step 2-5) of the (Step 2) described above.

(Step 3-1) When moving the mining station 220 in the Y direction from the state illustrated in (f) of FIG. 31, the base control unit 45 releases the four support legs 26 of the lower platform 21Y from the seabed while keeping the support legs 26 of the upper platform 21X landed. Then, the base control unit 45 moves the lower platform 21Y fully in a positive direction of Y, as illustrated in (a) of FIG. 32, in the state where the upper platform 21X and the middle frame 21M are joined together. After that, the four support legs 26 of the lower platform 21Y are landed.

Figure 32:
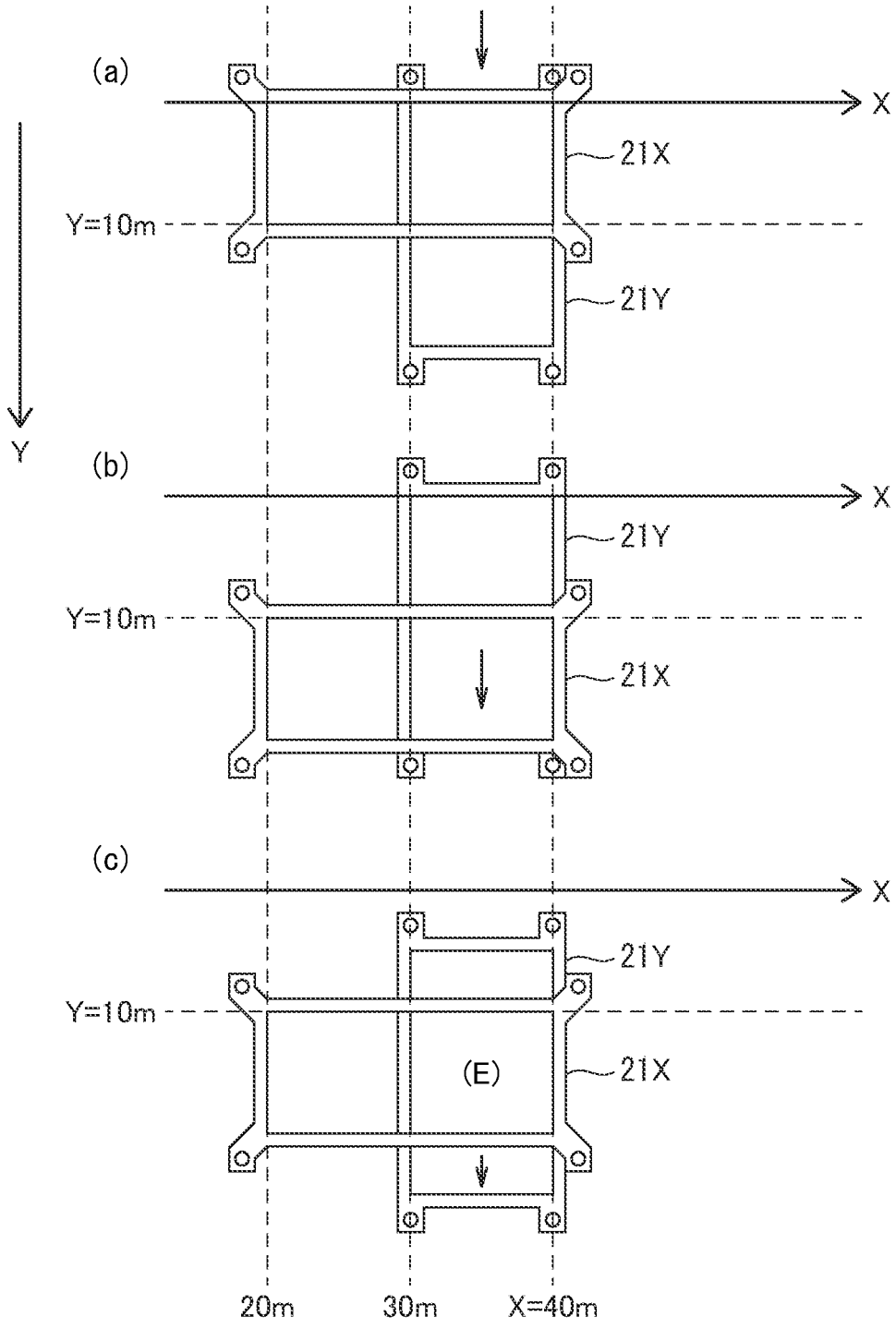
FIG. 32 is a diagram ((a) to (c)) illustrating a walking motion of the platform of the undersea mining base in the mining steps of FIG. 23.

(Step 3-2) After that, while keeping the support legs 26 of the lower platform 21Y landed, the base control unit 45 releases the four support legs 26 of the upper platform 21X from the seabed, and then, moves the upper platform 21X and the middle frame 21M fully in the positive direction of Y, as illustrated in (b) of FIG. 32, in the state where the upper platform 21X is fixed to the middle frame 21M. After that, the four support legs 26 of the upper platform 21X are landed.

(Step 3-3) Next, while keeping the four support legs 26 of the upper platform 21X landed, the base control unit 45 releases the four support legs 26 of the lower platform 21Y from the seabed. Then, the base control unit 45 moves the lower platform 21Y in the positive direction of Y to a position where a plane center of the lower platform 21Y coincides with plane centers of the upper platform 21X and the middle frame 21M, as illustrated in (c) of FIG. 32, in the state where the upper platform 21X and the middle frame 21M are joined together.

Figure 33:
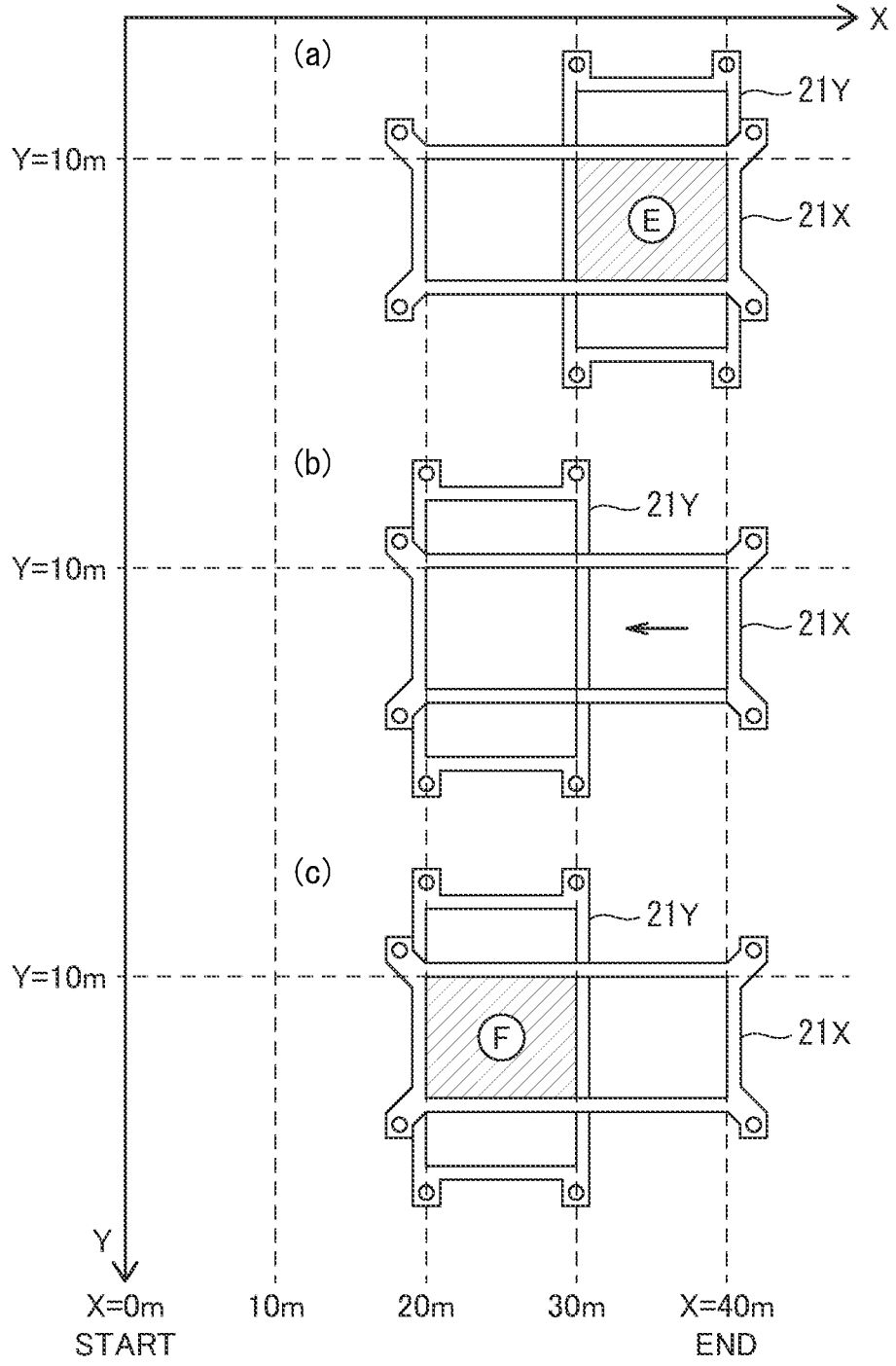
FIG. 33 is a diagram ((a) to (c)) illustrating a walking motion of the platform of the undersea mining base in the mining steps of FIG. 23.

After that, the base control unit 45 lands the four support legs 26 of the lower platform 21Y. As a result, the predetermined region inside the upper and lower platforms 21X and 21Y becomes a fifth section E illustrated in FIG. 23. As illustrated in FIG. 33, in the fifth section E, the base control unit 45 receives a mining start command from the management computer, and then mines the predetermined region inside the middle frame 21M.

(4) Repetition

Hereinafter, as illustrated in (a) to (c) of FIG. 33, when moving in a negative direction of X, the same steps as those in the positive direction of X may be performed in an opposite direction, and the operations of the (Step 2) and (Step 3) described above are repeatedly performed until excavation of the predetermined mining region (40×40 m) is completed. Additionally, regarding traveling in the X direction, the steps in the positive and negative directions of X may be executed alternately.

Thus, the mining station 220 of the third embodiment can correspond with the slopes and undulations of seabed ore deposits, as well as the mining station 220 capable of self-traveling can make it unnecessary to use the erection and installation mother ship 2, which is a support ship for changing the position (relocation) of the mining station, or can significantly reduce situations requiring the use of the mother ship 2. Thus, construction periods and cost for projects can be significantly reduced.

Figure 34A:
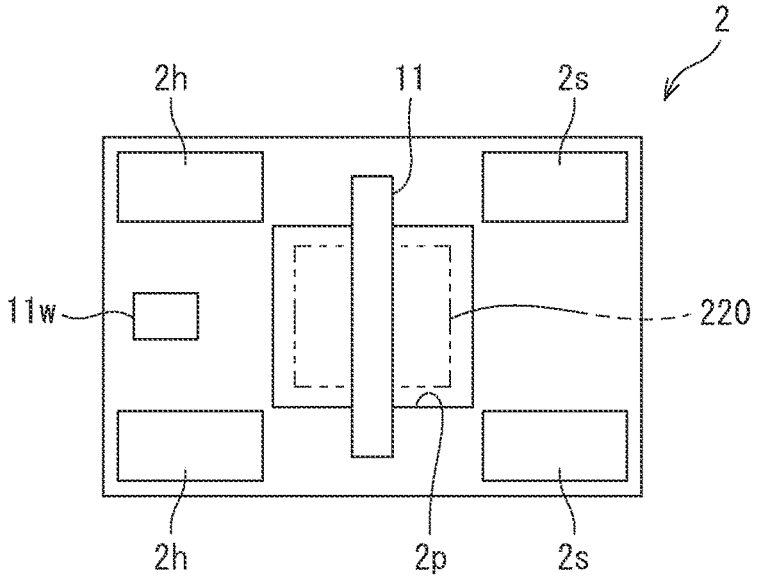
Figure 34B:
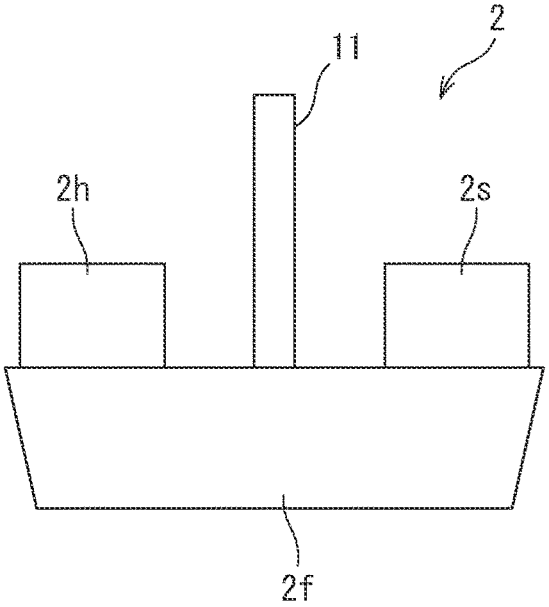
Figure 34C:
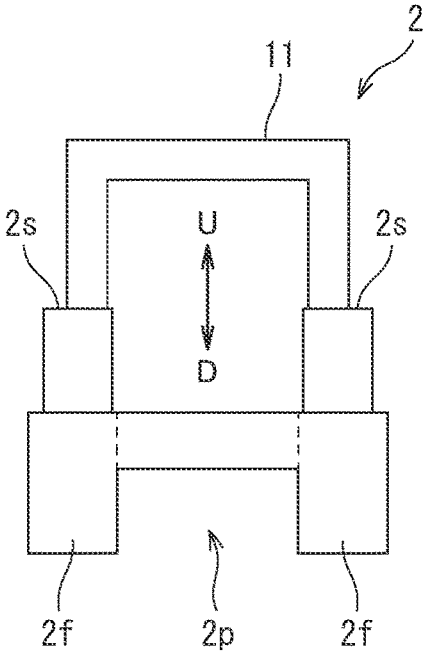

Note that while the above first embodiment has described the example of the erection and installation mother ship 2 that is a large vessel carrying the mineral lifting unit 4 and the plurality of mining stations 20, as in FIG. 1, but the present invention is not limited thereto. For example, as illustrated in FIGS. 34A to 34C, a small erection and installation mother ship 2 can be used.

The erection and installation mother ship 2 of the drawing has a ship hull having a rectangular frame shape in a plan view, and the ship hull are provided with floating bodies 2*f* on right and left sides thereof. At a center of the ship hull in a plan view is provided a rectangular moon pool 2*p*, and a crane (i.e., machine 11) is straddled over the ship hull so as to stride over the moon pool 2*p*.

On a deck of the ship hull are provided a living room 2*h* and a reservoir 2*s*, and also a winch 11*w* is equipped at an appropriate place to allow the mining station 220 to be hung down in the sea and lifted up from the moon pool 2*p*. Note that reference signs D and U in FIG. 34C represent an image in which the mining station 220 can be hung down and lifted up.

Note that, in terms of erection and installation of the mining station 220 of the third embodiment, it preferable to set dimensions of the erection and installation mother ship 2 to about 72 m in entire length and 48 m in entire width and dimensions of the moon pool 2*p* to about 30 m by 33 m. Using such a small erection and installation mother ship 2 is more preferable in terms of cost reduction, because the cost of the support ship itself, the cost of anchoring a ship at sea, and the like can be further reduced.

Herein, on seabed hydrothermal deposits, there are chimneys spouting hot water (chimney-like hot water spouting protrusions) on seamounts. Due to this, when erecting the mining station 20, 120, or 220 of the above respective embodiments on a seabed and when performing walking operation of the mining station 120 or 220 of the second or third embodiment, it is necessary to prevent or suppress interference between the mining station and obstacles such as chimneys. Thus, hereinafter, a description will be given of a mining station including chimney monitoring means, a mining base monitoring device, and a chimney avoidance method.

Figure 35:
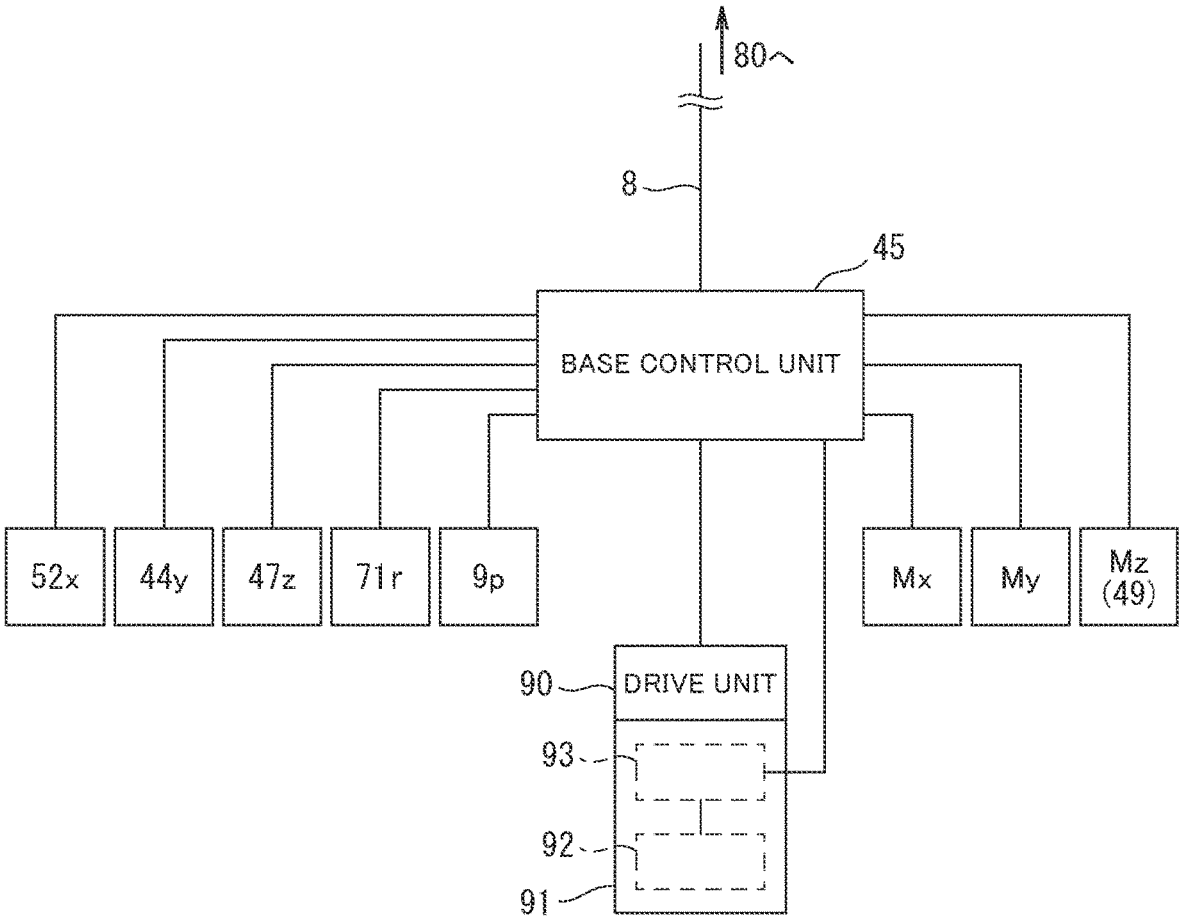
FIG. 35 is a block diagram illustrating a base control unit in the third embodiment.

In the mining station 220 of the third embodiment, the base control unit 45 is configured to include a chimney detecting unit 91, as illustrated in FIG. 35. The chimney detecting unit 91 is chimney detection means configured to detect chimneys on seabed ore deposits. The chimney detecting unit 91 includes an ultrasonic wave transmitting and receiving unit 92 and a detection unit 93 configured to detect chimneys on the basis of an echo obtained by underwater detection using an ultrasonic wave.

The ultrasonic wave transmitting and receiving unit 92 emits an ultrasonic wave toward a seabed ore deposit from a base side, and then is immediately switched to a reception status to receive a reflection wave from the seabed ore deposit. The detection unit 93 measures a round trip time from the emission of the ultrasonic wave to the reception of the reflection wave, converts the round trip time into a distance to measure the distance from the mining station 220 to the chimney, and detects an interface state of the seabed ore deposit and the presence or absence of a chimney.

The chimney detection means illustrated in FIG. 35 is searchlight type sonar (multi-beam sonar) in which a drive unit 90 is added to the chimney detecting unit 91. The chimney detecting unit 91 is provided, for example, at a highest appropriate place in the center of the platform 21, where while the chimney detecting unit 91 performs search at a viewing angle that is a predetermined angle, the drive unit 90 rotates the chimney detecting unit 91 by 360 degrees in the horizontal plane. This enables detection on the entire periphery of the mining station 220.

Note that the place for arranging the chimney detecting unit 91 is not limited to the "highest appropriate place in the center of the platform 21", and the chimney detecting unit 91 can be arranged at another position of the mining station 220 long as an intended search can be performed. For example, the chimney detecting unit 91 may be provided on a surface of the platform 21 facing an ore deposit side. In this case, it is possible to detect the unevenness of the ore deposit by measuring a height of a lower portion of the mining station 220 itself, including the support legs 26 and the guide shells 48, and heights of its surrounding terrain, from the surface of the platform 21 facing the ore deposit side.

Note that the chimney detection means is not limited to searchlight type sonar, and, for example, scanning sonar may be used. Scanning sonar can detect the entire circumference of 360 degrees of the mining station 220 at one time. Additionally, while the mining station 220 of the third embodiment has been described as the example including the chimney detecting unit 91 using ultrasonic waves as the chimney detection means, the present invention is not limited thereto. Light may be used as the chimney detection means to detect chimneys. For example, the base control unit 45 can be configured to include an image processing unit for detecting chimneys on seabed ore deposits by camera or image sensor.

Furthermore, in the mining station 220 of the third embodiment, the base control unit 45 is configured to execute avoidance control to avoid a detected chimney.

Specifically, as illustrated in FIG. 35, the base control unit 45 is configured to be capable of monitoring torques of the motors driving the respective movement mechanisms described above by acquiring from detection values of respective torque detectors 52*x*, 44*y*, 47*z*, 71*r*, 9*p*, Mx, My, and Mz (49) thereof. In addition, the base control unit 45 is configured to be capable of executing a program of chimney avoidance processing.

Note that, in the drawing, reference sign 52*x* denotes a torque detector attached to the motor of the X-direction movement mechanism 52, reference sign 44*y* denotes a torque detector attached to the motor of the Y-direction movement mechanism 44, reference sign 47*z* denotes a torque detector attached to the motor of the slide movement mechanism 47, reference sign 71*r* denotes a torque detector attached to the rotating drive mechanism of the housing unit 71, reference sign 9*p* denotes a torque detector attached to the drive unit of the high pressure water supply pump of the high pressure water supply pipe 9, and reference signs Mx, My, and Mz (49) respectively denote torque detectors respectively attached to the X drive motors Mx, the Y drive motors My, and the motors of the jack mechanisms 49.

Figure 36:
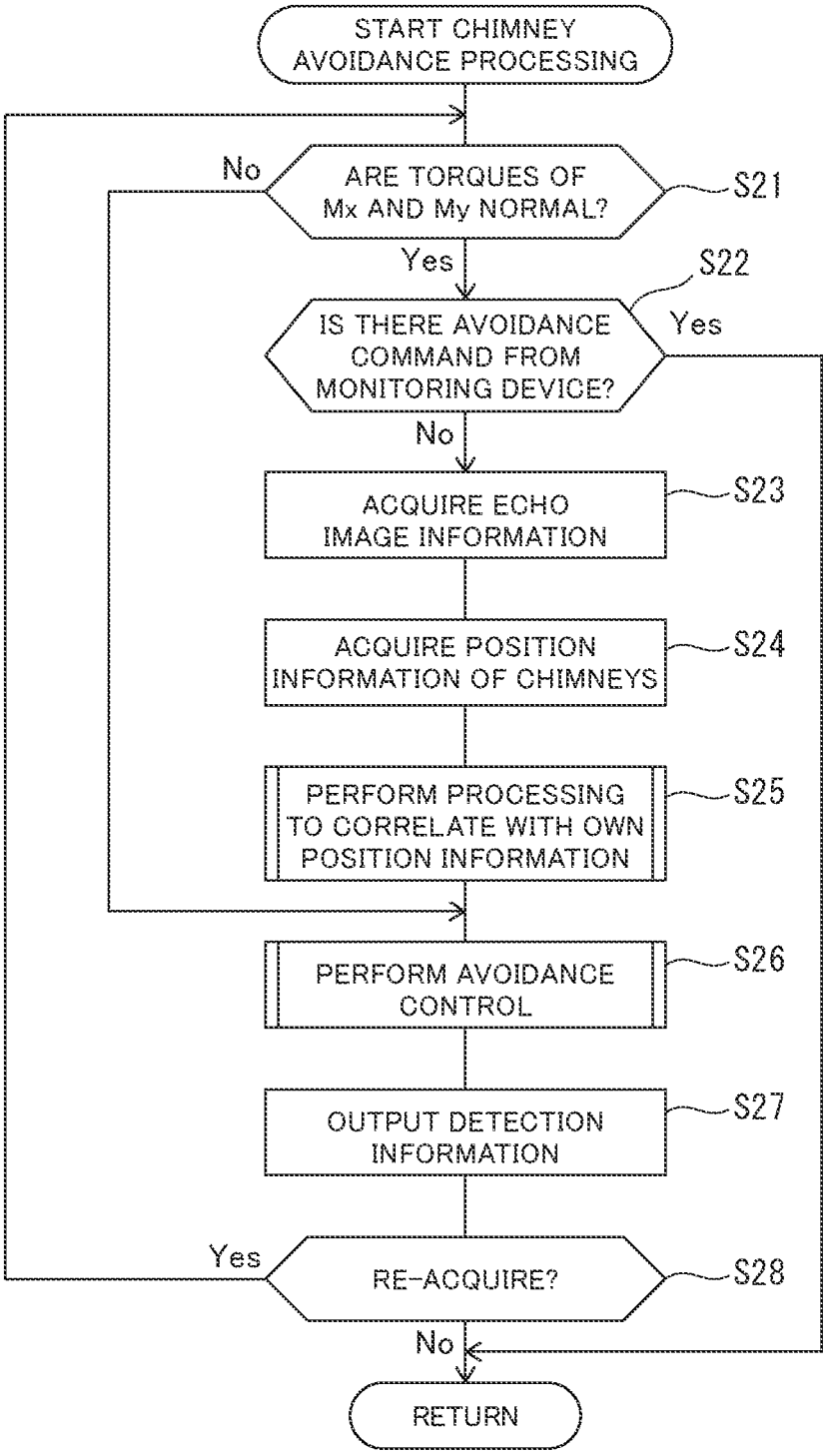
FIG. 36 is a flowchart of chimney avoidance processing to be executed by the base control unit illustrated in FIG. 35.

Specifically, when the chimney avoidance processing is executed by the base control unit 45, process proceeds to step S21 as illustrated in FIG. 36. At step S21, motor torque is checked on the basis of the torque detectors attached to the X drive motors Mx and the Y drive motors My. When the torque is within a normal value range (Yes), the process proceeds to subsequent step S22. When the torque indicates an abnormal value, i.e., the monitored torque exceeds a predetermined value (No), it is determined that the corresponding movement mechanism has contacted with a chimney, and the process proceeds to step S26.

At step S22, the presence or absence of a command for avoidance from a mining base monitoring device 80 (e.g., manual operation by the operator) is confirmed, and if there is the avoidance command (Yes), the process returns to perform control in accordance with the avoidance command, whereas if there is no avoidance command (No), the process proceeds to subsequent step S23.

At step S23, echo image information detected by the chimney detecting unit 91 is acquired, followed by step S24 where position information of chimneys detected by the chimney detecting unit 91 is acquired, and then, the process proceeds to step S25. At step S25, processing is performed to correlate position information of the mining station 220 itself with the position information of the chimneys. In the correlation processing, mutual interface information between position information of each portion of the mining station 220 itself and the position information of the chimneys is compared to calculate each relative distance. When the relative distance is closer than a predetermined threshold value, the corresponding chimney is determined to be an obstacle.

For example, when the chimney detecting unit 91 is equipped on the surface of the platform 21 facing the ore deposit side, it is possible to determine a height difference with respect to a set height of the platform 21 from position information of the support legs 26 and the guide shells 48. Furthermore, an obstacle determination can be made from a moving direction of the mining station 220.

At subsequent step S26, avoidance control is executed. The avoidance control is processing for avoiding a chimney determined to be an obstacle among detected chimneys. For example, when proceeded from step S21, control as a countermeasure for avoiding contact with an obstacle is performed, which control reversely drives a motor corresponding to any of the drive motors Mx and My whose monitored torque has been determined to have exceeded the predetermined value until the torque returns to within the normal value range.

In addition, for example, during excavation of the above-mentioned predetermined mining region (40×40 m), if there is a chimney that has been determined to be an obstacle in a section of the predetermined mining region, a bypass program for bypassing the corresponding section as a whole is executed as a countermeasure for avoidance at a time of non-contact with the obstacle, thereby avoiding the chimney determined as the obstacle. Alternatively, as a countermeasure for avoidance at the time of non-contact with the obstacle, walking processing of the mining station 220 itself may be suspended or controlled by a low-speed drive, and the process may proceed to step S27 to wait for an instruction from the operator.

When waiting for an instruction from the operator, as the countermeasure for avoidance at the time of non-contact, the process proceeds to step S27, and detection information including the position information of the chimney determined to be the obstacle is output to the mining base monitoring device 80. As a result, the operator monitoring by the mining base monitoring device 80 can take into consideration an image display, the interface information, the relative distance information, and the like on a display of the mining base monitoring device 80, thereby enabling appropriate manual operation of the mining station 220.

Herein, in a case where the operator performs a countermeasure for avoidance at the time of non-contact, it is preferable to manually avoid the chimney by measuring a terrain height from leg bottom information including the position information of the support legs 26 of the mining station 220 and the guide shells 48 to detect the unevenness of the ore deposit by, for example, the chimney detecting unit 91 on the bottom surface of the platform 21 and by referring to ultrasonic images and images captured by camera.

The reason that manual avoidance is preferable is that in general, an error obtained at measurement of a seabed base at a water depth of 2 km through sonar on the sea is about 20 m (1% of the water depth), and an assumed size of the mining station 220 is about 20 m. On the other hand, the chimney detecting unit 91 mounted on the mining station 220 has a resolution capability sufficient to detect chimneys. Thus, it may be difficult to perform correction processing when simply collating images simultaneously measured on the sea and on the seabed. Additionally, it may also be difficult to simply collate a detailed image (a map) obtained in advance near the seabed with the image measured on the seabed when the terrain has no outstanding characteristics.

Note that accuracy of measurement of the position and orientation of the mining station 220 is preferably improved by ultrasonic waves connecting the mining mother ship 1 serving as an offshore base or the erection and installation mother ship 2 to the mining station 220, a gyro equipped in the mining station 220, and additionally mounting of a depth meter. Alternatively, when lowering the mining station 220 in the sea from the offshore base, it is preferable to measure a lowering position by GPS and measure a route taken until it lands on the seabed by an inertial sensor mounted on the mining station 220. At a movement step of walking on the seabed from a seabed landing start point, it is preferable to integrate from a mechanical movement amount and a moving direction of the seabed base.

At subsequent step S28, it is determined whether or not to re-acquire detection information. In other words, if a command for re-acquisition of detection information is input from the operator on the sea, the process returns to step S21. Otherwise, the process returns to main control processing.

Next, the mining base monitoring device will be described with reference to FIGS. 37 and 38 as appropriate.

Figure 37:
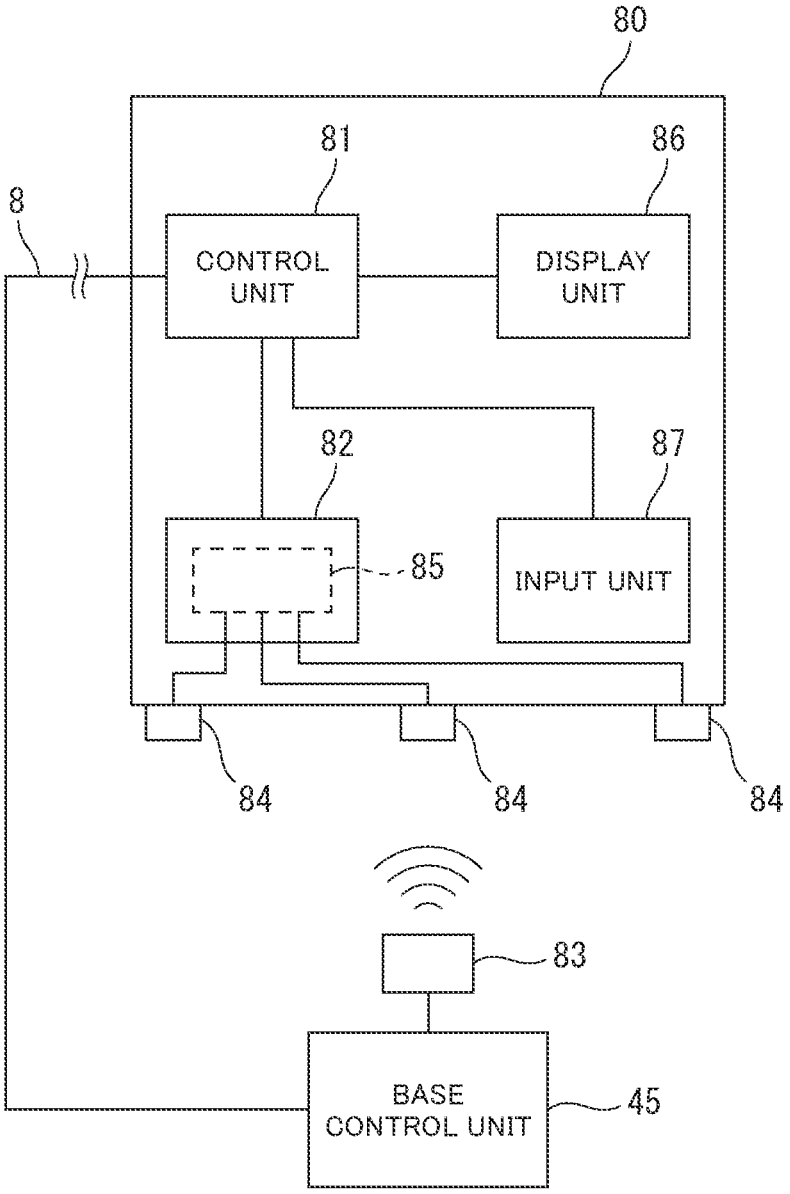
FIG. 37 is a block diagram illustrating a mining base monitoring device in the third embodiment.
Figure 38:
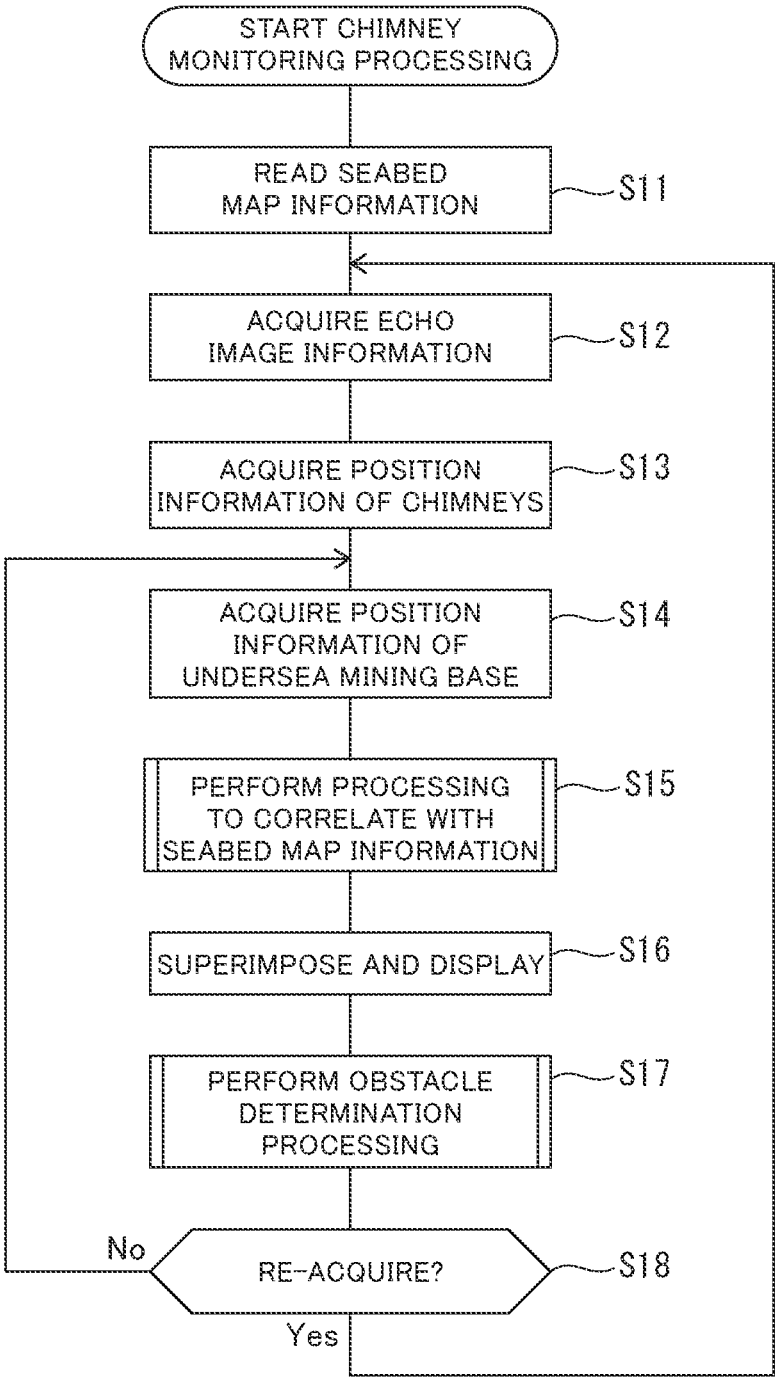
FIG. 38 is a flowchart of mining base monitoring processing to be executed by the mining base monitoring device illustrated in FIG. 37.

The mining base monitoring device 80 illustrated in FIG. 37 corresponds to the above management computer equipped in the mining mother ship 1 serving as the offshore base or the erection and installation mother ship 2 to monitor the mining station 220. Note that while the present embodiment has described the example where the mining base monitoring device 80 is equipped in the offshore base, the present invention is not limited thereto. The mining base monitoring device 80 can be equipped in a land base, and the monitoring operator can monitor not in the offshore base but in the land base distant therefrom.

As illustrated in FIG. 37, the mining base monitoring device 80 of the third embodiment is mining station position monitoring means configured to include a control unit 81, a display unit 86, an input unit 87, and an undersea detecting device 82, and also is chimney monitoring means. The control unit 81 includes software necessary for chimney monitoring processing and a computer that is a hardware resource configured to specifically execute information processing by the software. The control unit 81 is communicably connected to the base control unit 45 via the umbilical cable 8, and also is connected to the display unit 86 such as a display and the input unit 87 such as a keyboard via signal lines so that necessary data communication is possible. The display unit 86 is configured to be capable of displaying the position information of the mining station 220 and the echo image of a chimney on a monitor screen.

The undersea detecting device 82 includes an ultrasonic wave transmitter 83 equipped in the mining station 220, an ultrasonic wave receiver 84 equipped in three places of the ship bottom portion of the mining mother ship 1 or the erection and installation mother ship 2, and a detecting unit 85, and can obtain the position information of the mining station 220, for example, by a technology similar to a Super Short Base Line (SSBL).

In performing chimney monitoring, when the operator performs a predetermined input operation from the input unit 87 of the mining base monitoring device 80, chimney monitoring processing is executed. As illustrated in FIG. 38, the control unit 81 of the mining base monitoring device 80 first allows the process to proceed to step S11, where seabed map information of the corresponding sea region is read from a seabed map database stored in advance in a storage device or the like of the computer, followed by proceeding to step S12. At subsequent steps S12 to S13, the echo image information of chimneys and the position information thereof detected by the chimney detecting unit 91 of the base control unit 45 are acquired (corresponding to the chimney information acquisition unit).

At subsequent step S14, undersea mining base position information including information on the posture of the mining station 220 and the like acquired from the base control unit 45 is acquired. Note that the base control unit 45 includes a three-dimensional gyro sensor, whereby the position information of the mining station 220 in the sea can be produced at any time, with reference to initial position information when the mining station 220 is hung down from the erection and installation mother ship 2 and on the basis of subsequent relative changes in the position of the mining station 220.

Then, at step S15, on the basis of the acquired image information and position information of the chimneys and the position information of the mining station 220, processing is performed to correlate with the seabed map information of the corresponding sea region. As a result, the position information of the mining station 220 and the echo images and position information of the chimneys are correlated with the seabed map information of the corresponding sea region. At subsequent step S16, images based on the correlated data are superimposed and displayed on the display unit 86 that is the monitor screen.

As a result, with the images superimposed and displayed on the display unit 86, the operator can monitor the position and image picture of the mining station 220 in the sea and the positions and image pictures of the chimneys by visual checking (corresponding to the display synthesizing unit). The control unit 81 moves the seabed map and the echo image of the chimney superimposed and displayed on the display unit 86 in accordance with the movement of the mining station 220.

In this manner, an image picture of the mining station 220 during walking acquired as needed can be always displayed on the display unit 86. Note that the position information of the chimneys and the position information of the mining station 220 include latitude information and longitude information, and also include depth information of the chimneys and the mining station 220. As a result, exploration with higher accuracy can be performed. Additionally, it is suitable in terms of accurately determining interface states.

Then, at subsequent step S17, obstacle determination processing is executed. In the obstacle determination processing, a chimney to be an obstacle to the mining station 220 is determined from the position information of the chimneys and the position information of the mining station 220 correlated together (corresponding to the determination unit). In the obstacle determination processing, among a plurality of chimneys displayed on the monitor screen of the display unit 86, for example, a chimney closest to the mining station 220 is determined to be a chimney as an obstacle on the basis of the moving direction of the mining station 220.

When the chimney is determined to be a chimney as an obstacle, for example, a warning display for calling the attention of the operator is provided, for example, by changing colors of a displayed image of the chimney from an ordinary color (e.g., blue) to a warning color (e.g., red), displaying the image of the chimney more brightly that the other chimneys, blinking the image thereof, or another way.

At subsequent step S18, the presence or absence of an input operation for a re-exploration demand from the input unit 87 by the operator is checked. If there is a re-exploration demand (Yes), the process returns to step S12. Otherwise (No), the process returns to step S14, and information other than the position information of the mining station 220 continues to be used.

Next, the chimney avoidance method will be described with reference to FIGS. 39A, 39B, 40A and 40B.

As described above, in the third embodiment, the mining station 220 as the work device is configured so that the base control unit 45 includes the chimney detecting unit 91, and the mining mother ship 1 or the erection and installation mother ship 2 includes the mining base monitoring device 80. Thus, the structure of the third embodiment would enable avoidance of a chimney as an obstacle.

In other words, as described above, in the mining station 220, the base control unit 45 executes the avoidance control to avoid a detected chimney. The chimney detecting unit 91 detects chimneys on a seabed ore deposit on the basis of an echo obtained by underwater detection by transmission and reception of ultrasonic waves (chimney detection step), and on the basis of position information of the detected chimneys, avoidance control to avoid a chimney determined to be an obstacle is executed. Thus, interference with the chimney to be an obstacle can be avoided (interference avoidance step).

Figure 39A:
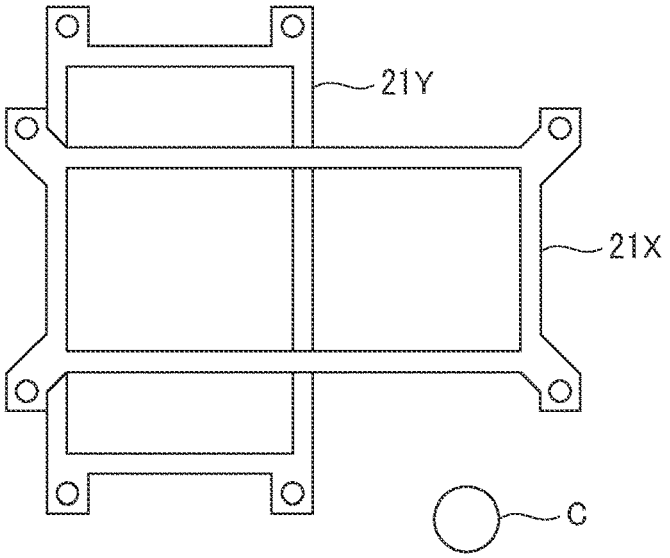
FIGS. 39A and 39B are diagrams illustrating a chimney avoidance motion in the third embodiment, in which the diagrams correspond to the state of moving steps illustrated in FIG. 30.
Figure 39B:
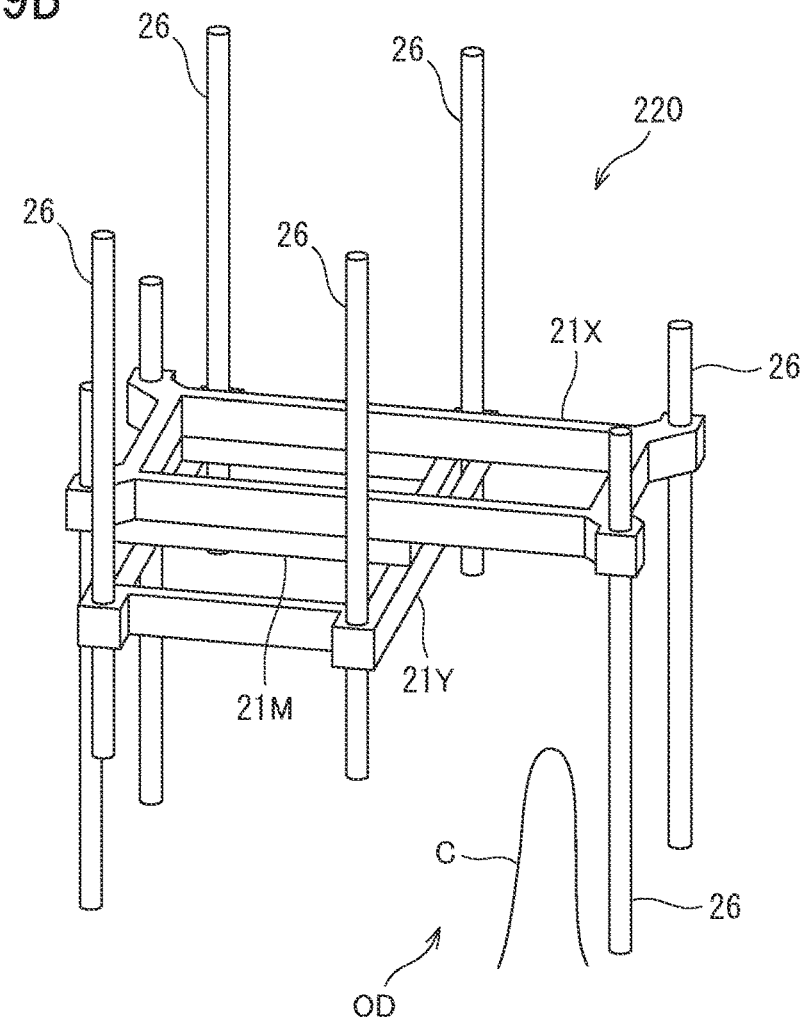

Note that, as described in the avoidance control of step S26, when there is a chimney determined to be an obstacle in the section of a predetermined mining region, executing the bypass program for bypassing the corresponding section as a whole to avoid the chimney determined to be an obstacle enables ex-ante avoidance of interference with the chimney to be an obstacle, as illustrated in an image of ex-ante avoidance of FIGS. 39A and 39B. Additionally, even when suspending the walking processing of the mining station 220 itself to wait for an instruction from the operator, interference with the chimney to be an obstacle can be avoided in advance.

On the other hand, even when ex-ante avoidance cannot be performed for some reason, the base control unit 45 monitors motor torques of the drive mechanisms including the drive motors Mx, My, and the like associated with walking, as described in the avoidance control of step S26, so that ex post avoidance of interference with the chimney to be an obstacle can be automatically performed. In other words, even when mining is performed under automatic control, not by an instruction from the operator, or even if the mining station 220 contacts with a chimney (an obstacle) due to erroneous manual operation by the operator, excessive collision with the chimney can be prevented or suppressed.

Figure 40A:
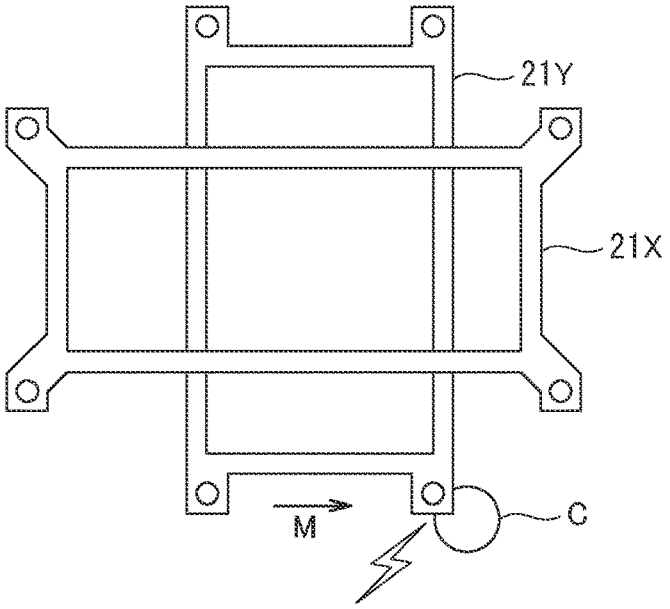
FIGS. 40A and 40B are diagrams illustrating a chimney avoidance motion in the third embodiment, in which the diagrams correspond to the state of moving steps illustrated in FIG. 30.
Figure 40B:
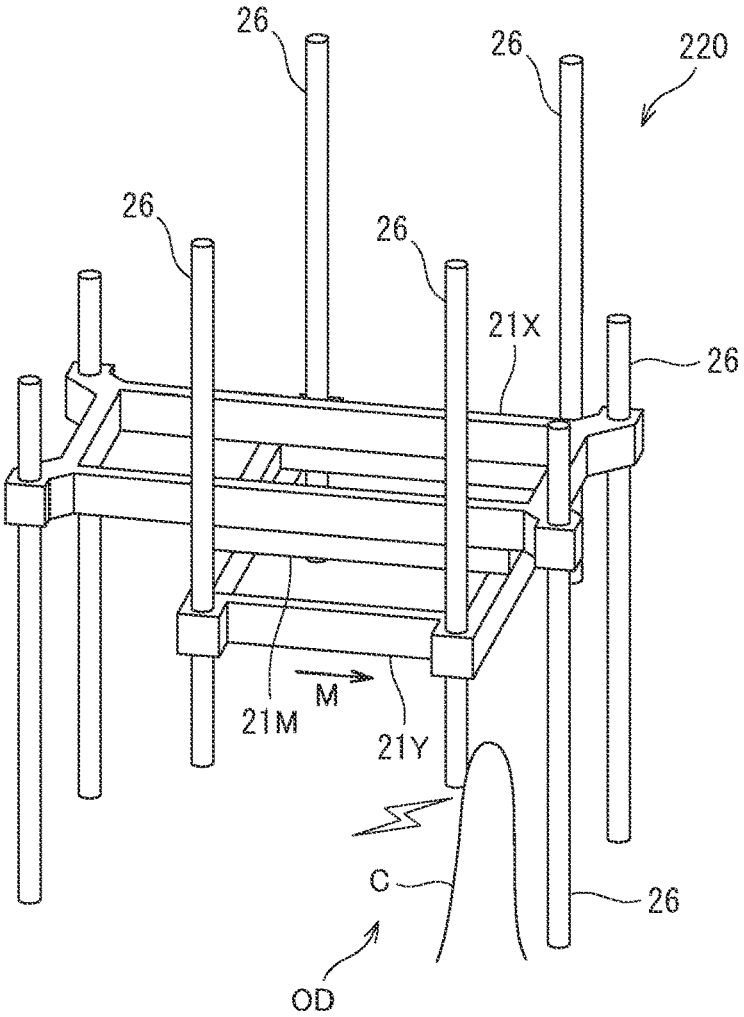

Specifically, as illustrated in an image of ex post avoidance of FIGS. 40A and 40B, now assume a case where, in the drawing, during the movement of the lower platform 21Y in the X direction (an arrow indicated by reference sign M represents an image of movement), the support leg 26 has contacted with a chimney C.

In this case, abnormal torque is generated in the Y drive motor My driving the lower platform 21Y. Due to this, the torque detector of the Y drive motor My immediately outputs an abnormal value. As a result, the base control unit 45 determines that the movement mechanism corresponding to the Y drive motor My has contacted with the chimney ("No" at step S21 of FIG. 36), and performs avoidance control, whereby the corresponding Y drive motor My can be reversely driven until the torque of the Y drive motor My returns to within the normal value range (step S26 of FIG. 36). Thus, even when contact with a chimney occurs, excessive collision with the chimney can be prevented or suppressed.

Furthermore, the operator in the mining mother ship 1 or the erection and installation mother ship 2 allows the mining base monitoring device 80 to execute chimney monitoring processing. Thus, the mining base monitoring device 80 detects chimneys on a seabed ore deposit on the basis of an echo obtained by underwater detection through transmission and reception of an ultrasonic wave by the chimney detecting unit 91 (chimney detection step), and can display a seabed map on the display unit 86 that is the monitor screen, as well as can superimpose and display echo images of the mining station 220 and the chimneys, including display of obstacle determination, thereon.

As a result, the operator monitors the state of the mining station 220 in the sea as needed, and when it is determined on the basis of position information of detected chimneys that there is a chimney that may interfere with the mining station 220, the operator can avoid the interference with the chimney as the obstacle in advance by manual operation (interference avoidance step).

Below is a list of reference numbers used in the drawings.

1: Mining mother ship (offshore mining base)
2: Erection and installation mother ship
3: Carrier ship
4: Mineral lifting unit
5: Suction pipe
6: Mineral lifting pipe
7: Discharge pipe
8: Umbilical cable
9: High pressure water supply pipe
10: Mining device main body
11: Work machine
12: Power generator
13: Reservoir
20, 120, 220: Mining station (undersea mining base)
21: Base frame (platform)
25: Mineral lift pump
26: Support leg
27: Sizer
30: Mining device
31: Cylinder
32: Water passage hole
33: Cylinder liner
34: Hammer
35: Connecting member
36: Cylinder bush
37: Check valve
38: Sleeve
39: Ring
40: Double pipe rod
41: Cylinder front chamber
42: Cylinder rear chamber
43: Movement frame
45: Base control unit (controller)
47: Slide movement mechanism
48: Guide shell
49: Jack mechanism
50: Bit
71: Housing unit
80: Mining base monitoring device
81: Control unit
82: Undersea detecting device
83: Ultrasonic wave transmitter
84: Ultrasonic wave receiver
85: Detecting unit
86: Display unit
87: Input unit
90: Drive unit
91: Chimney detecting unit
92: Ultrasonic wave transmitting and receiving unit
93: Detection unit
SL: Sea level
SB: Seabed
OD: Ore deposit
VH: Pit (bottomed hole)

The invention claimed is:

1. An undersea mining base arranged undersea and erected on a seabed, the undersea mining base mining seabed minerals while forming a bottomed hole in a seabed ore deposit, and collecting the mined seabed minerals from an inside of the bottomed hole, the undersea mining base comprising:

a seabed mineral mining device configured to form the bottomed hole in the seabed ore deposit;

a platform equipped with the seabed mineral mining device; and a chimney detection unit configured to detect at least one chimney on the seabed ore deposit, wherein the platform includes a plurality of support legs, each of the support legs being configured to be individually relatively slidable in a Z direction via a vertical movement mechanism, and wherein the platform and at least a portion of the plurality of support legs are self-movable, relative to the seabed, in at least one of an X direction or a Y direction orthogonal to each other in a horizontal plane.

2. The undersea mining base according to claim 1, comprising a controller configured to control at least one of the vertical movement mechanisms equipped in the platform.

3. The undersea mining base according to claim 2, further comprising a tilt sensor as an undersea posture stabilization mechanism, wherein, on a basis of output of the tilt sensor, the controller determines a degree of imbalance in a posture of the undersea mining base itself, and executes posture stabilization control for controlling the vertical movement mechanism of each support leg to maintain posture stability of the undersea mining base itself.

4. The undersea mining base according to claim 1, wherein the chimney detection unit includes an ultrasonic wave transmitting and receiving unit and a detection unit configured to detect the chimney on a basis of an echo obtained by underwater detection using an ultrasonic wave.

5. The undersea mining base according to claim 1, wherein the chimney detection unit includes an image processing unit configured to detect the chimney on the seabed ore deposit by camera or image sensor.

6. The undersea mining base according to claim 1, comprising a controller configured to execute avoidance control to avoid the detected chimney.

7. The undersea mining base according to claim 6, wherein each vertical movement mechanism equipped in the platform is driven by a motor, and the controller monitors torque of the motor configured to drive each movement mechanism, in which when a monitored torque exceeds a predetermined value, the controller determines that a corresponding movement mechanism has contacted with the chimney, and executes the avoidance control.

8. A mining base monitoring device equipped in an off shore base or a land base to monitor the undersea mining base according to claim 1, the mining base monitoring device comprising a chimney monitoring unit configured to monitor the chimney on the seabed ore deposit.

9. The mining base monitoring device according to claim 8, wherein the chimney monitoring unit includes a display unit configured to display an echo image of the chimney on a monitor screen.

10. The mining base monitoring device according to claim 9, wherein the chimney monitoring unit includes a chimney information acquisition unit configured to acquire the echo image of the detected chimney and position information of the chimney, a display synthesizing unit configured to, on a basis of the acquired position information, correlate with seabed map information acquired in advance, and superimpose and display the echo image of the chimney and a seabed map on the monitor screen, and a determination unit configured to determine a chimney to be an obstacle to the undersea mining base.

11. The mining base monitoring device according to claim 10, wherein the position information includes latitude information and longitude information.

12. The mining base monitoring device according to claim 10, wherein the position information includes depth information of the chimney.

13. The mining base monitoring device according to claim 10, wherein the determination unit determines that, among a plurality of chimneys displayed on the monitor screen, a chimney closest to the undersea mining base is the chimney to be the obstacle, on a basis of a moving direction of the undersea mining base.

14. The mining base monitoring device according to claim 10, wherein the display synthesizing unit moves the seabed map and the echo image of the chimney superimposed and displayed on the monitor screen, in accordance with movement of the undersea mining base.

15. An undersea mining base arranged undersea and erected on a seabed, the undersea mining base mining seabed minerals while forming a bottomed hole in a seabed ore deposit, and collecting the mined seabed minerals from an inside of the bottomed hole, the undersea mining base comprising:

a seabed mineral mining device configured to form the bottomed hole in the seabed ore deposit;

a platform, including a plurality of support legs, equipped with the seabed mineral mining device, wherein the platform and at least a portion of the plurality of support legs are self-movable, relative to the seabed, in at least one of an X direction or a Y direction orthogonal to each other in a horizontal plane; and a movement frame equipped on the platform and movable by a movement mechanism, wherein the seabed mineral mining device is attached to the movement frame in such a manner as to be movable in the at least one of the X direction or the Y direction orthogonal to each other in the horizontal plane along the platform equipped with the seabed mineral mining device by driving of the movement mechanism.

16. The undersea mining base according to claim 15, wherein the platform includes an upper platform, a lower platform, and a middle frame arranged between the upper platform and the lower platform, the middle frame and the upper platform being configured to be relatively slidable in one direction via a horizontal movement mechanism, the middle frame and the lower platform being relatively slidable in an other direction orthogonal to the one direction via a horizontal movement mechanism, and each of the upper and lower platforms including the plurality of support legs, each of the support legs being individually slidable relative to its mounting at the platform in a Z direction via a vertical movement mechanism.

17. The undersea mining base according to claim 16, wherein the movement frame is equipped on one of the upper platform or the lower platform and the seabed mineral mining device is attached to the movement frame in such a manner as to be movable in the at least one of the X direction or the Y direction orthogonal to each other in the horizontal plane along the one of the upper platform or the lower platform by driving of the movement mechanism.

18. The undersea mining base according to claim 17, wherein the seabed mineral mining device includes a guide shell fixed to the movement frame and extending in a vertical direction, a feeding mechanism attached to an upper portion of the guide shell, and a mining device main body connected to the feeding mechanism and configured to move vertically along the guide shell by driving of the feeding mechanism.

19. The undersea mining base according to claim 16, wherein each of the support legs is fixed to the movement frame via the vertical movement mechanism, wherein the vertical movement mechanism is a jack mechanism capable of sliding a respective support leg vertically and holding a slide position of the respective support leg.

20. The undersea mining base according to claim 15, wherein the movement frame includes a plurality of frames combined together in such a manner as to be mutually horizontally slidable and a movement mechanism configured to mutually horizontally slide the plurality of frames.

21. A method for avoiding a chimney on a seabed ore deposit, which is a method for avoiding interference between a work device used on a seabed ore deposit and configured to perform work necessary to mine while self-travelling on a seabed and a chimney on the seabed ore deposit, the work device comprising an undersea mining base that mines seabed minerals while forming a bottomed hole in the seabed ore deposit in a vertical direction relative to the seabed and that is movable in at least one of an X direction or a Y direction orthogonal to each other in a horizontal plane, the method comprising:

detecting the chimney on the seabed ore deposit on a basis of an echo obtained by underwater detection through transmission and reception of an ultrasonic wave; and avoiding the interference between the work device and the chimney on a basis of position information of the chimney obtained at the detecting.

* * * * *